US011981476B2

(12) United States Patent
Villasin et al.

(10) Patent No.: US 11,981,476 B2
(45) Date of Patent: May 14, 2024

(54) CAN ENDS HAVING RE-CLOSABLE POUR OPENINGS

(71) Applicant: ARDAGH METAL PACKAGING USA CORP., Chicago, IL (US)

(72) Inventors: Rex Villasin, Itasca, IL (US); Peter Kim, Arlington Heights, IL (US); Alex Teckenbrock, Lombard, IL (US); Michael R Gogola, Itasca, IL (US)

(73) Assignee: ARDAGH METAL PACKAGING USA CORP., Chicago, IL (US)

( * ) Notice: Subject to any disclaimer, the term of this patent is extended or adjusted under 35 U.S.C. 154(b) by 172 days.

(21) Appl. No.: 17/398,794

(22) Filed: Aug. 10, 2021

(65) Prior Publication Data

US 2023/0049520 A1 Feb. 16, 2023

(51) Int. Cl.
*B65D 17/00* (2006.01)

(52) U.S. Cl.
CPC ..... *B65D 17/06* (2013.01); *B65D 17/02* (2013.01); *B65D 2517/0002* (2013.01); *B65D 2517/0016* (2013.01)

(58) Field of Classification Search
CPC ..... B65D 17/28; B65D 17/02; B65D 17/34; B65D 17/4014
USPC ..... 220/265, 269, 258, 273
See application file for complete search history.

(56) References Cited

U.S. PATENT DOCUMENTS 4,678,096 A * 7/1987 LaBarge ..... B65D 47/0876 220/273
4,880,137 A 11/1989 Wells
5,062,542 A * 11/1991 Morton ..... B65D 17/506 220/268
10,981,402 B2 4/2021 Ramsey
2003/0000952 A1 1/2003 Pyren
2011/0168709 A1* 7/2011 Wells ..... B65D 17/4014 220/272
2013/0087563 A1 4/2013 Brandtner
2017/0044649 A1 2/2017 Selepack
(Continued)

FOREIGN PATENT DOCUMENTS

BR 112020018899 3/2021
CN 110832103 2/2020
(Continued)

OTHER PUBLICATIONS

European Patent Office, "Extended Search Report," issued in connection with Application No. 22189522.0, dated Dec. 16, 2022, 8 pages.
(Continued)

*Primary Examiner* — Anthony D Stashick
*Assistant Examiner* — Raven Collins
(74) *Attorney, Agent, or Firm* — HANLEY, FLIGHT & ZIMMERMAN, LLC

(57) ABSTRACT

Re-closable mobile packages are disclosed. An example can end includes a center panel having a pour opening, a first wall extending from the center panel around a perimeter of the pour opening, and a cover rotatably coupled to the center panel. The cover is rotatable relative to the pour opening between a first position and a second position. The cover interlocks with the first wall when the cover is in the first position to prevent access to the pour opening. The cover exposes the pour opening when cover is in the second position.

24 Claims, 24 Drawing Sheets

(56) References Cited

U.S. PATENT DOCUMENTS

| | | | |
|---|---|---|---|
| 2019/0031988 | A1 | 1/2019 | Brendecke |
| 2019/0048300 | A1 | 2/2019 | Gatewood et al. |
| 2019/0368020 | A1 | 12/2019 | Campbell et al. |
| 2020/0024713 | A1 | 1/2020 | Das et al. |
| 2020/0282745 | A1 | 9/2020 | Stowitts et al. |
| 2020/0291503 | A1 | 9/2020 | Mariaux et al. |
| 2020/0371453 | A1 | 11/2020 | Stowitts |
| 2021/0016933 | A1 | 1/2021 | Cepa et al. |

FOREIGN PATENT DOCUMENTS

| | | |
|---|---|---|
| EP | 3248897 | 11/2017 |
| JP | 2018512507 | 5/2018 |
| PL | 236617 | 2/2021 |
| PL | 237349 | 4/2021 |
| PL | 237506 | 4/2021 |
| WO | 2004109581 | 12/2004 |
| WO | 2018125199 | 7/2018 |
| WO | 2018189472 | 10/2018 |
| WO | 2019143832 | 7/2019 |
| WO | 2019186363 | 10/2019 |
| WO | 2020210302 | 10/2020 |
| WO | 2021016415 | 1/2021 |
| WO | 2021058998 | 4/2021 |
| WO | 2021067695 | 4/2021 |
| WO | 2021092344 | 5/2021 |

OTHER PUBLICATIONS

Canadian Intellectual Property Office, "Examiner Requisition," issued in connection with Canadian Patent Application No. 3,170,383, dated Oct. 24, 2023, 4 pages.

European Patent Office, "Communication pursuant to Article 94(3) EPC," issued in connection with European Patent Application No. 22 189 522.0, dated Nov. 15, 2023, 4 pages.

* cited by examiner

CAN ENDS HAVING RE-CLOSABLE POUR OPENINGS

FIELD OF THE DISCLOSURE

This disclosure relates generally to can ends and, more particularly, to can ends having re-closable pour openings.

BACKGROUND

Beverage cans often employ easy-open ends. Easy-open ends typically include a tear or opening panel and an attached leverage tab for pushing the opening panel into the container to open a pour opening and access contents (e.g., liquid) stored inside the container. However, once opened, easy-open ends remain permanently open and cannot be re-closed.

SUMMARY

An example can end includes a center panel having a pour opening, a first wall extending from the center panel around a perimeter of the pour opening, and a cover rotatably coupled to the center panel. The cover is rotatable relative to the pour opening between a first position and a second position. The cover interlocks with the first wall when the cover is in the first position to prevent access to the pour opening. The cover exposes the pour opening when cover is in the second position.

An example can end includes a center panel having a pour opening, a first wall extending from the center panel around a perimeter of the pour opening, and a cover coupled to the center panel. The cover includes a hinge separating a first portion of the cover and a second portion of the cover. The second portion of the cover to pivot relative to the first portion about the hinge to enable the cover to rotate between a first position to conceal the pour opening and a second position to expose the pour opening.

An example can end includes a center panel having a pour opening, a first wall positioned around a perimeter of the pour opening. The first wall extends away from the center panel. The first wall includes a first end and a second end opposite the first end. The first end of the first wall is fixed to the center panel. The second end of the first wall includes a lip extending outward relative to the pour opening. The can end includes a cover pivotably coupled to the center panel. The cover includes a second wall extending from a body of the cover toward the center panel. The second wall includes a first protrusion extending inward relative to the cover. The cover to pivot between a closed position to conceal the pour opening and an open position to expose the pour opening.

Figure 1A:
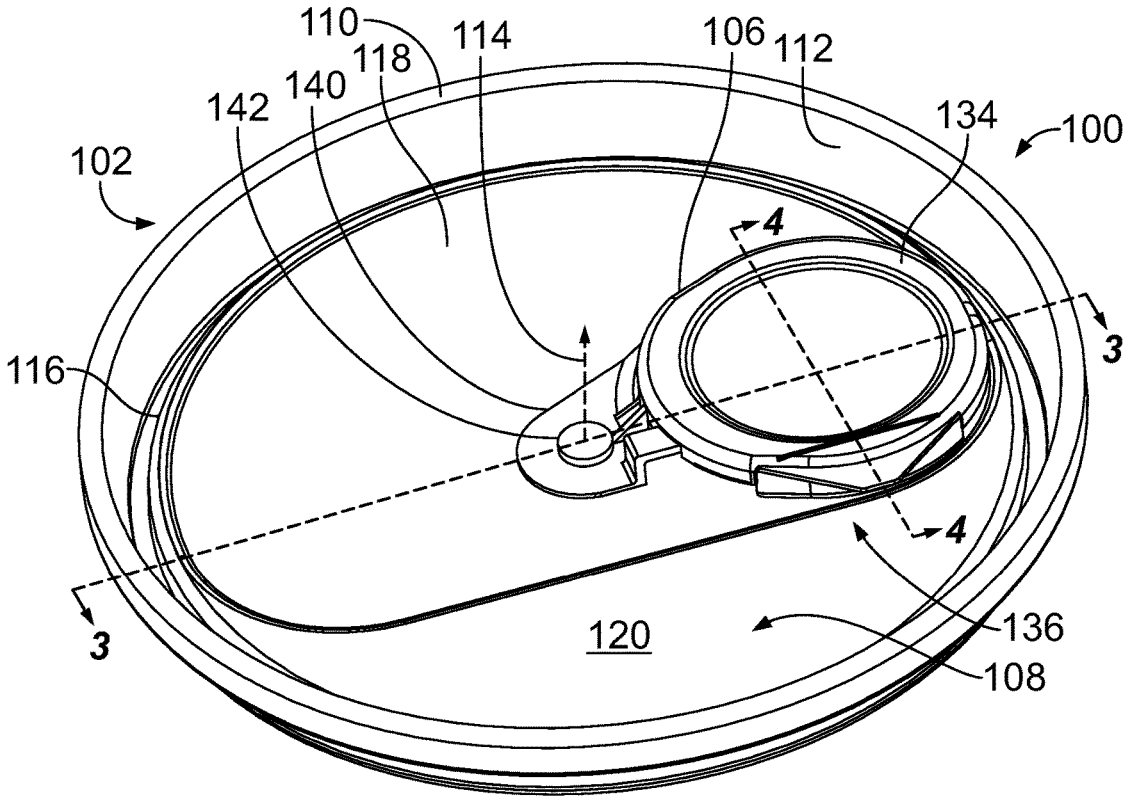
FIG. 1A is a perspective view of an example can end in accordance with teachings disclosed herein. The example can end of FIG. 1 is in an example closed position.

The figures are not to scale. In general, the same reference numbers will be used throughout the drawing(s) and accompanying written description to refer to the same or like parts. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc. are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately" and "about" refer to dimensions that may not be exact due to manufacturing tolerances and/or other real world imperfections.

DETAILED DESCRIPTION

Beverage containers employ ends (e.g., easy-open ends) having pour openings through which contents can be dispensed. Beverage containers typically include a tear or opening panel and an attached leverage tab for pushing the panel into the container to expose the pour opening and access contents (e.g., liquid, a carbonated liquid, etc.) stored inside the container. To open a can end, the leverage tab displaces the opening panel of the can end. Specifically, the opening panel is formed in the can end via a score and the tab is lifted and forced against the opening panel to cause the score to rupture or sever along a length or perimeter of the score. Accordingly, the tab displaces the opening panel to an angular orientation relative to the can end to expose the pour opening to the environment, which allows the contents in the container to be dispensed therethrough.

However, once the opening panel has been displaced, the pour panel cannot return to a closed or sealed position to block and/or cover (e.g., seal) the exposed pour opening. In other words, the opening panel of a beverage container is unable to return to a closed position relative to the pour opening after the pour opening is exposed. As a result, the contents within the container are susceptible to spilling from the container when the container is not in an upright position. In addition, after a container of a carbonated beverage is opened, the contents therein remain exposed to air in the nearby environment, which causes the contents to quickly lose their effervescence as the entrained carbon dioxide is released from the beverage and passes into the air in the nearby environment. Accordingly, the quality of the beverage can deplete over time.

To preserve the contents within a beverage container, some beverage container ends employ a cover that can be repositioned over the pour opening after the pour opening has been initially exposed. However, these beverage containers can often be costly and/or difficult to manufacture. For instance, beverage container ends having repositionable covers often include additional parts, such as springs or elastic materials, to enable the cover to return to a closed position. Furthermore, complexities associated with operating these beverage container ends can present difficulties for consumers when opening and/or closing the container. In addition, these beverage container ends often do not prevent spillage and, instead, merely cover the pour opening of the container.

Example beverage containers disclosed herein employ re-closeable can ends. In some examples, beverage containers disclosed herein include can ends having spill-proof (e.g., watertight, airtight, gas-tight, etc.), re-closable covers that enable a pour opening of a can end to be closed after being opened (e.g., an initial opening). Additionally or alternatively, example covers of example can ends disclosed herein protect and/or preserve contents enclosed by the container. In some examples, the re-closeable can ends disclosed herein enable numerous opening and closing cycles (e.g., 5 cycles, 10 cycles, 20 cycles, etc.) without causing the cover to remove or detach from the can end. For example, example covers disclosed herein can be staked to the can end and, as a result, remain attached to the can end even after being moved (e.g., repeatedly) between open and closed positions to expose and cover (e.g., block) a pour opening of the can end. In some examples, the example re-closable covers latch in the closed position to prevent undesired movement of the cover relative to the pour opening. For example, in some examples, covers disclosed herein can snap between a latched position and an unlatched position prior to moving the cover between the closed position and the open position. In some examples, re-closable can ends disclosed herein are made of metal (e.g., aluminum) to improve manufacturability and cost efficiency. Further, example can ends disclosed herein have moveable components that do not detach from or separate from a body (e.g., a panel) of the can ends.

In examples disclosed herein, can ends include an example center panel having a pour opening surrounded by an example first wall (e.g., an annular wall). The example first wall disclosed herein extends in a direction away from the example center panel and extends around (e.g., entirely surrounds) a perimeter of the pour opening. Example can ends disclosed herein include a cover rotatably coupled to the center panel. For example, example covers disclosed herein are rotatably or pivotably movable between a closed position to block a pour opening (e.g., a first position) and an open position to expose the pour opening (e.g., a second position). In particular, when an example cover disclosed herein is in a first or closed position, the example cover interlocks with the first wall of the pour opening of the can end to cover or prevent access to the pour opening and/or prevent spillage of contents from a container coupled to the can end. Example covers disclosed herein include a first portion and a second portion each having a curl or protrusion to interlock the cover with the first wall of the pour opening when the cover is in the closed position. In some examples, the first portion of the cover slides along the first wall of the pour opening and the second portion of the cover moves over the first wall of the pour opening when the cover rotates between the open position and the closed position.

In some examples, can ends disclosed herein include tamper-proof evidence features. For example, to provide evidence of tampering (e.g., tamper evidency), the cover can include brackets or perforations that rupture in response to the cover moving from the closed position for a first time. In some examples, the cover provides a seal (e.g., a leak-proof seal, a gas-tight seal, etc.) to prevent fluid (e.g., liquid) in the container from passing through the pour opening when the cover is in the closed position (e.g., positioned over the pour opening). In some examples, at least one of the cover and/or the can end (e.g., the first wall) includes a secondary seal or a tamper evidence seal to prevent contents inside the container from passing through the pour opening when the cover is in the closed position. When the cover is in the open position, the pour opening is exposed to allow contents within the container to be dispensed therethrough.

Figure 1B:
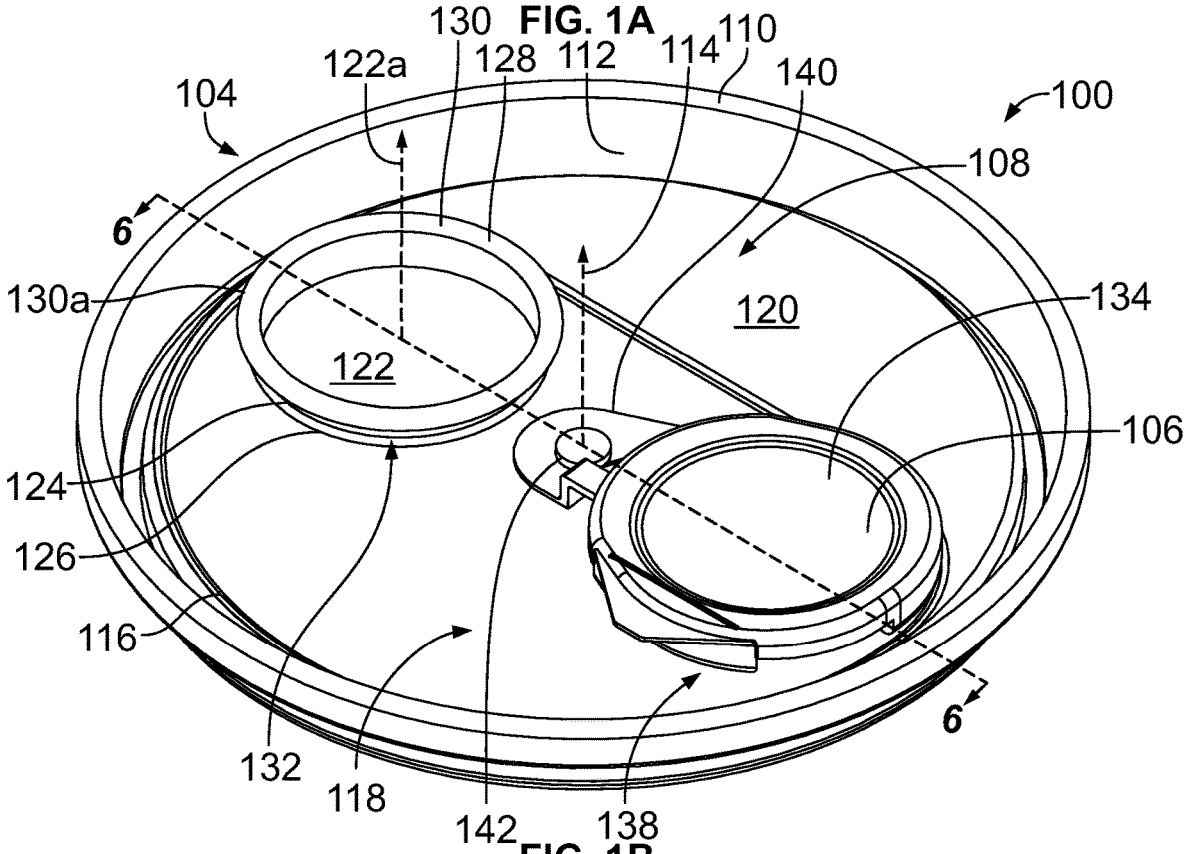
FIG. 1B is a perspective view of the example can end of FIG. 1A shown in an example open position.
Figure 1C:
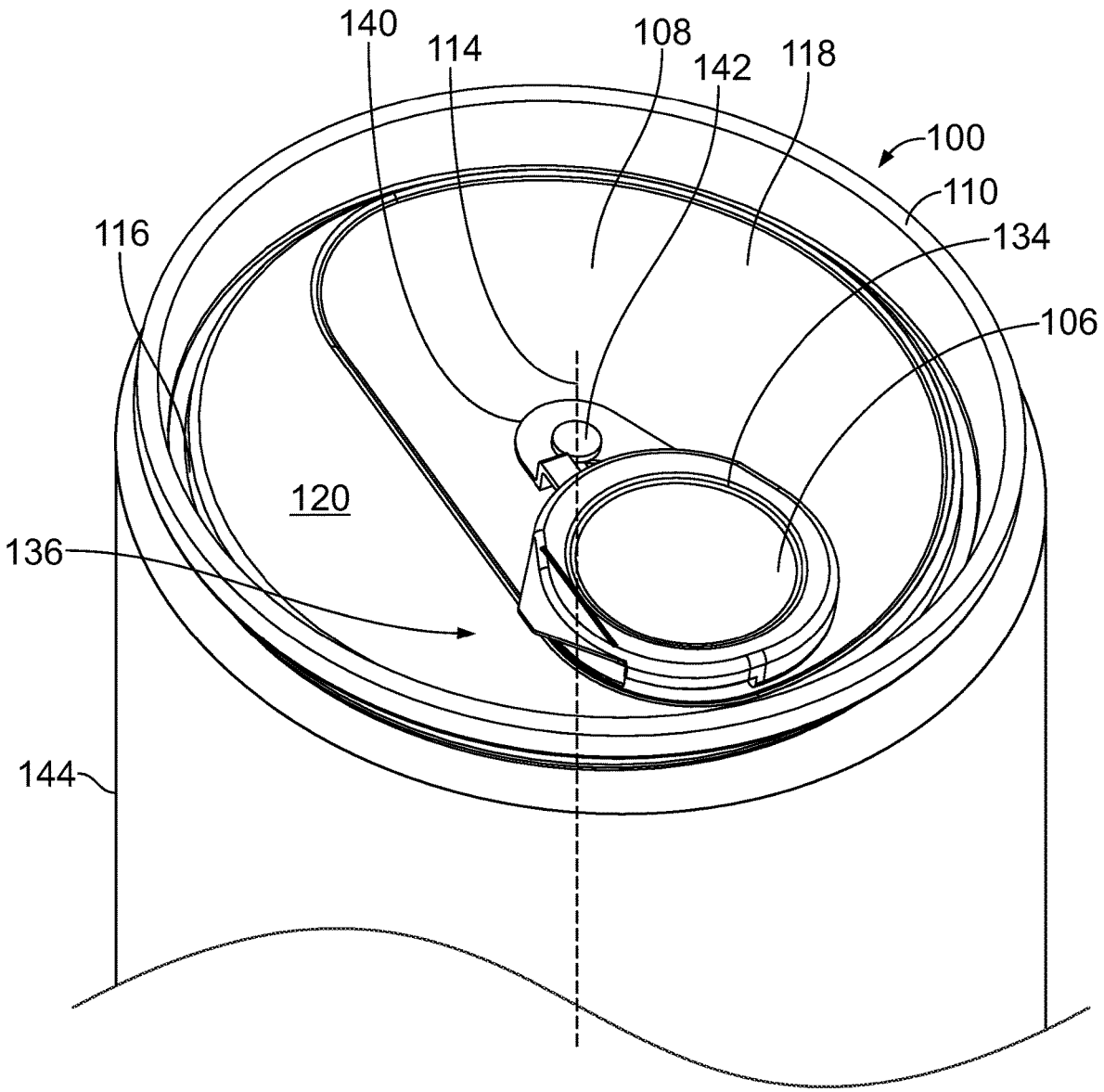
FIG. 1C is a perspective view of the example can end of FIGS. 1A-1B coupled to an example container.

FIG. 1A is a perspective view of an example can end 100 (e.g., a beverage can end) in accordance with teachings disclosed herein. The can end 100 of FIG. 1A is shown in an example closed position 102. FIG. 1B is a perspective view of the example can end 100 of FIG. 1A shown in an example open position 104. FIG. 1C is a perspective view of the example can end 100 of FIGS. 1A and 1B joined to an example can body 144 (e.g., a container).

To configure the can end 100 of the illustrated example between the closed position 102 and the open position 104, the can end 100 of the illustrated example includes an example cover 106. The can end 100 of the illustrated example has a center panel 108 separated from a seaming curl 110 by a circumferential wall 112. The seaming curl 110 of the illustrated example is generally centered about a center or longitudinal axis 114 (e.g., a vertical axis) of the example can end 100. The circumferential wall 112 of the illustrated example extends (e.g., downward) from the seaming curl 110 to a bend 116 that is joined to (e.g., integral with) the center panel 108. After formation, the can end 100 is coupled to the can body 144 via the seaming curl 110 (e.g., to enclose contents disposed in a cavity of the can body 144).

The center panel 108 of the illustrated example includes a deboss panel 118. The deboss panel 118 of the illustrated example is recessed relative to a surface 120 (e.g., an outer surface of the can end 100) of the center panel 108. In some examples, the center panel 108 may not include the deboss panel 118. The center panel 108 of the illustrated example includes a pour opening 122 (FIG. 1B) through which contents within the associated can body 144 can be dispensed when the can end 100 is in the open position 104 (FIG. 1B).

The can end 100 of the illustrated example includes a first wall 124 (FIG. 1B) extending from the center panel 108 in a direction defined by the longitudinal axis 114. In particular, the first wall 124 of the illustrated example extends from the deboss panel 118 in a direction (e.g., a vertical direction) away from the deboss panel 118. Additionally, the first wall 124 of the illustrated example is disposed around a perimeter of the pour opening 122. For example, the first wall 124 of the illustrated example surrounds the entire perimeter (e.g., circumference) of the pour opening 122. The first wall 124 of the illustrated example includes a first end 126 and a second end 128 opposite the first end 126. The first end 126 of the illustrated example is fixed (e.g., joined) to the deboss panel 118. The first wall 124 of the illustrated example is an annular wall having a circular shape. In the illustrated example, the first wall 124 is formed during formation of the can end 100 (e.g., via stamping). Thus, the first wall 124 is integrally formed with the can end 100. In some examples, the first wall 124 can be coupled to the can end 100 via, for example, welding and/or any other manufacturing process (es) or technique(s).

The second end 128 of the first wall 124 of the illustrated example includes a lip 130 (e.g., a projection, a protrusion, a catch, an annular rim, a bead, etc.). For example, the lip 130 of the illustrated example overhangs the center panel 108 and/or the first end 126 of the first wall 124. In the illustrated example, the lip 130 of the illustrated example is a curl or rim 130*a*. In other words, the second end 128 of the first wall 124 of the illustrated example extends laterally in a direction non-parallel (e.g., perpendicular) relative to a longitudinal axis 122*a* of the pour opening 122. In this manner, the center panel 108, the first wall 124, and the lip 130 of the illustrated example define a first track 132 (e.g., therebetween). In some examples, the lip 130 can be a ridge or another alternatively shaped protuberance that extends outward from the first wall 124 relative to the pour opening 122 to define the first track 132. Additionally or alternatively, in some examples, the first wall 124 includes a groove (e.g., an annular groove) defined therein between the first end 126 and the second end 128 to define the first track 132. In this example, the second end 128 can be formed without the lip 130 and a side surface of the second end 128 can be substantially flush with a side surface of the first end 126 (e.g., in the vertical direction).

As noted above, to configure the can end 100 (e.g., the pour opening 122) between the closed position 102 and the open position 104, the can end 100 of the illustrated example employs the cover 106. The cover 106 of the illustrated example is coupled to the center panel 108 (e.g., the deboss panel 118) of the can end 100. Additionally, the cover 106 of the illustrated example moves (e.g., rotates) relative to the deboss panel 118.

The cover 106 of the illustrated example includes a base or body 134 that conceals and/or prevents access to the pour opening 122 when the cover 106 is in the closed position 102 (i.e., positioned to fully cover the pour opening 122). The cover 106 is moveable (e.g., repositionable) relative to the pour opening 122 to configure the can end 100 between the closed position 102 and the open position 104. For example, the cover 106 of the illustrated example is pivotally coupled to the center panel 108. In the illustrated example, the body 134 of the cover 106 rotates relative to the surface 120 between a first position 136 (FIG. 1A) and a second position 138 (FIG. 1B). To pivotally attach the cover 106 to the can end 100, the cover 106 of the illustrated example includes a web 140. The web 140 of the illustrated example is staked to the center panel 108 to rotatably couple the cover 106 to the center panel 108. Specifically, the web 140 is staked to the deboss panel 118 via a rivet 142. As a result, the cover 106 can rotate or pivot about the rivet 142 between the first position 136 to configure the can end 100 in the closed position 102 and the second position 138 to configure the can end 100 in the open position 104. The rivet 142 of the illustrated example is aligned (e.g., coaxially aligned) with the longitudinal axis 114 of the center panel 108. Thus, the cover 106 pivots about the longitudinal axis 114 of the can end 100. In some examples, the rivet 142 is offset from the longitudinal axis 114 of the center panel 108. In other words, the cover 106 rotates about a pivot axis that is offset (e.g., spaced from, but parallel) relative to the longitudinal axis 114 of the can end 100.

FIGS. 2A-2D are perspective views of the example cover 106 of FIGS. 1A, 1B, and 1C. FIG. 2E is a bottom view of the example cover 106 of FIGS. 1A, 1B, and 1C.

Figure 2A:
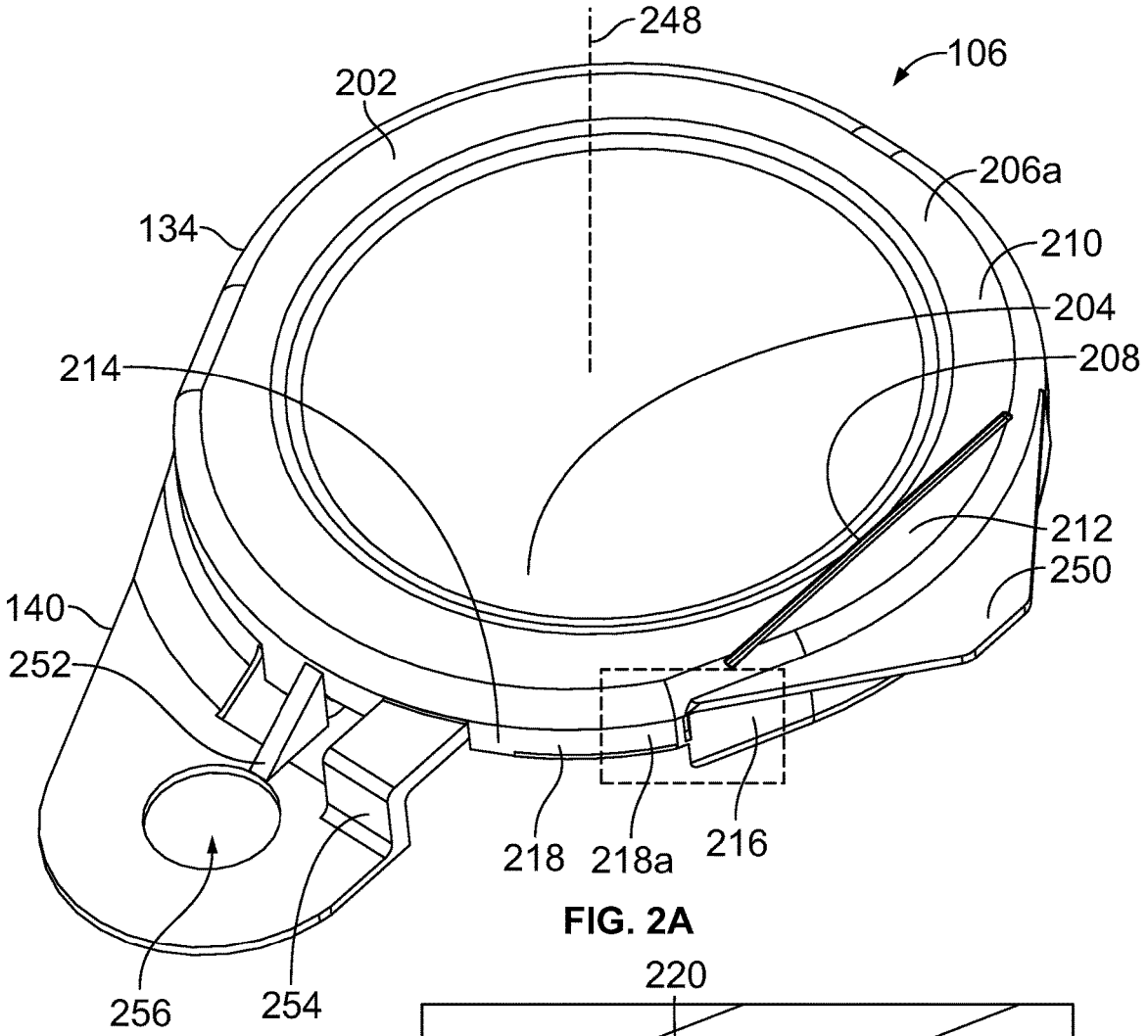
FIG. 2A is a top perspective view of an example cover of the example can end of FIGS. 1A, 1B and 1C.
Figure 2B:
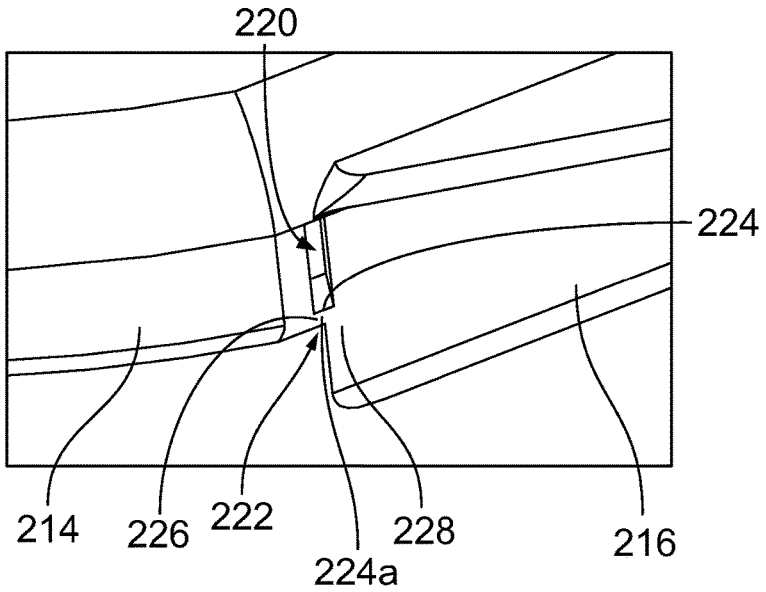
FIG. 2B is an enlarged, partial perspective view of the example cover of FIG. 2A.
Figure 2C:
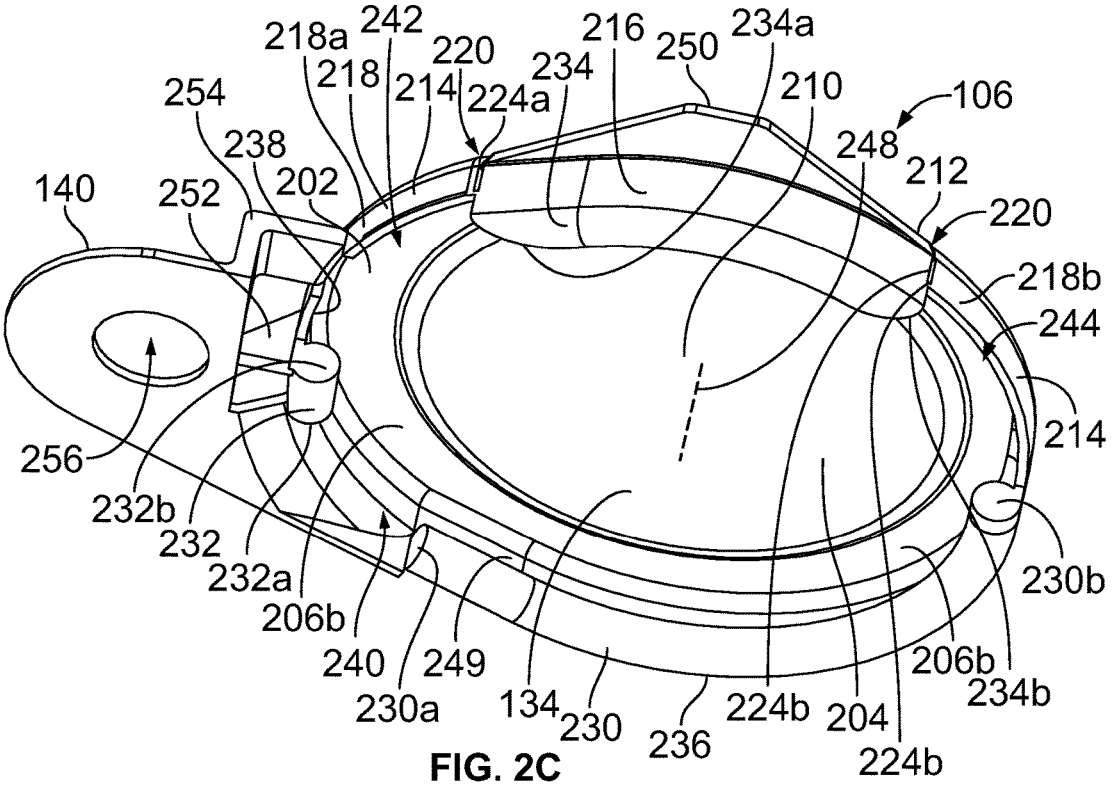
FIGS. 2C-2D are bottom perspective views of an example cover of the example can end of FIGS. 1A, 1B and 1C.
Figure 2D:
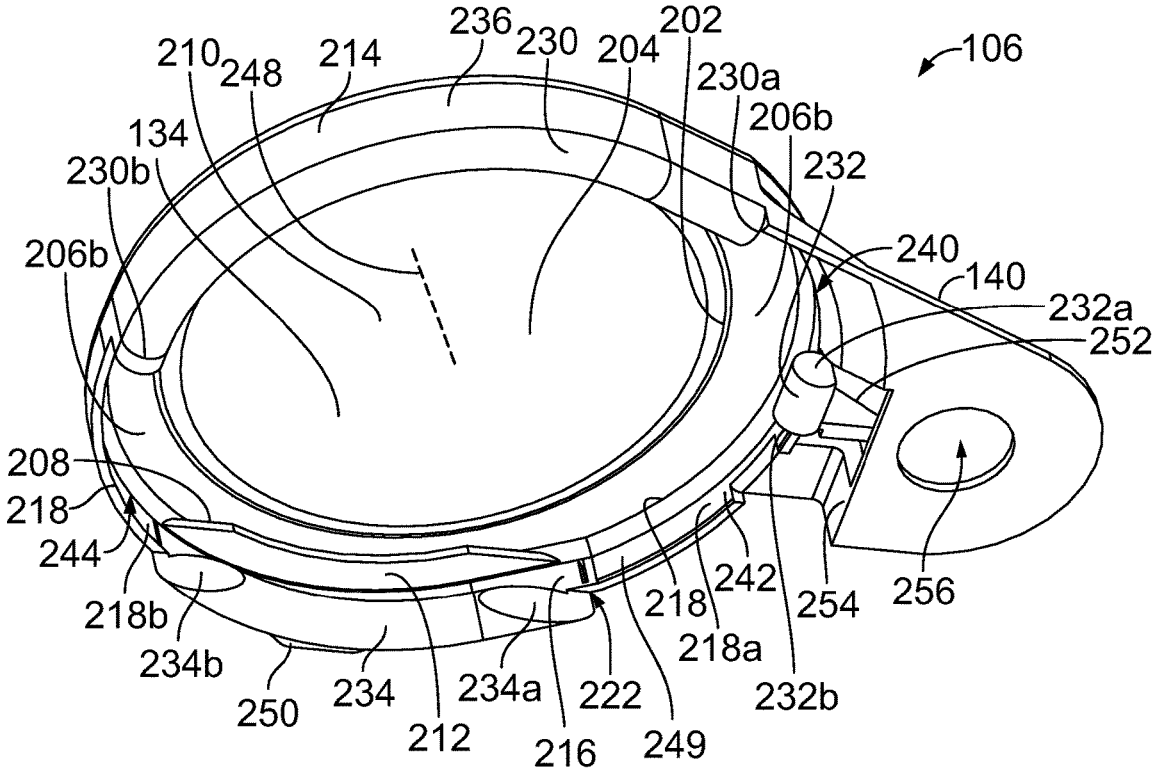
Figure 2E:
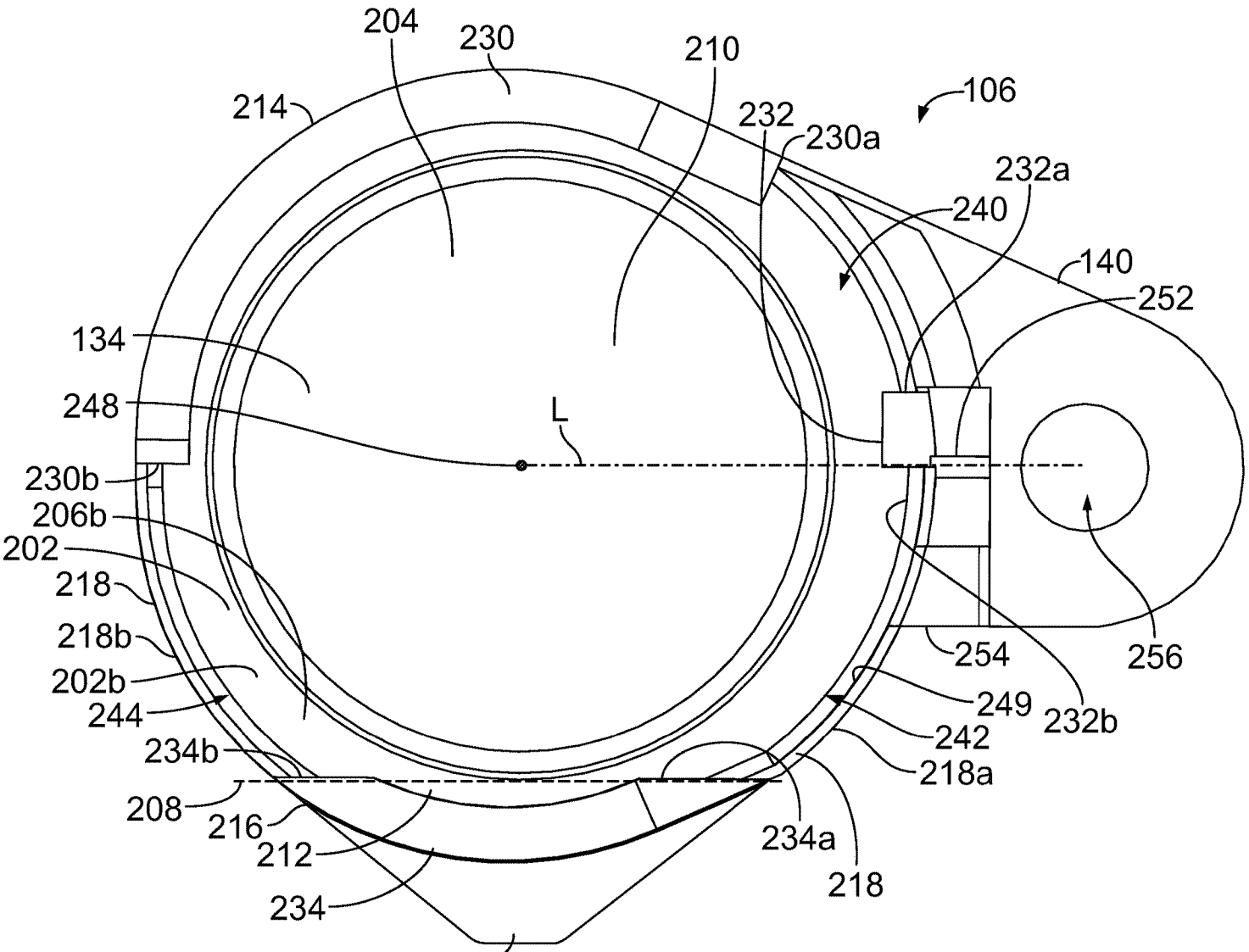
FIG. 2E is a bottom view of the example cover of the example can end of FIGS. 1A, 1B, 1C, 2A, 2B, and 2C.

Referring to FIGS. 2A-2B, the body 134 of the cover 106 of the illustrated example includes an outer ring 202 and a mid-panel 204 (e.g., a down panel, an indentation, a center panel, etc.). The mid-panel 204 of the illustrated example is recessed relative to an outer surface 206*a* (e.g., an upper surface) of the outer ring 202 and protrudes away from an inner surface 206*b* (e.g., a lower surface) of the outer ring 202 opposite the outer surface 206*a*.

The cover 106 of the illustrated example includes a crease or score line 208. The score line 208 of the illustrated example separates a first portion 210 of the body 134 and a second portion 212 (e.g., a liftable tab) of the body 134. Specifically, the score line 208 of the illustrated example provides a hinge. For example, the first portion 210 is a fixed portion of the body 134 and the second portion 212 is a flexible, movable, or liftable portion of the body 134 that can move relative to the first portion 210. For example, the first portion 210 of the body 134 has a fixed spatial relationship relative to the web 140 and/or the center panel 108 (FIGS. 1A-B) in the direction defined by the longitudinal axis 114 (FIGS. 1A-B) (e.g., a fixed distance separating the first portion 210 of the body 134 and the surface 120). The second portion 212 of the body 134 has an adjustable spatial relationship relative to the first portion 210 and/or the center panel 108 in the direction defined by the longitudinal axis 114 (e.g., an adjustable distance separating the second portion 212 of the body 134 and the surface 120). Specifically, the second portion 212 of the body 134 can rotate or pivot about the score line 208 to allow the second portion 212 of the body 134 to move (e.g., lift) relative to (e.g., away from and toward) the surface 120. In some examples, other example hinges can be employed to enable the movement of the second portion 212 of the body 134 relative to the first portion 210 of the body 134.

Referring to FIGS. 2A-2E, to engage the first wall 124 of the pour opening 122 of the can end 100, the cover 106 of the illustrated example includes a second wall 214 (e.g., a first section of a wall of the cover 106) and a third wall 216 (e.g., a second section of a wall of the cover 106). Specifically, the second wall 214 and the third wall 216 extend from the body 134 in a direction away from the mid-panel 204 (e.g., vertically along the longitudinal axis 114). In particular, the second wall 214 and the third wall 216 extend (e.g., downwardly or vertically in the orientation of FIG. 2A) from the outer ring 202 of the cover 106. The second wall 214 of the illustrated example is formed with the first portion 210 of the body 134, and the third wall 216 of the illustrated example is formed with the second portion 212 of the body 134. Thus, the second wall 214 extends from the first portion 210 of the body 134 of the cover 106 and the third wall 216 extends from the second portion 212 of the body 134 of the cover 106. The second wall 214 of the illustrated example includes a first segment 218*a* and a second segment 218*b*. In the illustrated example, the third wall 216 is positioned between the first segment 218*a* and the second segment 218*b*.

When coupled to the can end 100, the second wall 214 and the third wall 216 are positioned between the deboss panel 118 and the outer ring 202 and/or the mid-panel 204. The second wall 214 and the third wall 216 of the illustrated example engage (e.g., least partially surround a perimeter of) the first wall 124 of the pour opening 122 (FIGS. 1A-B) when the cover 106 is in the closed position 102 (e.g., the first position 136 of FIG. 1A).

To enable movement of the second portion 212 of the body 134 relative to the first portion 210 about the score line 208, the cover 106 of the illustrated example includes slits or notches 220 defined between the third wall 216 and respective ones of the first segment 218*a* and the second segment 218*b* of the second wall 214. The notches 220 of the illustrated example are proximate the score line 208. In some examples, the notches 220 can be aligned with the score line 208 along a plane orthogonal to the center panel 108. The notches 220 of the illustrated example separate (e.g., partially separate) the second wall 214 and the third wall 216. As such, the third wall 216 pivots or rotates about the score line 208 with the second portion 212 of the body 134, which enables the third wall 216 to move (e.g., lift away from or toward) the center panel 108 when the second portion 212 of the body 134 moves relative to the first portion 210 of the body 134.

To provide a tamper proof feature 222, the cover 106 of the illustrated example includes ribs 224 (FIG. 2B). Each of the ribs 224 of the illustrated example includes a first end 226 coupled to the second wall 214 and a second end 228 coupled to the third wall 216. For example, the ribs 224 of the illustrated example span across (e.g., traverse) the respective notches 220. For example, a first rib 224*a* spans between the first segment 218*a* and the third wall 216, and a second rib 224*b* spans between the second segment 218*b* and the third wall 216. Accordingly, the ribs 224 of the illustrated example are proximate the score line 208. In some examples, the ribs 224 can be aligned with the score line 208 along a plane orthogonal to the center panel 108. In some examples, two or more of the ribs 224 can span across respective ones of the notches 220 at opposite ends of the score line 208. When the second portion 212 of the body 134 is initially opened relative to the first portion 210 (e.g., for a first time after formation), at least one of the first end 226 or the second end 228 of the respective ribs 224 detach or decouple from (e.g., separate from) a respective one of the first or second segments 218*a-b*) of the second wall 214 or the third wall 216.

To interlock, enmesh, or otherwise attach the cover 106 and the first wall 124 of the pour opening 122, the second wall 214 of the illustrated example includes a first projection or protrusion 230 (e.g., a curl) and a second projection or protrusion 232 (e.g., a curl), and the third wall 216 of the illustrated example includes a third projection or protrusion 234 (e.g., a locking tab, a curl, etc.). The first protrusion 230 and the second protrusion 232 are formed with the first portion 210 of the body 134 and the third protrusion 234 is formed with the second portion 212 of the body 134. Specifically, the first protrusion 230 and the second protrusion 232 extend from the second wall 214 and the third protrusion 234 extends from the third wall 216. For example, the first protrusion 230 extends radially about a first portion 236 (e.g., around between 20% and 60%) of a perimeter of the second wall 214. For example, the first protrusion 230 includes a first end 230*a* and a second end 230*b*. Likewise, the second protrusion 232 is positioned about a second portion 238 (e.g., between 5% and 15%) of the perimeter of the second wall 214. In particular, the second protrusion 232 is positioned proximate the web 140 of the cover 106. The second protrusion 232 includes a first end 232*a* and a second end 232*b* opposite the first end 232*a*. In the illustrated example, the first end 232*a* of the second protrusion 232 is oriented toward the first end 230*a* of the first protrusion 230. The third protrusion 234 is supported by (e.g., is formed with) the third wall 216. The third protrusion 234 has a first end 234*a* and a second end 234*b* opposite the first end 234*a*. For instance, the first end 234*a* is proximate the first segment 218*a* of the second wall 214 and the second end 234*b* is proximate the second segment 218*b* of the second wall 214. In the illustrated example, the first end 234*a* of the third protrusion 234 is oriented toward the second end 232*b* of the second protrusion 232 and the second end 234*b* of the third protrusion 234 is oriented toward the second end 230*b* of the first protrusion 230. Each of the first, second, and third protrusions 230, 232, 234 has a circular or oblong shape such that the protrusions 230, 232, 234 protrude toward a center axis 248 of the cover 106. For example, the protrusions 230, 232, 234 extend farther toward the center axis 248 than an interior surface 249 (e.g., an inner surface) of the second wall 214 and/or the third wall 216. In some examples, one or more of the protrusions 230, 232, 234 can have a square shape, an oval shape, a triangular shape, and/or any other suitable shape.

To prevent the protrusions 230, 232 and/or 234 from hindering movement of the cover 106 relative to the first wall 124 (e.g., when the cover 106 moves between the closed position 102 and the open position 104), the second wall 214 includes a first gap 240, a second gap 242, and a third gap 244. The first gap 240 is formed between the first protrusion 230 and the second protrusion 232. In other words, the first end 230*a* of the first protrusion 230 is spaced from the first end 232*a* of the second protrusion 232. The second gap 242 is formed between the second protrusion 232 and the third protrusion 234. In other words, the second end 232*b* of the second protrusion 232 is spaced from the first end 234*a* of the third protrusion 234. The third gap 244 is positioned between the first protrusion 230 and the third protrusion 234. In other words, the second end 230*b* of the first protrusion 230 is spaced from the second end 234*b* of the third protrusion 234. Thus, the protrusions 230, 232, and 234 form segments positioned or disposed about a perimeter of the body 134 of the cover 106. To form the gaps 240, 242, 244, the protrusions 230, 232, 234 extend a greater distance (e.g., a vertical distance) from the inner surface 206*b* along the center axis 248 than a distance of the second wall 214. For example, in the illustrated example, the second wall 214 includes a shortened or raised portion 218 (e.g., the first segment 218*a* and the second segment 218*b*) that only partially extends over the first wall 124 when the cover 106 is in the closed position 102 (FIG. 1A) to allow the cover 106 to rotate to the open position 104 (FIG. 1B). For example, the raised portion 218 of the second wall 214 moves at least partially over (e.g., above or along an uppermost surface of) the pour opening 122 when the cover 106 rotates between the closed position 102 and the open position 104.

In some examples, the score line 208 can be positioned across the lengthwise midsection of the cover 106. In such examples, the second wall 214 may not include the raised portion 218 or the gaps 240, 242, 244. For example, when the score line 208 is positioned across the lengthwise midsection of the cover 106, the first and second protrusions 230, 232 can be positioned about the perimeter of the second wall 214 and the third protrusion 234 can be positioned about the perimeter of the third wall 216 to substantially eliminate (e.g., reduce a size or completely eliminate) the gaps 240, 242, 244 and/or the raised portion 218.

To facilitate movement of the second portion 212 relative to the first portion 210 about the score line, the cover 106 of the illustrated example includes a tab or grip 250. The grip 250 of the illustrated example is a tab or lip extending from the cover 106. The grip 250 of the illustrated example extends from the third wall 216 (e.g., in a direction away from the center axis 248 of the cover 106).

As noted above, to pivotally couple the cover 106 and the can end 100, the cover 106 of the illustrated example includes the web 140. The web 140 of the illustrated example is fixed to and extends from the second wall 214 of the cover 106 (e.g. in a direction away from the center axis 248). Specifically, the web 140 is fixed to the second wall 214. In some examples, the web 140 can be fixed to the first portion 210 of the body 134. To increase strength, the web 140 of the illustrated example includes a gusset 252 and a bracket 254 (e.g., an L-bracket), which are fixedly coupled to the web 140 and the second wall 214. The bracket 254 is an L-shaped bracket that reduces or prevents interference with the first wall 124 when the cover 106 rotates about the longitudinal axis 114 (e.g., the pivot axis). The gusset 252 of the illustrated example is aligned with a lengthwise midsection of the cover 106 and is fixedly coupled to (e.g., integrally formed with) the second wall 214 and the web 140. The bracket 254 is fixedly coupled to (e.g., integrally formed with) the web 140 and the raised portion 218 (e.g., the first segment 218*a*) of the second wall 214. To receive the rivet 142 (FIG. 1A and FIG. 1B), the web 140 of the illustrated example includes an opening 256. The opening 256 of the illustrated example receives the rivet 142 to rotatably couple the web 140 and, thus, the cover 106 to the center panel 108 (FIGS. 1A-1B). As a result, the cover 106 pivots about the opening 256 to move between the closed position 102 of FIG. 1A and the open position 104 of FIG. 1B. As shown in FIG. 2E, to enable pivotal movement of the cover 106 about the longitudinal axis 114, the longitudinal axis 114 is spaced from the center axis 248 of the cover 106 by a distance L (FIG. 2E). Additionally, the web 140 (e.g., a flange of the web 140) at least partially covers or surrounds the first wall 124 when the cover 106 is in the closed position 102.

Figure 3A:
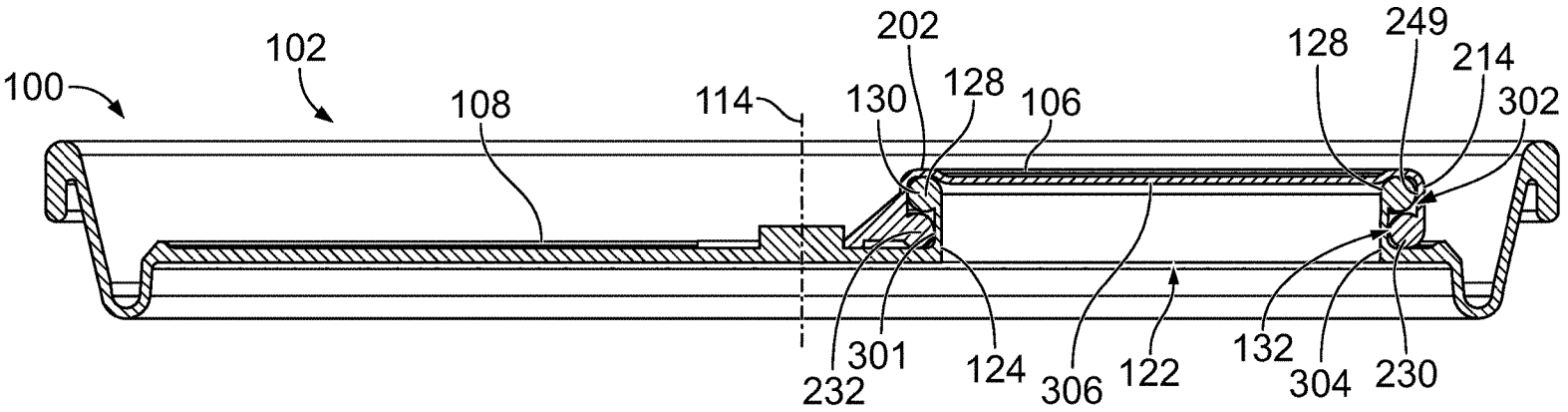
FIG. 3A is a cross-sectional view of the example can end of FIGS. 1A and 1B taken along line 3-3 of FIG. 1A.
Figure 3B:
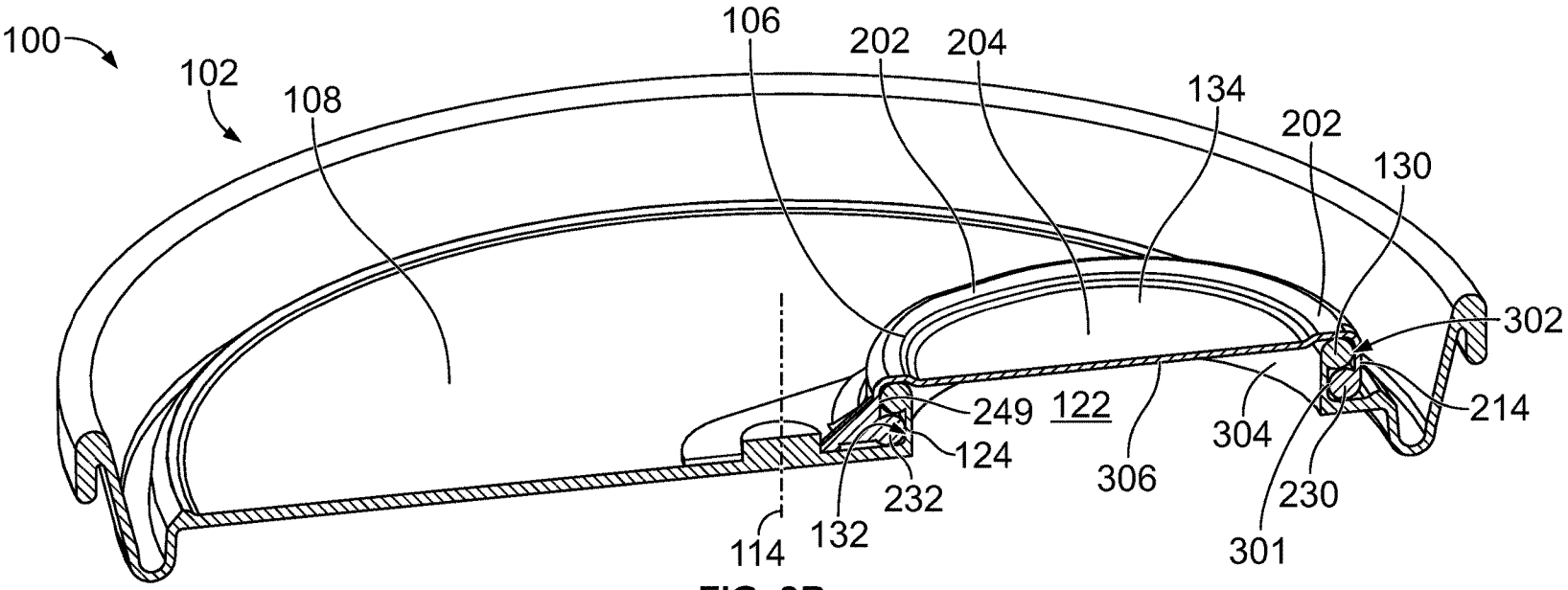
FIG. 3B is a perspective view of FIG. 3A.

FIG. 3A is a cross-sectional view of the example can end 100 of FIGS. FIG. 1A-1B taken along line 3-3 of FIG. 1A. FIG. 3B is a perspective view of FIG. 3A. The cover 106 of the illustrated example is in the closed position 102. When the cover 106 is in the closed position 102, the first, second, and third protrusions 230, 232, 234 of the illustrated example interface with (e.g., press between and/or are captured between) the center panel 108, the first wall 124, and the lip 130 of the first wall 124, which, in turn, locks, fixes, or otherwise secures a position of the cover 106 over the pour opening 122.

For example, the first protrusion 230 of the illustrated example interfaces (e.g., engages and/or interlocks) with the first track 132 when the cover 106 is in the closed position 102. Specifically, the first protrusion 230 is received by the first track 132. In this manner, the first protrusion 230 is positioned between the center panel 108 and the second end 128 of the first wall 124. As such, the first protrusion 230 of the second wall 214 interlocks with the first track 132 defined by the first wall 124 when the cover 106 is in the closed position 102. For example, the first protrusion 230 is positioned against an outer surface 301 of the first wall 124 and pressed between the lip 130 and the center panel 108, which interlocks the first protrusion 230. Likewise, the second protrusion 232 is positioned within the first track 132 (e.g., captured between the center panel 108 and the lip 130 of the first wall 124).

Additionally, the cover 106 of the illustrated example includes a second track 302 to receive the second end 128 of the first wall 124. Specifically, the protrusions 230, 232, 234, the interior surface 249 of the second wall 214 and the third wall 216, and the inner surface 206*b* of the outer ring 202 define the second track 302 (e.g., an annular groove or track). As such, the second track 302 of the illustrated example spans partially around the interior surface 249 of the second wall 214 and the third wall 216. The second end 128 (e.g., the lip 130) of the first wall 124 of the illustrated example engages and/or interlocks with the second track 302 of the cover 106 when the cover 106 is in the closed position 102. Specifically, the lip 130 is positioned between the outer ring 202 and the protrusions 230, 232, 234 such that the lip 130 is captured between the protrusions 230, 232, 234 of the second wall 214 and the third wall 216 when the cover 106 is in the closed position 102. For example, the lip 130 is positioned against the interior surface 249 of the second wall 214 and the third wall 216 and pressed or captured between the protrusions 230, 232, 234 and the body 134 of the cover 106, which interlocks the lip 130 in the second track 302. Thus, in the closed position 102, the lip 130 of the first wall 124 prevents or restricts the first portion 210 of the cover 106 from lifting in a direction away (e.g., in an upward or vertical direction) from the center panel 108. In other words, when the first track 132 is engaged with the protrusions 230, 232, 234 and the second track 302 is engaged with the lip 130, the first portion 210 of the cover 106 is prevented from lifting away from the pour opening 122. When the cover 106 is pivoted or lifted about the score line 208, engagement between the first and second protrusions 230, 232 and the first track 132 only enables pivotal movement of the cover 106 in a rotational direction about the score line 208.

To prevent access to the pour opening 122 when the cover 106 is in the closed position 102, the outer ring 202 of the cover 106 of the illustrated example is displaced over the lip 130. For example, the outer ring 202 of the cover 106 of the illustrated example presses against the second end 128 of the first wall 124 when the cover 106 is in the closed position 102. The mid-panel 204 of the cover 106 of the illustrated example is positioned adjacent to an interior surface 304 of the first wall 124 (e.g., facing the pour opening 122) when the cover 106 is in the closed position 102. Additionally, the first wall 124 of the illustrated example is concentrically positioned around the mid-panel 204 when the cover 106 is in the closed position 102. As a result, the cover 106 conceals the pour opening 122 and prevents contents within the associated container from spilling. For example, when the cover 106 is in the closed position 102, the body 134 of the cover 106 prevents contents within the associated container from traveling past the second end 128 of the first wall 124 and, thus, prevents the contents from spilling out of a container (e.g., the can body 144 of FIG. 1C). In some examples, the cover 106 seals the pour opening 122 when the outer ring 202 engages the second end 128 of the first wall 124. In some examples, an inner surface of the mid-panel 204 sealingly engages against the second end 128 (e.g., or an inner surface) of the first wall 124. In some examples, the can end 100 includes a gasket positioned around a perimeter of the interior surface 306 of the mid-panel 204. In some such examples, the gasket interfaces with the second end 128 of the first wall 124.

Figure 4A:
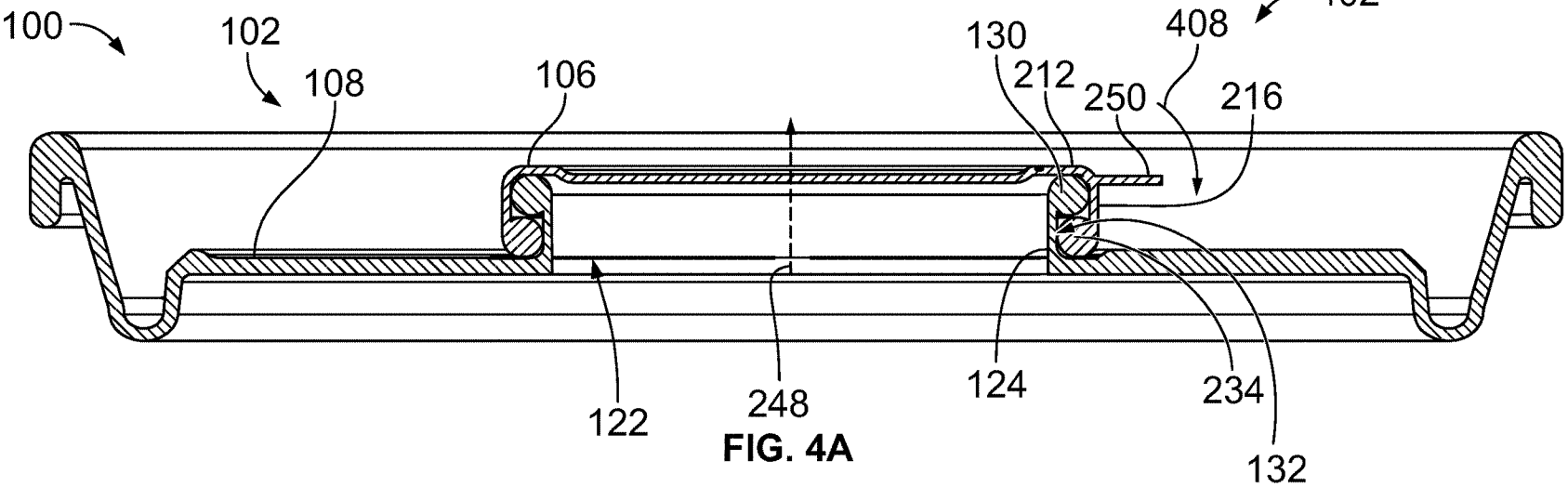
FIG. 4A is a cross-sectional view of the example can end of FIGS. 1A and 1B taken along line 4-4 of FIG. 1A. The example cover of the example can end of FIG. 3A is in an example latched position.
Figure 4B:
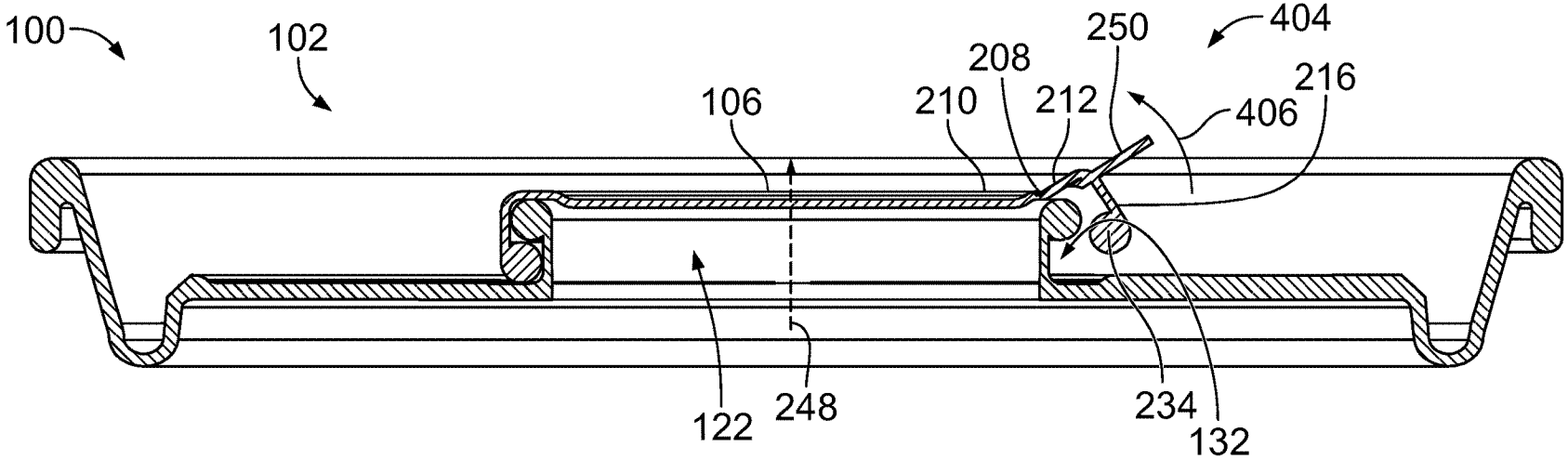
FIG. 4B is a view of the example can end of FIG. 4A with the example cover of the example can end in an example unlatched position.

FIG. 4A is a cross-sectional view of the example can end 100 of FIGS. 1A and 1B taken along line 4-4 of FIG. 1A. In FIG. 4A, the cover 106 is in an example first or latched position 402. FIG. 4B is a view of the example can end 100 of FIG. 4A showing the cover 106 in an example second or unlatched position 404.

To latch or lock the cover 106 in the closed position 102, the second portion 212 (e.g., the grip 250) is in the latched position 402. For example, in the latched position 402, the third protrusion 234 interfaces or interlocks (e.g., engages) with the lip 130. When the cover 106 is in the latched position 402, the cover 106 is prevented from rotating about the longitudinal axis 114 (FIG. 1A). Thus, the cover 106 is prevented from moving away from the pour opening 122. In other words, the third protrusion 234 engages or interfaces with the first wall 124 in the direction of rotation of the cover 106 to prevent movement of the cover 106 relative to the longitudinal axis 114. To enable movement of the cover 106 of the illustrated example from the closed position 102 of FIG. 1A to the open position 104 of FIG. 1B, the second portion 212 of the cover 106 is moved to the unlatched position 404. For example, the second portion 212 is pivoted relative to the first portion 210 about the score line 208 in a first pivot direction 406 toward the center axis 248. Accordingly, the cover 106 of the illustrated example bends at the score line 208 to move the third wall 216 in a direction away from the center panel 108. Additionally, movement of the second portion 212 (e.g., the third wall 216) toward the unlatched position 404 causes the third protrusion 234 to at least partially move in a direction away from the lip 130. In other words, movement of the second portion 212 to the unlatched position 404 causes the third protrusion 234 to disengage, separate from, or move away from the first wall 124 (e.g., the lip 130 and/or the first track 132 of the first wall 124). As a result, the third wall 216 of the illustrated example does not block or interfere with rotation of the cover 106, which allows the cover 106 to rotate freely about the longitudinal axis 114 between the closed position 102 and the open position 104. When the cover 106 is returned over the pour opening 122, the second portion 212 of the cover 106 is rotated in a second pivot direction 408 to position the cover 106 (e.g., the third protrusion 234) in the latched position 402 (e.g., in engagement with the first track 132). Rotation of the grip 250 in the second pivot direction 408 causes the third protrusion 234 to engage the first track 132 and prevent rotational movement of the cover 106 about the longitudinal axis 114.

Figure 5:
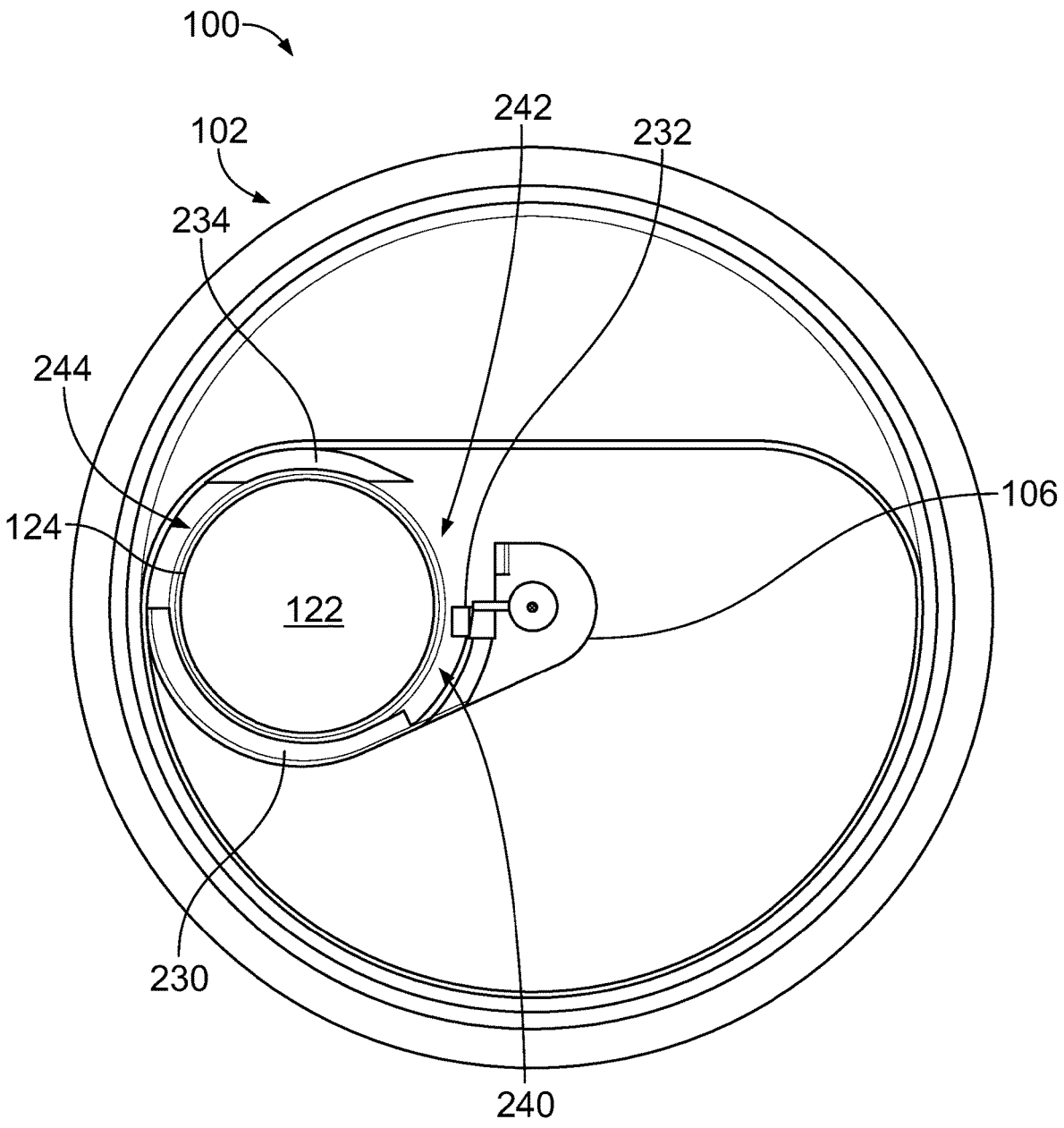
FIG. 5 is a top view of a cross section of the example can end of the example can end of FIGS. 1A, 1B and 1C showing a portion of the example cover removed to illustrate an interaction between the example cover and the example pour opening.

FIG. 5 is a top view of the example can end 100 of FIGS. 1A-1B, 2A-2E, 3A-3B, and 4A-4B. In the illustrated example, a portion of the example cover 106 (e.g., the body 134) and the lip 130 extending from the second end 128 of the first wall 124 are removed. Specifically, the body 134 and the lip 130 are removed from the illustrated example to show a top view of the protrusions 230, 232, 234 relative to the first wall 124 when the cover 106 is in the closed position 102. As shown, each of the protrusions 230, 232 and 234 surrounds a portion of a perimeter of the first wall 124. Specifically, the protrusions 230, 232, 234 collectively surround a portion of the perimeter of the first wall 124. Specifically, portions of the first wall 124 are not covered by the protrusions 230, 232, 234 along portions of the second wall 214 defined by the gaps 240, 242, 244, respectively. Although portions of the first wall 124 are not engaged by the protrusions 230, 232, 234 along portions of the second wall 214 defined by the gaps 240, 242, 244, the third protrusion 234 prevents rotation of the cover 106 toward the open position 104 when the cover 106 is in the closed position 102. Lifting the grip 250 and the second portion 212 relative to the first portion 210 about the score line 208 to the unlatched position 404 of FIG. 4B causes the third protrusion 234 to release the first wall 124 and enable rotation of the cover 106 toward the open position 104. The first protrusion 230 and the second protrusion 232 do not interfere with the first wall 124 when the cover 106 moves to the open position 104. Additionally, portions of the first wall 124 are exposed via one or more of the gaps 240, 242, 244 when the cover is in the closed position 102.

Figure 6A:
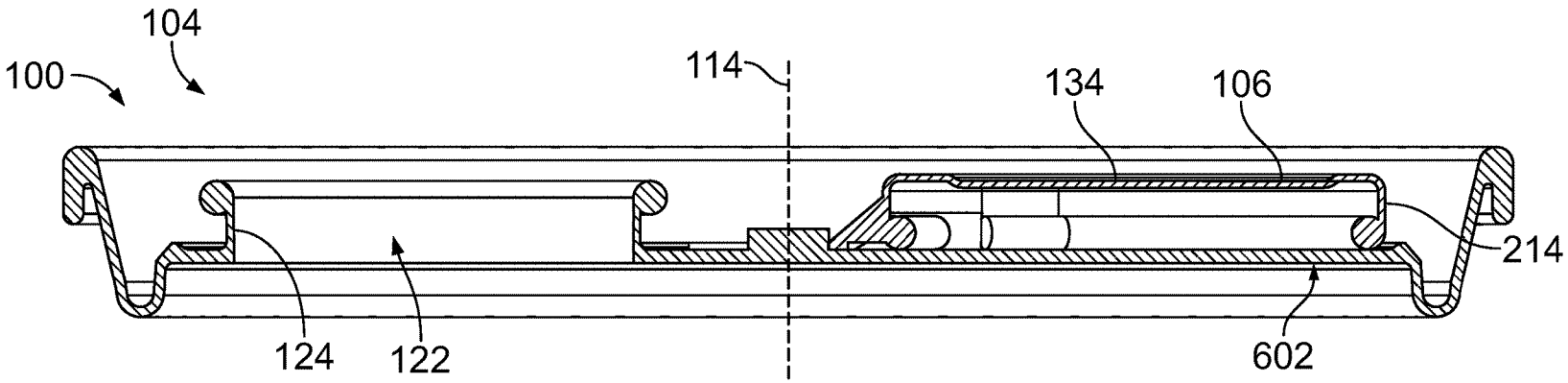
FIG. 6A is a cross-sectional view of the example can end of FIGS. 1A, 1B and 1C taken along line 6-6 of FIG. 1B.
Figure 6B:
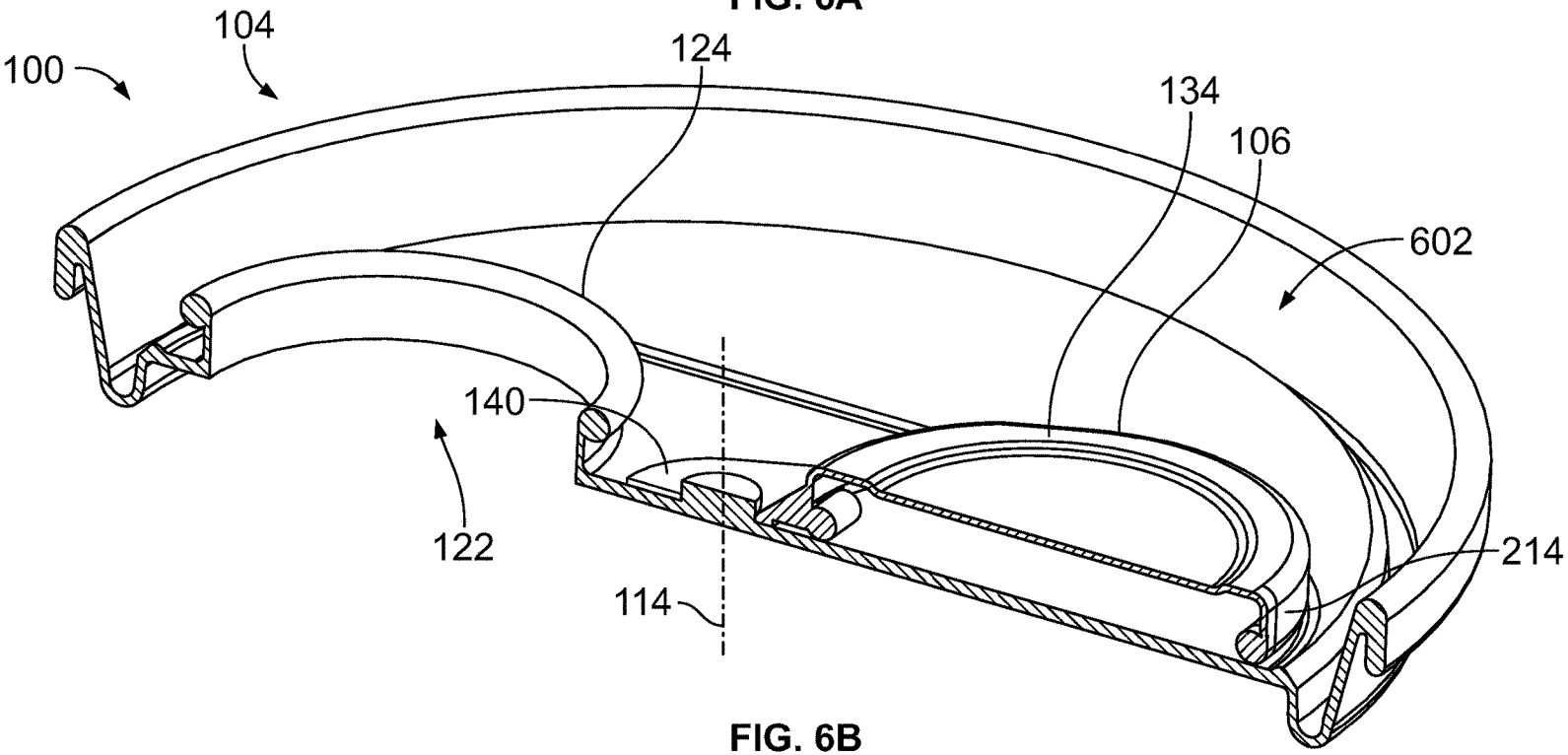
FIG. 6B is a perspective view of FIG. 6A.

FIG. 6A is a cross-sectional view of the can end 100 of FIGS. 1A and 1B taken along line 5-5 of FIG. 1B. FIG. 6B is a perspective view of FIG. 6A. The cover 106 of the illustrated example is in the open position 104 to expose the pour opening 122 and allow contents within the associated can body 144 to be dispensed therethrough. For example, the second wall 214 and the third wall 216 (FIGS. 2A-2E) do not surround the first wall 124 and, thus, the cover 106 is not positioned over the pour opening 122, which allows liquid to flow therethrough without being stopped by the cover 106. In the open position 104, the cover 106 is positioned on a side 602 of the can end 100 that is opposite from the pour opening 122. For example, in the open position 104, the web 140 is positioned between the body 134 of the cover 106 and the first wall 124 of the pour opening 122. In the closed position 102 of FIG. 1A, the web 140 is positioned between the body 134 and the side 602. To move the cover 106 to the side 602, the cover 106 is rotated about the longitudinal axis 114. In other words, the cover 106 slides along the center panel 108 as the cover 106 rotates between the open position 104 and the closed position 102 about the longitudinal axis 114.

Figure 7A:
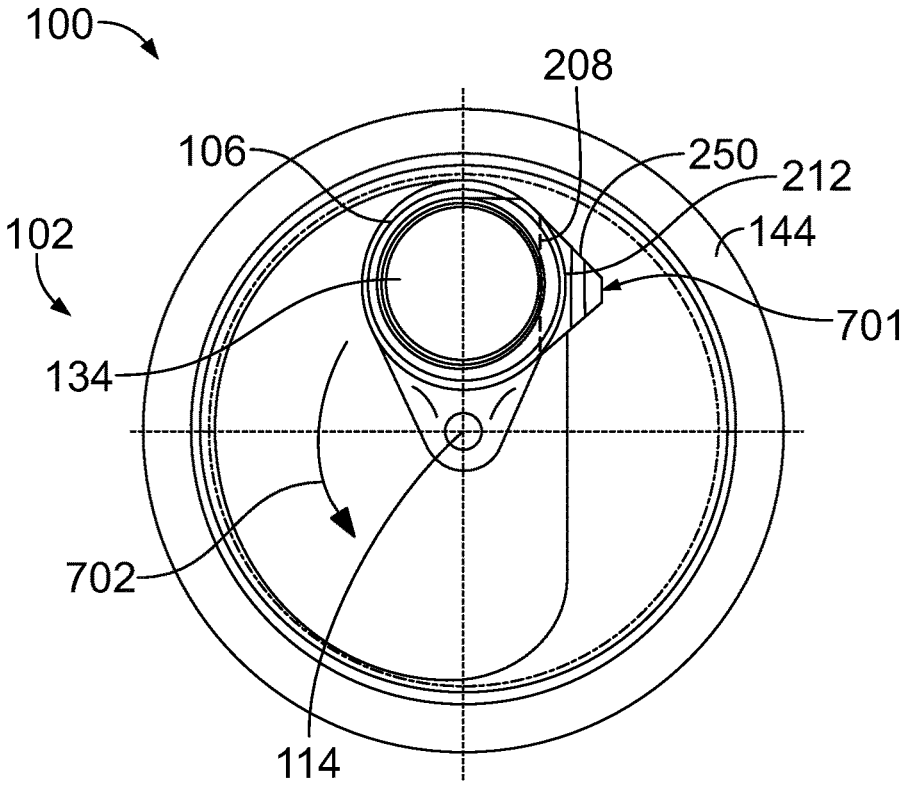
FIG. 7A is a top view of FIG. 1A.
Figure 7B:
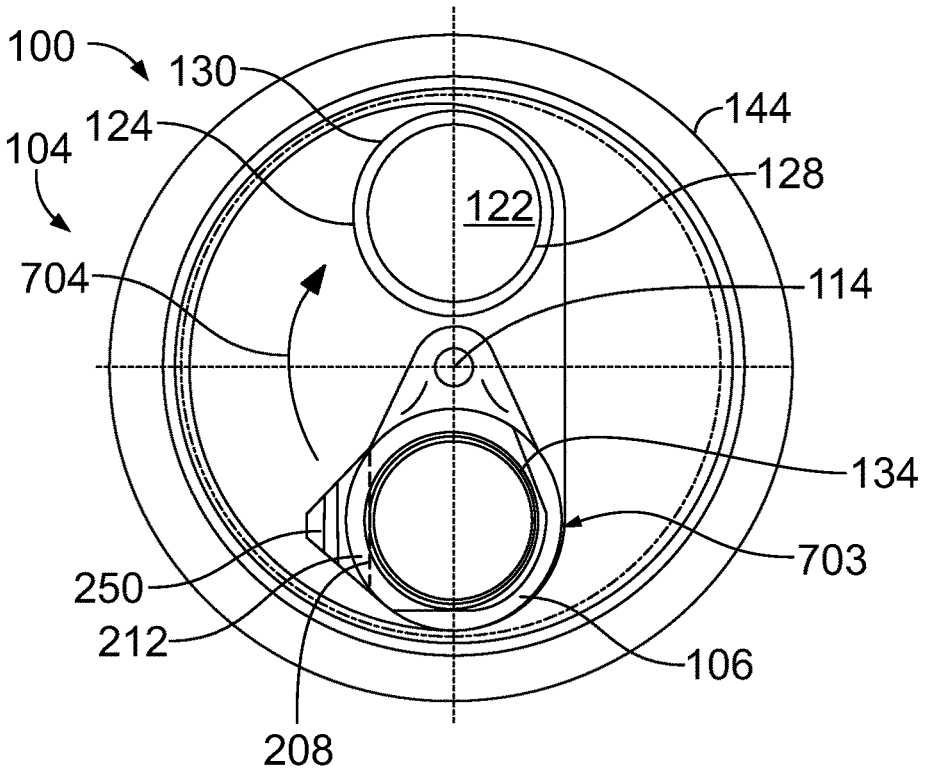
FIG. 7B is a top view of FIG. 1B.

FIG. 7A is a top view of the example can end 100 of FIGS. 1A-1B, 2A-2E, 3A-3B, 4A-4B, 5, and 6A-6B in the closed position 102 of FIG. 1A. FIG. 7B is a top view of the example can end 100 of FIGS. 1A-1B, 2A-2B, 3A-3B, 4A-4B, 5, and 6A-6B in the open position 104 of FIG. 1B.

In operation, to rotate the cover 106 from the closed position 102 of FIG. 7A to the open position 104 of FIG. 7B, the grip 250 is lifted in the first pivot direction 406 (e.g., moved away from the center panel 108 as shown in FIG. 4B) to rotate the second portion 212 of the body 134 of the cover 106 about the score line 208 to the unlatched position 404 of FIG. 4B. Accordingly, the third protrusion 234 of the third wall 216 (FIG. 2A) rotates with the second portion 212 of the body 134.

During an initial (e.g., a first-time) opening of the cover 106, the ribs 224 of the cover 106 break or rupture (e.g., to separate the second wall 214 from the third wall 216) in response to rotation of the second portion 212 of the cover 106 about the score line 208 to the unlatched position 404. In some examples, the ribs 224 provide the cover 106 with tamper evidence.

When the second portion 212 of the body 134 is in the unlatched position 404, the third protrusion 234 (FIGS. 2C-2E) is moved out of engagement or alignment with the first track 132 (FIG. 1B, 4B). With the second portion 212 in the unlatched position 414 and the third protrusion 234 disengaged from the first track 132, the cover 106 is free to rotate to the open position 104. For example, the cover 106 rotates in a first rotational direction 702 (e.g., counterclockwise direction in the orientation of FIG. 7A) to expose the pour opening 122 in response to a force 701 (e.g., a torque) applied to the cover 106 in a direction perpendicular to the longitudinal axis 114. In response to the force 701, the cover 106 pivots in the first rotational direction 702 about the longitudinal axis 114 to the open position 104 of FIG. 7B. As the cover 106 rotates toward the open position 104, the first protrusion 230 and/or the second protrusion 232 slidably disengage (e.g., move away) from the first track 132 of the first wall 124. Specifically, the first protrusion 230 and/or the second protrusion 232 slide relative to the first wall 124 (e.g., underneath the lip 130 of the first wall 124) when the cover 106 rotates toward the open position 104. In other words, the lip 130 restricts or prevents the first protrusion 230 and the second protrusion 232 from passing on top of or over (e.g., an uppermost surface of) the second end 128 of the first wall 124. Additionally, because the second portion 212 is in the unlatched position 404, the third protrusion 234 moves or passes over (e.g., moves across an uppermost surface of) the lip 130 of the first wall 124. Thus, the third protrusion 234 does not interfere with the first wall 124 when the cover 106 moves to the open position 104. In some examples, if the third protrusion 234 engages the first wall 124 when the cover 106 rotates toward the open position 104, engagement between the first wall 124 (e.g., the lip 130) and the third protrusion 234 causes the second portion 212 to rotate about the score line 208 in the first pivot direction 406 toward the unlatched position 404 to enable the third protrusion 234 to pass above the first wall 124. In some examples, a user can simultaneously lift the second portion 212 to the unlatched position 404 while applying the force 701 to rotate the cover 106 toward the open position 104. The cover 106 of the illustrated example has a 180 degree swing radius. In some examples, the cover 106 can have any other swing radius, such as 60 degrees, 90 degrees, 120 degrees, etc.

In some examples, the can end 100 can include a temporary peelable seal that interfaces with the lip 130 over the pour opening 122. For example, the temporary peelable seal can be heat sealed to the first wall 124 (e.g., the lip 130) over the pour opening 122. In some such examples, the temporary peelable seal is removed (e.g., peeled away by a user) to expose the pour opening 122 after the cover 106 is moved to the open position 104 for a first time.

To move the cover 106 from the open position 104 of FIG. 7B to the closed position 102 of FIG. 7A, a force 703 (e.g., a torque) is applied to the cover 106 in a direction that is perpendicular to the longitudinal axis 114, causing the cover 106 to rotate about the longitudinal axis 114 in a second rotational direction 704 (e.g., clockwise direction in the orientation of FIG. 7B) opposite the first rotational direction 702 until the cover 106 is positioned over the pour opening 122. Specifically, as the cover 106 rotates toward the closed position 102, the third protrusion 234 is in the unlatched position 404 and does not interfere with the first wall 124 to enable the cover 106 to be positioned over the pour opening 122. In some examples, if the second portion 212 (e.g., the third wall 216) is in a position that does not clear the first wall 124, engagement between the first wall 124 and the third protrusion 234 (e.g., with the force 703 applied to the cover 106) causes the third protrusion 234 and, thus, the second portion 212 to move or bend along the score line 208 in the first pivot direction 406 toward the unlatched position 404. In some examples, a user can simultaneously apply a lifting force (e.g., in the first pivot direction 406) to the second portion 212 to move the second portion 212 to the unlatched position 404 while applying the force 703 to move the cover 106 in the second rotational direction 704. Thus, although the third protrusion 234 is the initial protrusion to pass the first wall 124, the third protrusion 234 passes over (e.g., the lip 130 of) the first wall 124 (e.g., not within the first track 132).

As the cover 106 moves toward the closed position 102, the first protrusion 230 and/or the second protrusion 232 slidably engage the first track 132. In other words, the first and second protrusions 230 and 232 slide underneath the lip 130 of the first wall 124. Additionally, the third protrusion 234 passes or moves over (e.g., above) the lip 130. After the cover 106 is positioned over the pour opening 122, the second portion 212 of the body 134 is rotated or pivoted about the score line 208 in the second pivot direction 408 to the latched position 402. In turn, the third protrusion 234 moves into engagement with the first track 132, thereby locking or preventing rotational movement of the cover 106 relative to the pour opening 122. For example, the third protrusion 234 couples to first track 132 and/or is positioned underneath the lip 130 via a snap-fit connection. In some examples, the cover 106 flexes to accommodate manufacturing tolerances and enable rotation thereof between the closed position 102 (FIG. 1A) and the open position 104 (FIG. 1B) and/or between the latched position 402 and/or the unlatched position 404.

As a result, in the closed position 102, the cover 106 prevents access to the pour opening 122 and, thus, prevents contents within the associated can body 144 from spilling therethrough. Although the first, second and third protrusions 230, 232, 234 interact with and/or engage with the first wall 124, the protrusions 230, 232, 234 do not interfere with an operation of the cover 106 when the cover 106 moves between the open position 104 and the closed position 102. In some examples, an interior surface of the body 134 (e.g., a surface that faces the pour opening 122) includes an epoxy coating to protect the cover 106 from encountering wear when the cover 106 rotates between the closed position 102 and the open position 104. In some examples, an inner surface of the outer ring 202 includes a seal or membrane that engages (e.g., sealingly engages) the second end 128 of the first wall 124 to provide a seal. Thus, in operation, the first protrusion 230 and the second protrusion 232 slidably engage/disengage the first track 132 and the third protrusion 234 pivotally engages/disengages the first track 132.

The cover 106 can be attached to the can end 100 during manufacturing. In some examples, the cover 106 can be formed as shown in FIG. 2A, for example, and coupled to the first wall 124 of the pour opening 122 via a press (e.g., a punch press). In such examples, the press compresses the cover 106 around the first wall 124 with a significant pressure that enables the cover 106 to be coupled to the first wall 124 rapidly and, in turn, avoids causing deformation to the cover 106 or the first wall 124. In some examples, the cover 106 can be formed as a flat disk (e.g., including the notches 220, the ribs 224 via stamping, for example) having the protrusions 230, 232, 234 extending around at least a portion of a perimeter of a bottom surface (e.g., a surface facing the center panel 108). In such examples, the cover 106 can be pressed or formed over the first wall 124 via a press, a crimping press, etc. In some examples, the cover 106 is formed over the pour opening 122 via additive manufacturing or three-dimensional (3-D) printing. In some examples, the can end 100 including the cover 106 are formed via additive manufacturing. In some examples, the cover 106 is coupled to the first wall 124 via any other manufacturing processes or technique(s).

Figure 8A:
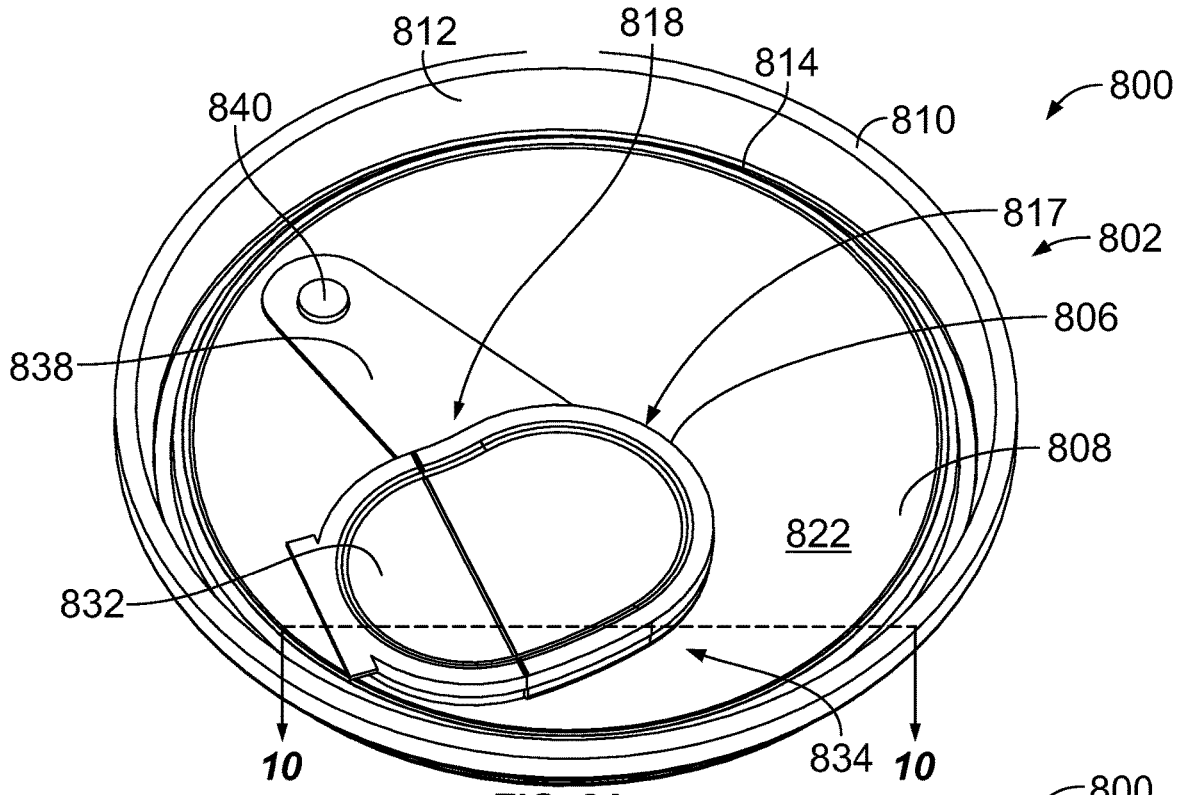
FIG. 8A is a perspective view of another example can end in an example closed position.
Figure 8B:
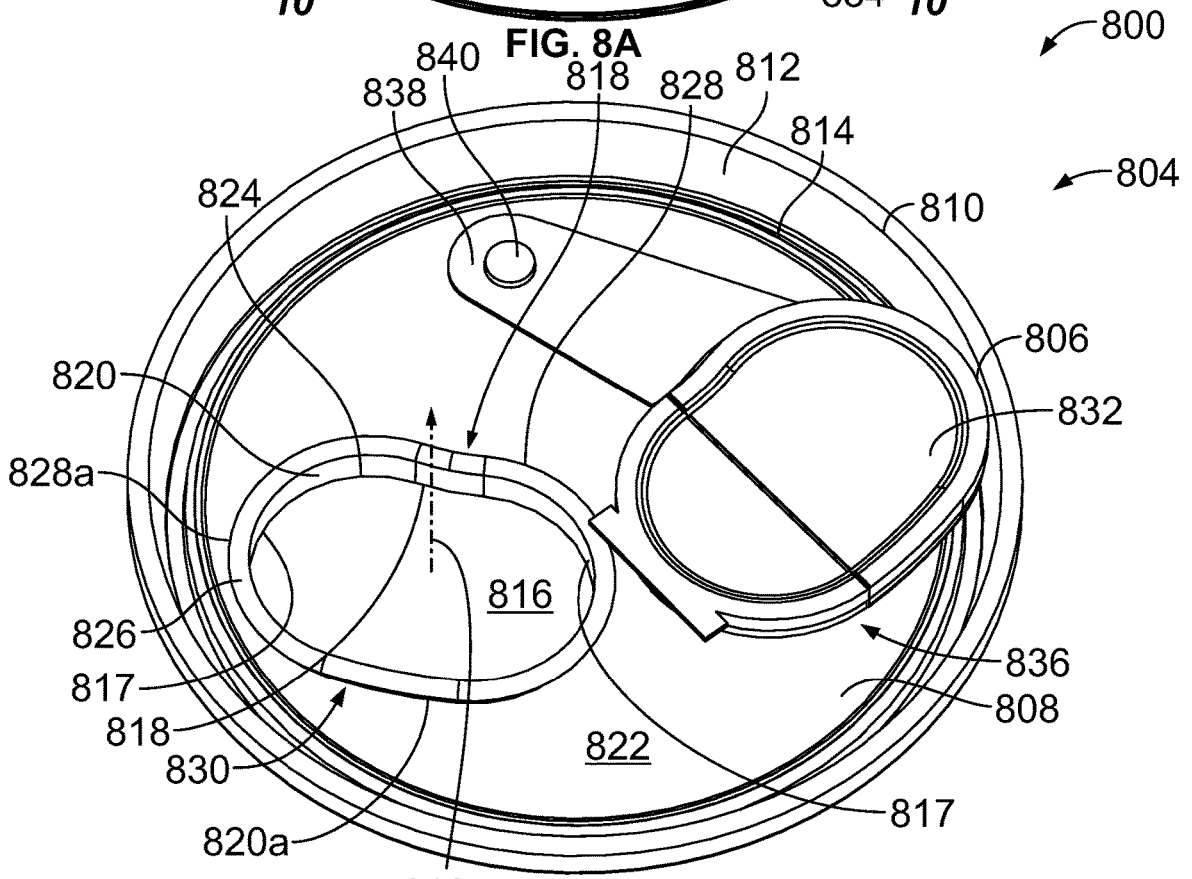
FIG. 8B is a perspective view of the example can end of FIG. 8A in an example open position.
Figure 8C:
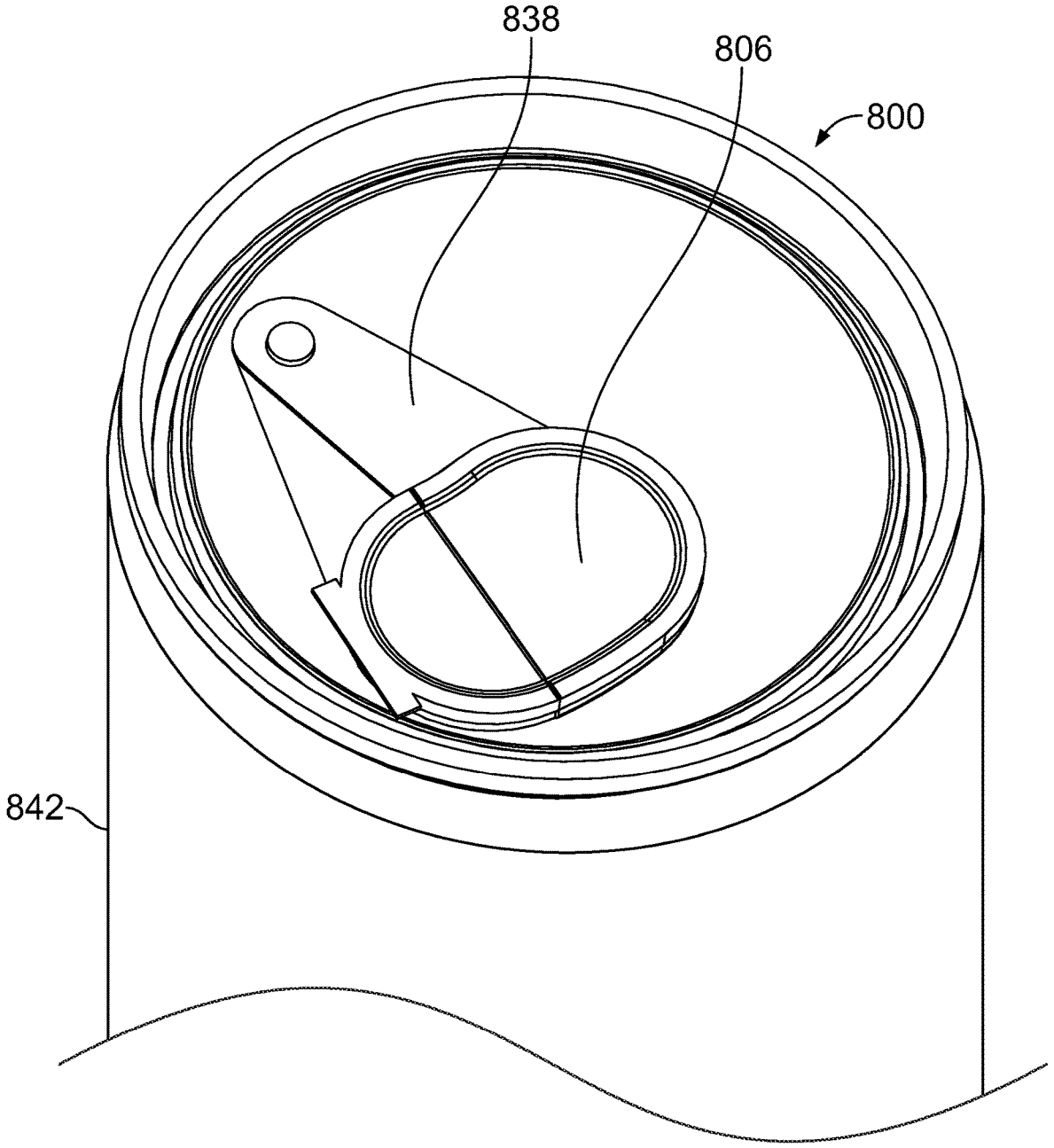
FIG. 8C is a perspective view of the example can end of FIGS. 8A-8B coupled to an example container.

FIG. 8A is a perspective view of another example can end 800 in accordance with teachings disclosed herein. The can end 800 of FIG. 8A is shown in an example closed configuration or closed position 802. FIG. 8B is a perspective view of the example can end 800 of FIG. 8A shown in an example open configuration or open position 804. To configure the can end 800 between the closed position 802 and the open position 804, the can end 800 of the illustrated example includes an example cover 806. Similar to the example can end 100 (FIGS. 1A-C, 2A-E, 3A-B, 4A-B, 5, 6A-B, and 7A-B), the can end 800 of the illustrated example has a center panel 808 separated from a seaming curl 810 by a circumferential wall 812. The circumferential wall 812 of the illustrated example extends (e.g., downward) from the seaming curl 810 to a bend 814 that is coupled to (e.g., integral with) the center panel 808. After formation, the can end 800 is joined to an associated container (e.g., a can body 842 of FIG. 8C) via the seaming curl 810 (e.g., to enclose contents disposed in a cavity of the can body).

The center panel 808 of the illustrated example includes a pour opening 816 (FIG. 8B) through which contents within the associated can body 842 can be dispensed. The pour opening 816 of the illustrated example has a kidney shape or profile (e.g., a kidney-shaped perimeter). For example, the center panel 808 of the illustrated example includes an oval portion 817 and an arc portion 818 extending inward relative to the oval portion 817 (e.g., toward a longitudinal centerline 816*a* of the pour opening 816) to define the kidney shape of the pour opening 816. In some examples, the pour opening 816 can include an oval-shaped perimeter (e.g., the center panel 808 does not include the arc portion 818), a square-shaped perimeter, and/or any other shape perimeter.

The can end 800 of the illustrated example includes a first wall 820 extending (e.g., in a vertical direction) from a surface 822 of the center panel 808 around the perimeter of the pour opening 816 (e.g., adjacent to the pour opening 816). For example, the first wall 820 of the illustrated example surrounds the entire perimeter of the pour opening 816. As such, the first wall 820 of the illustrated example defines a perimeter that substantially matches a perimeter (e.g., a kidney shape) of the pour opening 816. The first wall 820 of the illustrated example includes a first end 824 and a second end 826 opposite the first end 824.

The first end 824 of the first wall 820 of the illustrated example is coupled to (e.g., joined or fixed to) the center panel 808. The second end 826 of the first wall 820 of the illustrated example includes a lip 828 (e.g., a projection, a protrusion, a catch, an annular rim, a bead, etc.) extending outward relative to the pour opening 816 (e.g., away from the longitudinal centerline 816*a* of the pour opening 816). As such, the lip 828 of the illustrated example overhangs the center panel 808. The lip 828 of the illustrated example is a curl 828*a*. For example, the second end 826 of the illustrated example extends laterally in a direction away and non-parallel (e.g., perpendicular) relative to the longitudinal centerline 816*a* of the pour opening 816 from an outer surface 820*a* of the first wall 820. As a result, the center panel 808, the first wall 820, and the lip 828 of the illustrated example define a first track 830 (e.g., therebetween). In some examples, the lip 828 can be a ridge or another alternatively shaped protuberance that extends outward from the first wall 820 relative to the pour opening 816 to define the first track 830. In some examples, the first wall 820 can be a vertical wall and the first track 830 can be formed via a groove or recess formed in the outer surface 820*a* (e.g., an annular groove or groove around at least a portion of the perimeter of the first wall 820) between the first end 824 and the second end 826.

The cover 806 of the illustrated example includes a body or base 832 that covers the pour opening 816 when the cover 806 is in the closed position 802. The base 832 of the illustrated example has a kidney shaped perimeter. Thus, the perimeter of the base 832 of the illustrated example is complementary to the perimeter of the first wall 820. In the illustrated example, the perimeter of the base 832 is slightly larger than the perimeter of the pour opening 816. Thus, the base 832 is repositionable relative to the first wall 820 and/or the pour opening 816 to configure the can end 800 between the closed position 802 and the open position 804. For example, the cover 806 is pivotally coupled to the center panel 808. As such, the cover 806 can rotate relative to the surface 822 between a first position 834 (FIG. 8A) corresponding to the closed position 802 of the can end 800 and a second position 836 (FIG. 8B) corresponding to the open position 804 of the can end 800.

To couple the cover 806 of the illustrated example to the can end 800, the cover 806 includes a web 838. The web 838 of the illustrated example is staked to the center panel 808 to pivotally couple the cover 806 to the center panel 808. Specifically, the web 838 of the illustrated example is staked to the center panel 808 via a rivet 840, which enables the cover 806 to pivot about the rivet 840 between the first position 834 and the second position 836.

Figure 9A:
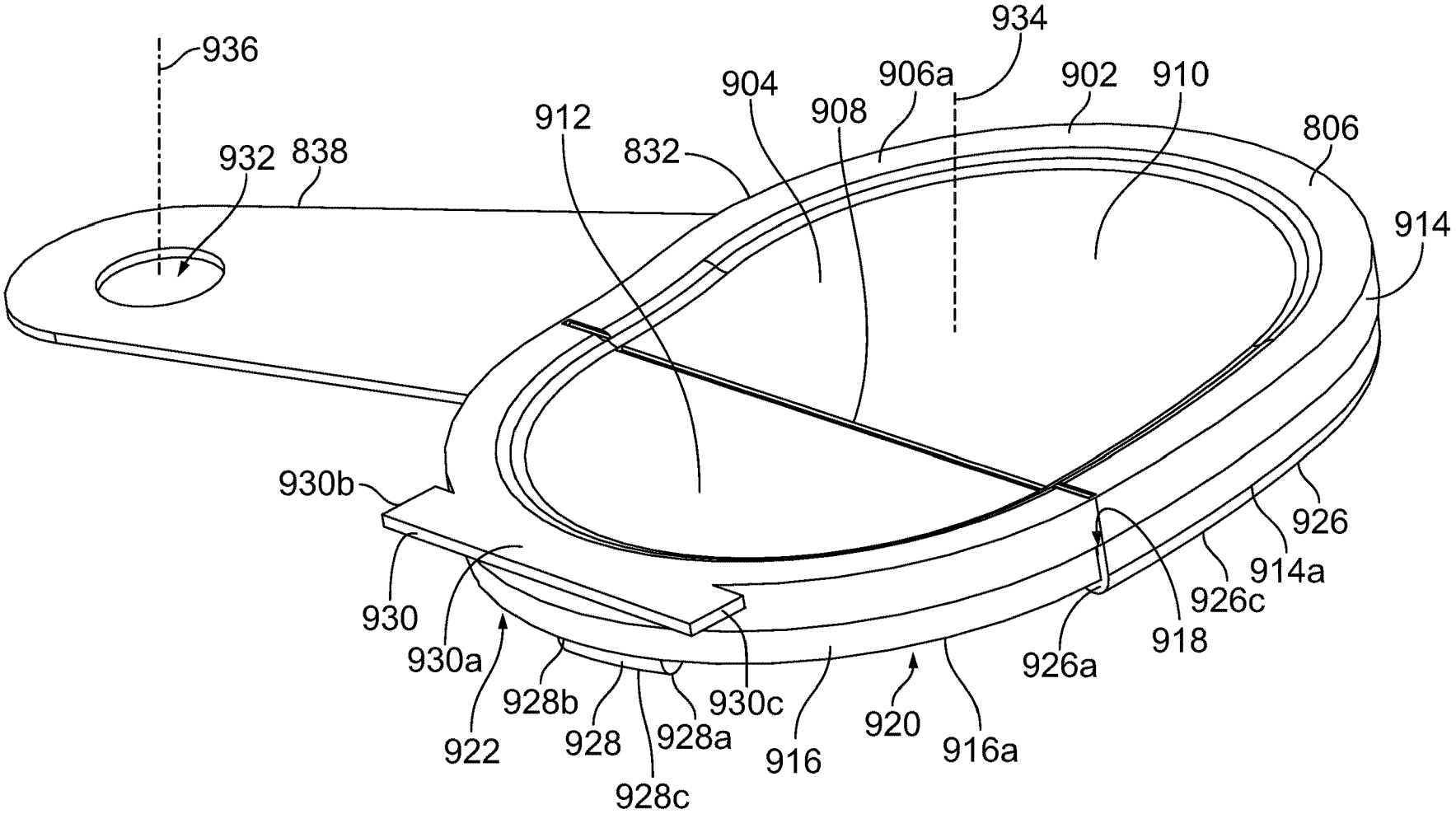
FIGS. 9A and 9B are perspective views of an example cover of the example can end of FIGS. 8A, 8B, and 8C.
Figure 9B:
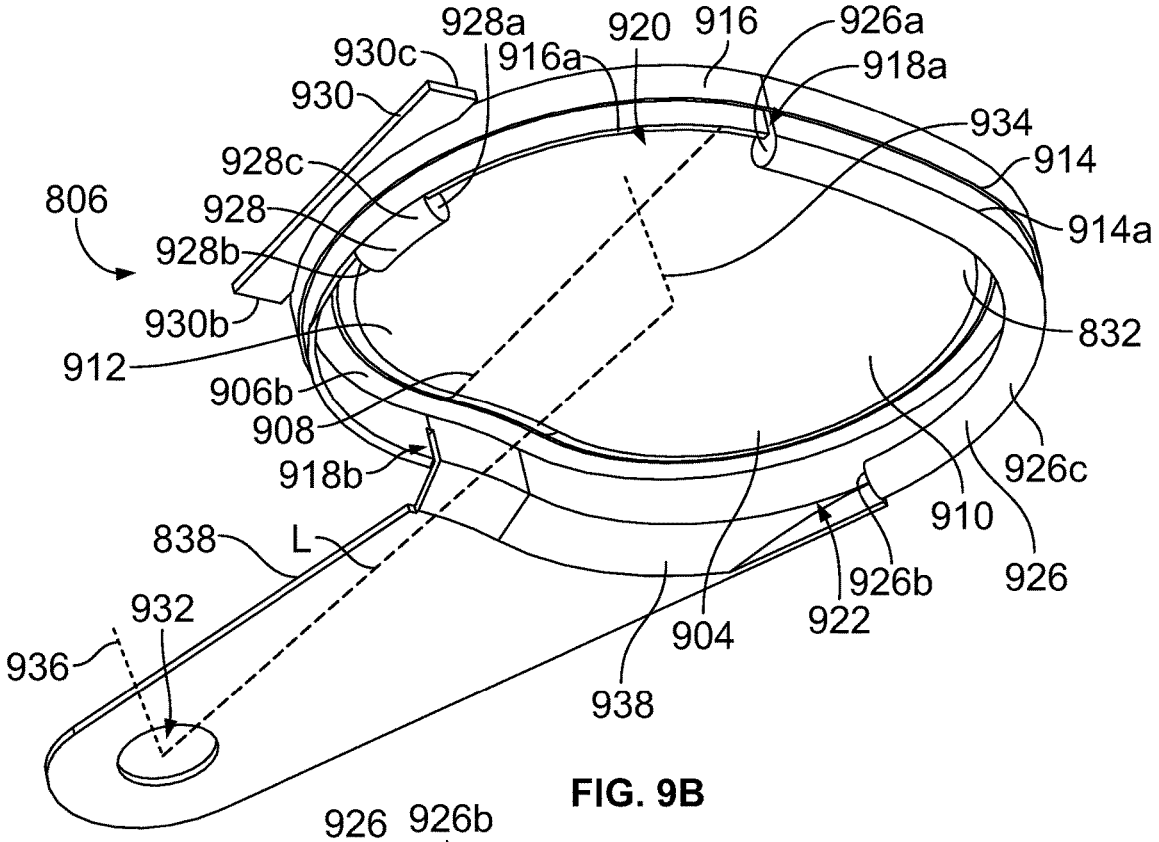
Figure 9C:
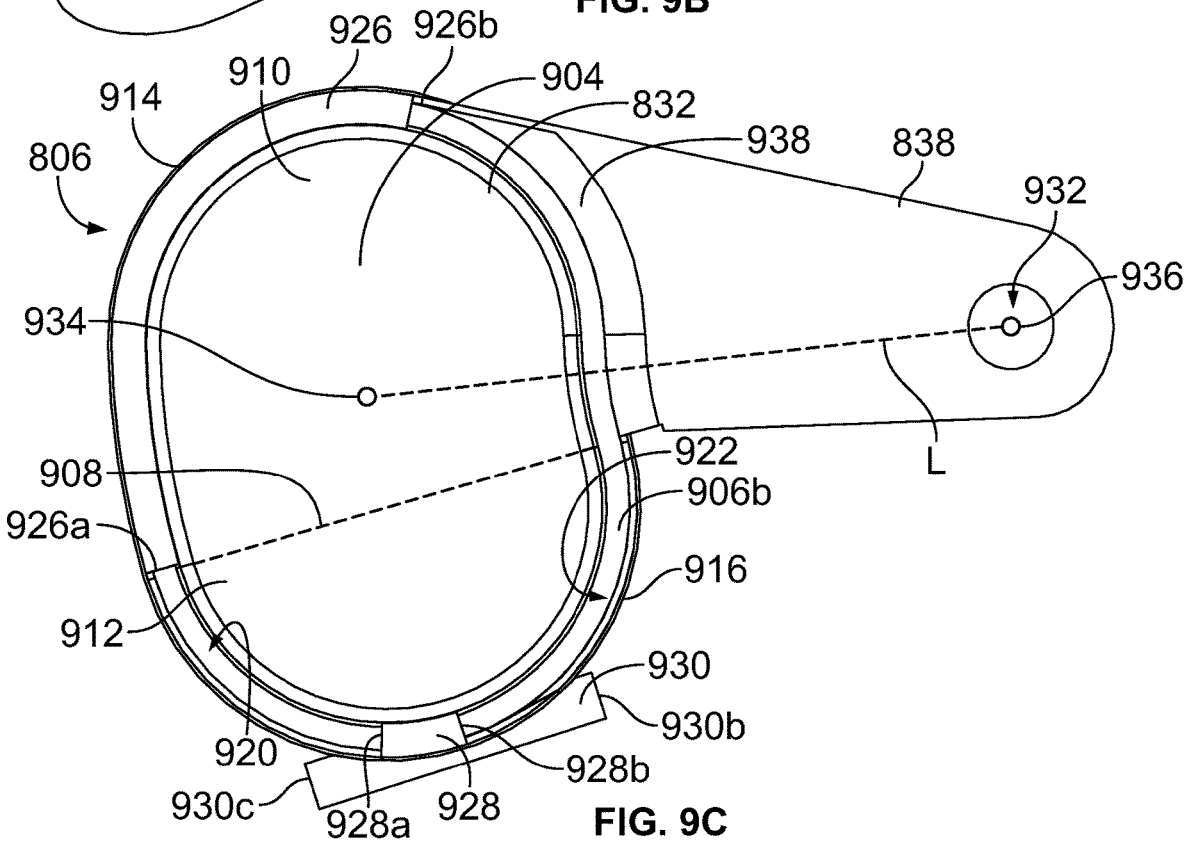
FIG. 9C is a bottom view of the example cover of FIGS. 8A, 8B, 8C, 9A, and 9B.

FIG. 9A is a perspective view of the example cover 806 of FIGS. 8A and 8B. FIG. 9B is another perspective view of the example cover 806 of FIGS. 8A, 8B, and 9A. FIG. 9C is a bottom view of the example cover 806 of FIGS. 8A, 8B, 9A and 9B.

The base 832 of the illustrated example includes an outer loop 902 (e.g., an outer edge or ridge) and a mid-panel 904 (e.g., an indentation, a down panel, a center panel, etc.). The outer loop 902 of the base 832 of the illustrated example is positioned around (e.g., encases) a perimeter of the mid-panel 904. The mid-panel 904 of the illustrated example is recessed relative to an outer surface 906*a* of the outer loop 902 and protrudes away from an inner surface 906*b* of the outer loop 902.

The cover 806 of the illustrated example includes a crease or score line 908. The score line 908 of the illustrated example separates a first portion 910 of the base 832 and a second portion 912 of the base 832. The score line 908 of the illustrated example is a hinge. As such, the first portion 910, for instance, is a fixed portion of the base 832 and the second portion 912 is a liftable portion (e.g., a liftable tab) of the base 832. For example, the first portion 910 of the base 832 has a fixed spatial relationship relative to the center panel 808. The second portion 912 of the base 832 has an adjustable spatial relationship relative to the center panel 808.

The cover 806 of the illustrated example includes a second wall 914 and a third wall 916. The second wall 914 and the third wall 916 are formed around a perimeter of the outer loop 902. In particular, the second wall 914 and the third wall 916 of the illustrated example extend from (e.g., a perimeter edge) of the outer loop 902 in a direction away from the outer surface 906*a* (e.g., toward the surface 822 of the center panel 808). In this manner, the second wall 914 and the third wall 916 of the illustrated example are to position around a perimeter of the first wall 820 when the cover 806 is in the closed position 802.

The cover 806 of the illustrated example includes a slit or notch 918 defined between the second wall 914 and the third wall 916. The notch 918 of the illustrated example is aligned with the score line 908 (e.g., aligned along a plane orthogonal to the center panel 808). The notch 918 of the illustrated example separates the second wall 914 and the third wall 916. As such, the second wall 914 of the illustrated example extends from the first portion 910 of the base 832 and the third wall 916 extends from the second portion 912 of the base 832. Accordingly, the third wall 916 can pivot or rotate about the score line 908 with the second portion 912 of the base 832, which allows the third wall 916 to be lifted away (e.g., separated) from the center panel 808.

The cover 806 of the illustrated example includes a first projection or protrusion 926 extending from the second wall 914 and a second projection or protrusion 928 extending from the third wall 916. The first protrusion 926 extends downwardly from the second wall 914 in a direction away from the inner surface 906*b*. The second protrusion 928 extends downwardly from the third wall 916 in a direction away from the inner surface 906*b*. The first protrusion 926 and the second protrusion 928 have circular shapes or cross-sections. Thus, the protrusions 926, 928 of the illustrated example can form a curl (e.g., a circular shape curl) or half curl (e.g., a semi-circular shape curl).

The first protrusion 926 of the illustrated example extends around a portion (e.g., between approximately 20 percent to 70 percent) of the perimeter of the second wall 914. The second protrusion 928 of the illustrated example extends around a portion (e.g., between approximately 2 percent to 10 percent) of the perimeter of the third wall 916. In other words, a first gap 920 is formed between a first end 926*a* of the first protrusion 926 and a first end 928*a* of the second protrusion 928 and a second gap 922 is formed between a second end 926*b* of the first protrusion 926 and a second end 928*b* of the second protrusion 928. In the illustrated example, the first end 926*a* of the first protrusion 926 is aligned adjacent or proximate (e.g., immediately adjacent within approximately between 1 millimeter and 10 millimeters) of a first notch 918*a* formed between the second wall 914 and the third wall 916. The second end 926*b* of the first protrusion 926 is positioned adjacent or proximate (e.g., immediately adjacent within approximately between 1 millimeter and 10 millimeters) of a flange 938 of the web 838. The second protrusion 928 is positioned between respective notches 918*a*, 918*b* formed between the second wall 914 and the third wall 916. The second protrusion 928 provides a locking tab when the cover 106 is in the closed position 802. A surface 926*c* of the first protrusion 926 extends (e.g., downwardly) past an end 914*a* of the second wall 914. Likewise, a surface 928*c* of the second protrusion 928 extends (e.g., downwardly) past an end 916*a* of the third wall 916. For example, the first protrusion 926 and the second protrusion 928 extend closer to the center panel 808 than the ends 914*a*, 916*a* of the second and third walls 914, 916, respectively.

To facilitate pivotal movement of the second portion 912 of the base 832 relative to the first portion 910, the cover 806 of the illustrated example includes a tab or grip 930. The grip 930 of the illustrated example extends from the second portion 912 of the base 832. The grip 930 of the illustrated example has an upper surface 930*a* that is flush (e.g., a continuing surface) with the outer surface 906*a* the outer loop 902. The second protrusion 928 of the illustrated example is positioned under the grip 930 (and between lateral ends 930*b*, 930*c* of the grip 930).

The web 838 of the illustrated example includes an opening 932 through which the web 838 is staked to the center panel 808. Specifically, the rivet 840 (FIGS. 8A-8B) is inserted through the opening 932 to stake the web 838 and, thus, the cover 806 to the center panel 808. As a result, the web 838 does not detach from the center panel 808. The web 838 of the illustrated example is fixed (e.g., jointed) to the second wall 914. Specifically, the web 838 of the illustrated example is fixed to the second wall 914 between the first notch 918*a* and a portion of the second wall 914 (e.g., the second end 928*b* of the second protrusion 928). The web 838 is fixed to, and extends from, the second wall 914. In other words, the web 838 projects a distance from the second wall 914 in a direction away from a longitudinal axis 934 of the cover 806 such that a pivot axis 936 defined by the opening 932 is spaced from the longitudinal axis 934 of the cover 806 by a distance L. A flange 938 of the web 838 of the illustrated example extends along a perimeter of the second wall 914 that is opposite a perimeter of the second wall 914 on which the first end 926*a* of the first protrusion 926 is located. In some examples, the web 838 is fixed to the first portion 910 of the base 832. When coupled to the can end 100 via the rivet 840, the web 838 of the illustrated example prevents the cover 806 from separating (e.g., being lifted away) from the center panel 808.

Figure 10A:
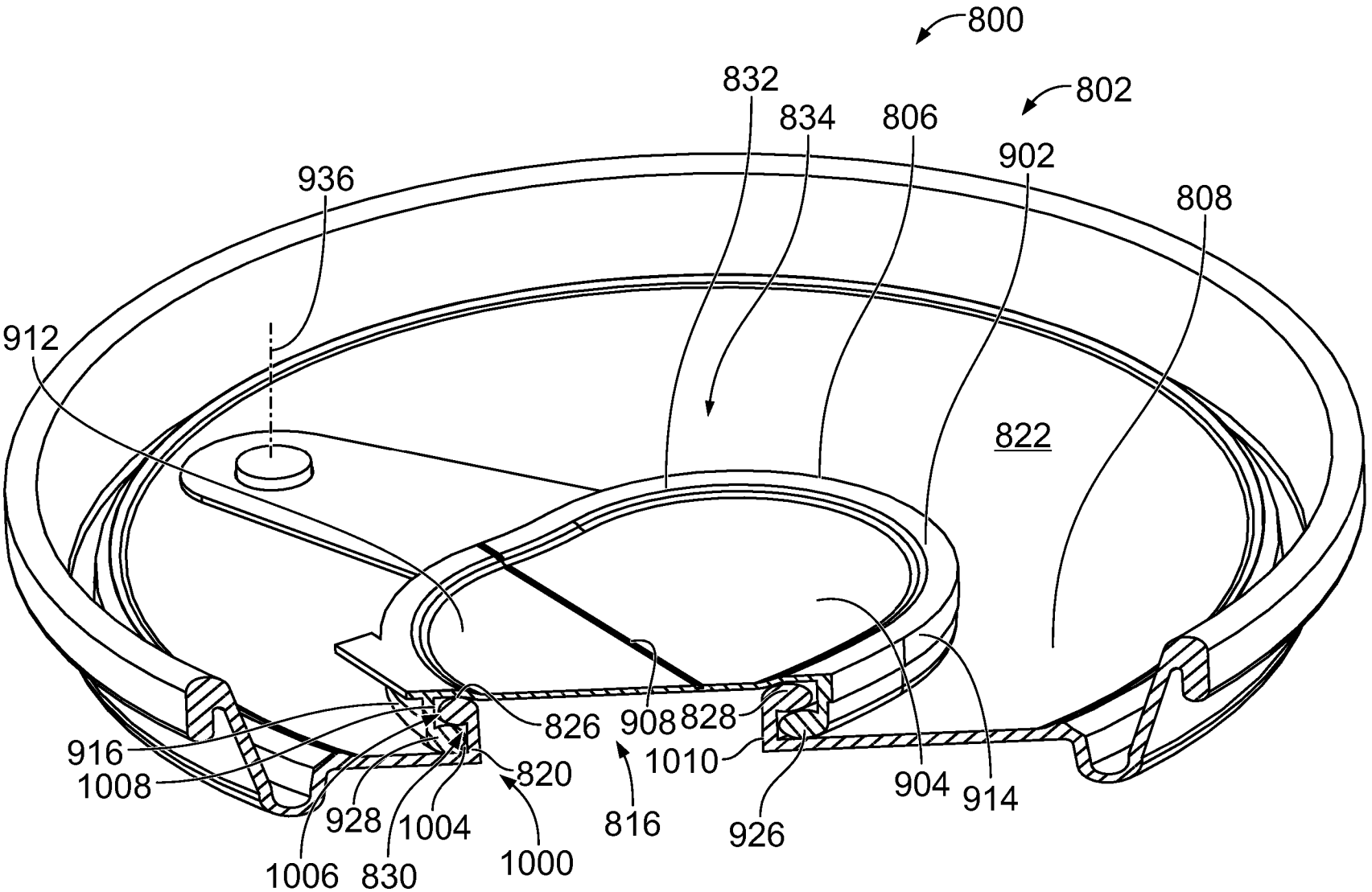
FIGS. 10A and 10B are partial, cut away views of the example can end of FIGS. 8A, 8B and 8C.
Figure 10B:
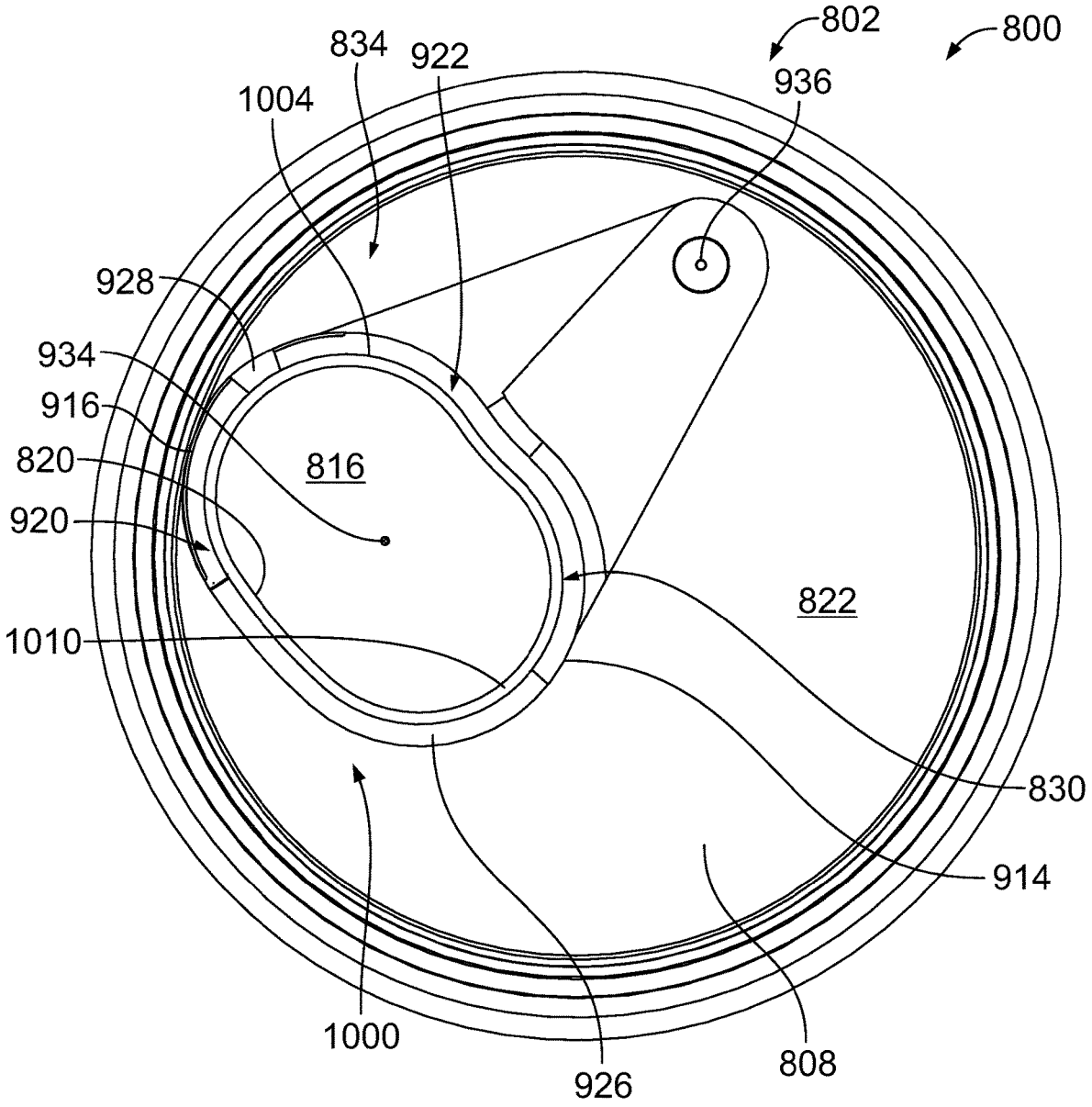
Figure 10C:
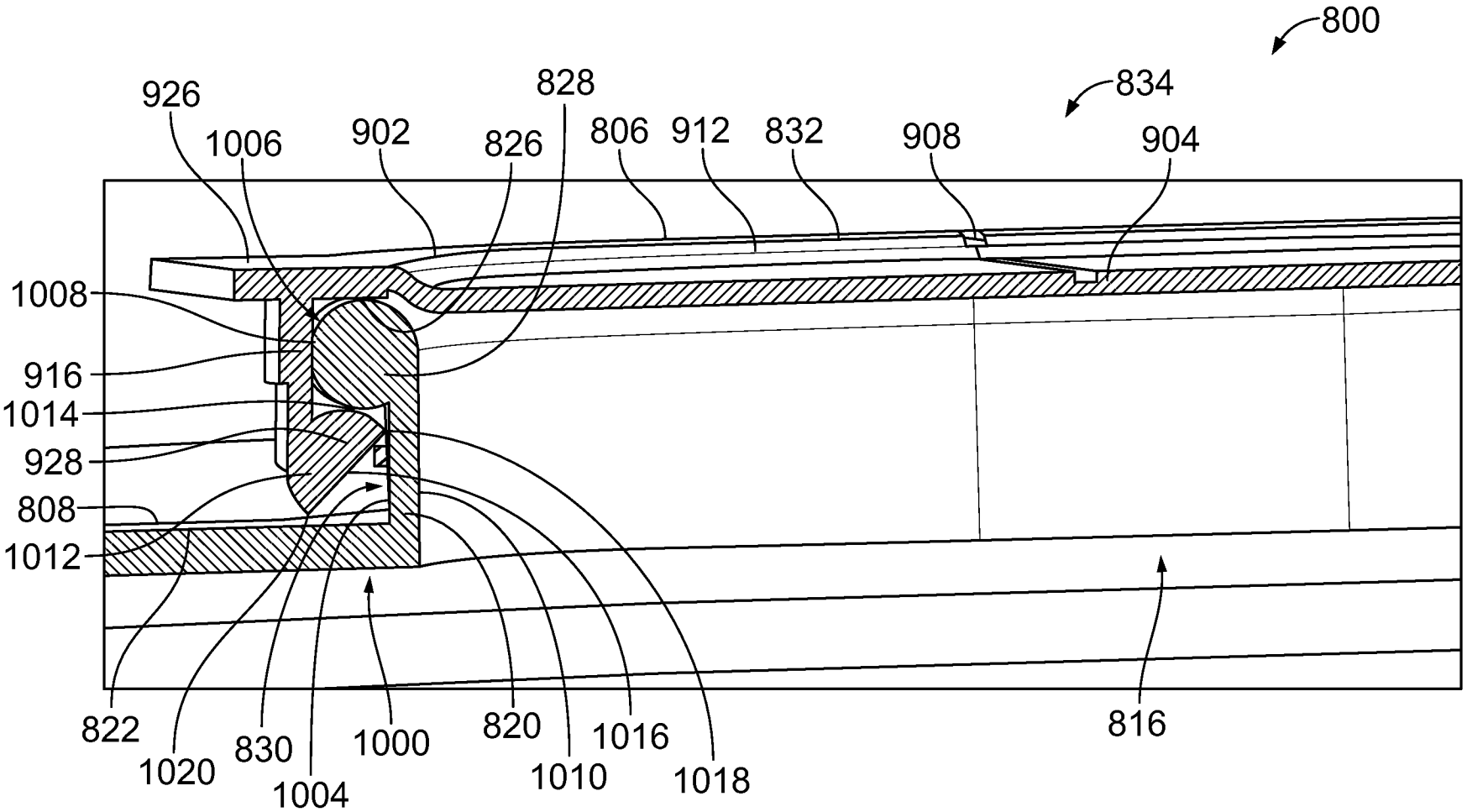
FIG. 10C is a cross-sectional view of the example can end of FIGS. 8A, 8B, and 8C taken along line 10-10 of FIG. 8A.

FIGS. 10A and 10B are partial, cut-away views of the example can end 800 of FIGS. 8A and 8B. FIG. 10C is a partial cross-sectional view of the example can end 800 of FIGS. 8A and 8B taken along line 10-10 of FIG. 8A. The cover 806 is in the closed position 802 and the second portion 912 of the cover 806 is in a latched position 1000. The can end 800 of the illustrated example includes the first track 830 defined between the center panel 808, the first wall 820, and the lip 828. When the cover 806 is in the closed position 802 and in the latched position 1000, the first protrusion 926 and the second protrusion 928 of the illustrated example are engaged and interlocked with the first track 830. For example, the first protrusion 926 and the second protrusion 928 interface (e.g., engage via friction) with the center panel 808, the first wall 820, and the lip 828 to conceal and prevent access to the pour opening 816. Specifically, the first protrusion 926 and the second protrusion 928 are positioned against an outer surface 1004 (e.g., facing away from the pour opening 816) of the first wall 820 and pressed or captured between the center panel 808 and the lip 828 (e.g., via friction fit) to lock the cover 806 over the pour opening 816 and prevent movement of the cover 806 relative to the pour opening 816 about the pivot axis 936.

The cover 806 of the illustrated example includes a second track 1006 defined between the base 832 of the cover 806 and the first and second protrusions 926, 928. In some examples, the second wall 914 and the third wall 916 include grooves to define the second track 1006. When the cover 806 is in the first position 834, the lip 828 of the first wall 820 of the illustrated example is engaged and interlocked with the second track 1006. For example, the lip 828 interfaces with the base 832, the second wall 914, the third wall 916, the first protrusion 926 and the second protrusion 928 when the cover 806 is in the closed position 802. Specifically, the lip 828 is positioned against an inner surface 1008 of the second wall 914 and pressed between the base 832 and the first and second protrusions 926, 928 to lock the cover 806 over the pour opening 816.

When the cover 806 is in the first position 834, the outer loop 902 of the cover 806 presses against the second end 826 of the first wall 820. Specifically, the engagement between (1) the lip 828 and the second track 1006 and (2) the first and second protrusions 926, 928 and the first track 830, presses the base 832 toward the center panel 808. Accordingly, the mid-panel 904 of the illustrated example is positioned adjacent to an interior surface 1010 of the first wall 820. For example, the mid-panel 904 can be positioned at least partially within the pour opening 816 (e.g., extend below the second end 826 of the first wall 820 and/or the lip 828. Thus, the mid-panel 904 of the illustrated example is positioned at least partially closer than the second end 826 of the first wall 820 to the center panel 808. Moreover, the mid-panel 904 of the illustrated example has a perimeter that substantially matches the perimeter of the pour opening 816. Accordingly, the mid-panel 904 of the illustrated example is adjacent to the first wall 820 and covers the pour opening 816 when the cover 806 is in the closed position 802. As a result, the cover 806 seals the pour opening 816 and prevents contents within the associated can body 842 from spilling therethrough.

In some examples, the score line 908 is positioned across a lengthwise midsection of the base 832 of the cover 806 (e.g., aligned with a plane defined by the longitudinal axis 934 of the cover 806 and the pivot axis 936 of the cover 806). In such examples, the gaps 920, 922 can be substantially eliminated. For example, the first protrusion 926 can extend around a perimeter of the second wall 914 and the second protrusion 928 can extend around a perimeter of the third wall 916.

In the illustrated example of FIG. 10C, the second protrusion 928 is a half curl 1012. In other words, the second protrusion 928 has a half-circle cross-sectional shape. Specifically, an upper portion 1014 of the second protrusion 928 is curved to engage or interface with the lip 828 of the first wall 820. Additionally, the second protrusion 928 includes a flat face 1016 defined between a first edge 1018 (e.g., an upper edge) and a second edge 1020 (e.g., a lower edge). The first edge 1018 of the second protrusion 928 engages (e.g., interfaces) with the outer surface 1004 of the first wall 820. The second edge 1020 of the second protrusion 928 engages (e.g., interfaces) with the surface 822 of the center panel 808. In some examples, the center panel 808 can include a groove to receive the second edge 1020. Likewise, in some examples, the first wall 820 can include a groove to receive the first edge 1018. When the second portion 912 of the cover 806 is in the latched position 1000, the lip 828 of the first wall 820 can press the second protrusion 928 (e.g., downward) toward the center panel 808. As a result, the second edge 1020 of the second protrusion 928 can press (e.g., dig) into the surface 822 of the center panel 808 to lock the second portion 912 of the cover 806 in the latched position 1000.

Figure 11A:
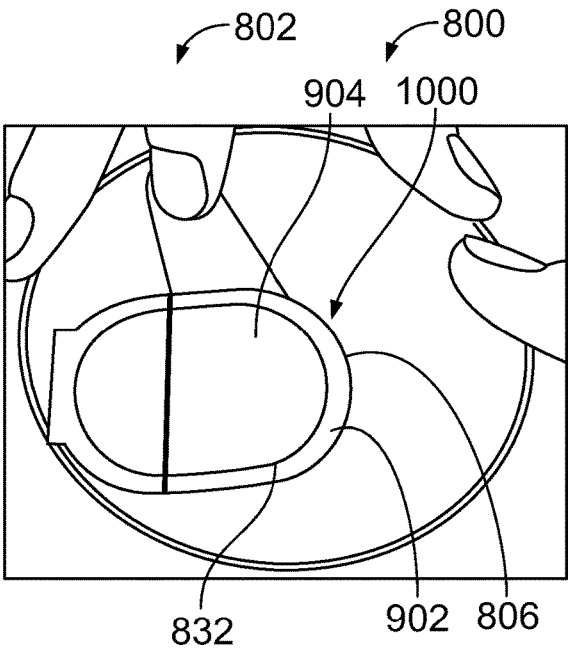
FIGS. 11A-11D illustrate the example cover of FIGS. 8A, 8B, 8C, 9A, and 9B in different example sequential positions between the example open position and the example closed position.

FIGS. 11A-D are perspective views of the example can end 800 of FIGS. 8A and 8B shown in different example positions between a fully closed position (e.g., the closed position 802) and a fully open position (e.g., the open position 804). FIG. 11A illustrates the can end 800 in the closed position 802 and the cover 806 in the latched position 1000. In the closed position 802 and the latched position 1000, the lip 828 (FIG. 8B) is interlocked in the second track 1006 (FIGS. 10A-10C) and the first and second protrusions 926, 928 (FIGS. 9A-9C) are interlocked in the first track 830 (FIG. 8B). In other words, engagement between the second protrusion 928 (e.g., the locking tab) and the lip 828 of the first wall 820 (e.g., provides an interference that) prevents rotation of the cover 806 about the pivot axis 936 (FIGS. 9A-9C). Additionally, in the closed position 802 and the latched position 1000, the cover 806 covers the pour opening 816 and engages (e.g., presses or seals) against the second end 826 of the first wall 820 (FIG. 8B). Specifically, the outer loop 902 of the base 832 of the illustrated example is displaced over and presses against (e.g., seals) the lip 828 when the cover 806 is in the closed position 802. Additionally, the mid-panel 904 is positioned over the pour opening 816 adjacent to the first wall 820. As a result, the cover 806 conceals and/or prevents access to the pour opening 816.

Figure 11B:
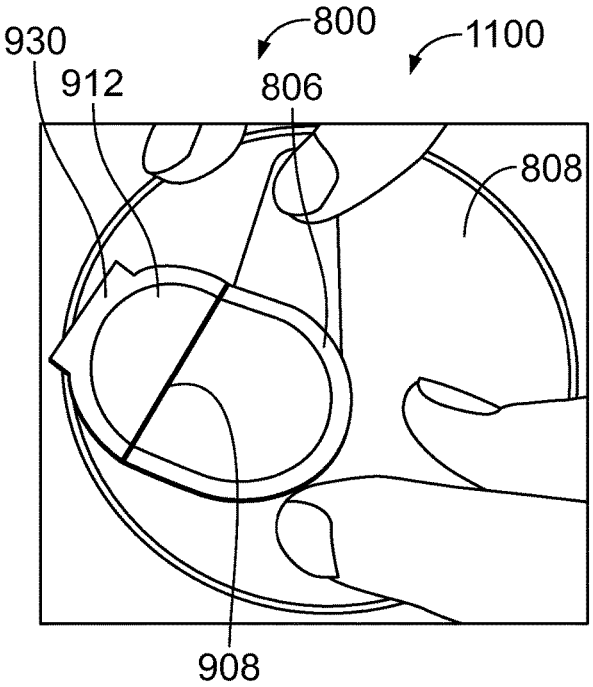

FIG. 11B illustrates the cover 806 in the closed position 802 and an unlatched position 1100. To move the cover 806 to the unlatched position 1100, the cover 806 is bent at the score line 908. For example, the third wall 916 is separated from the second wall 914 and the center panel 808. For example, the second portion 912 of the cover 806 can be lifted via the grip 930. As a result, the second portion 912 moves away from the first track 830 in response to the grip 930 being lifted away from the center panel 808 because the second protrusion 928 is attached to the second portion 912. In the unlatched position 1100, the second protrusion 928 disengages from the first track 830 and/or the outer surface 1004 (FIG. 10A) of the first wall 820. For example, the second protrusion 928 moves at least partially above the lip 828 of the first wall 820.

Figure 11C:
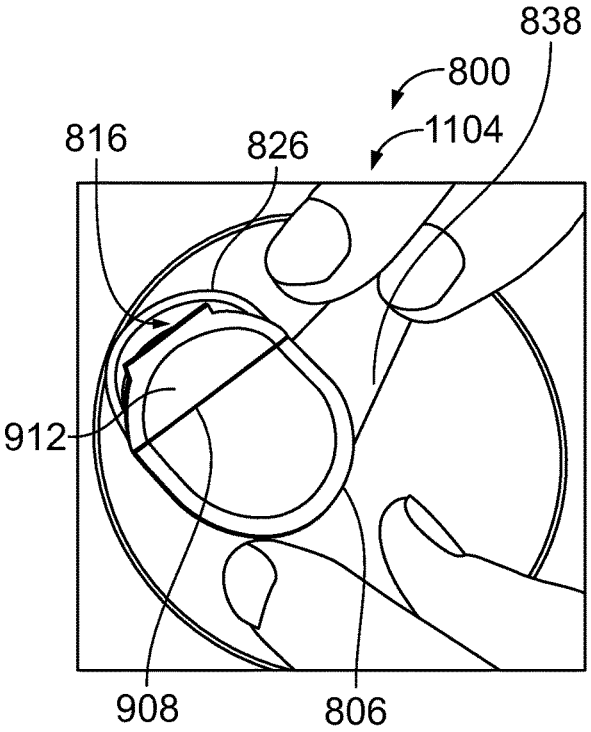

FIG. 11C illustrates the can end 800 having the cover 806 in a second partially open position 1104. In the second partially open position 1104, the second portion 912 of the cover 806 is bent about the score line 908 and the second protrusion 928 is disengaged from the first track 830. As a result, the cover 806 can rotate about the pivot axis 936 (FIG. 9A) (e.g., without interference from the second protrusion 928 relative to the first wall 820). In the second partially open position 1104, the web 838 and the cover 806 pivot about the rivet 840 (FIGS. 8A-8B). In turn, the cover 806 moves to uncover a portion of the pour opening 816.

The cover 806 of the illustrated example can include an epoxy coating (e.g., to prevent or otherwise reduce friction between the cover 806 and the second end 826 of the first wall 820 when the cover 806 rotates relative to the first wall 820). In some examples, contents within the can body 842 (FIG. 8C) associated with the can end 800 can be dispensed through the pour opening 816 at a reduced flow rate when the cover 806 is in the second partially open position 1104.

Figure 11D:
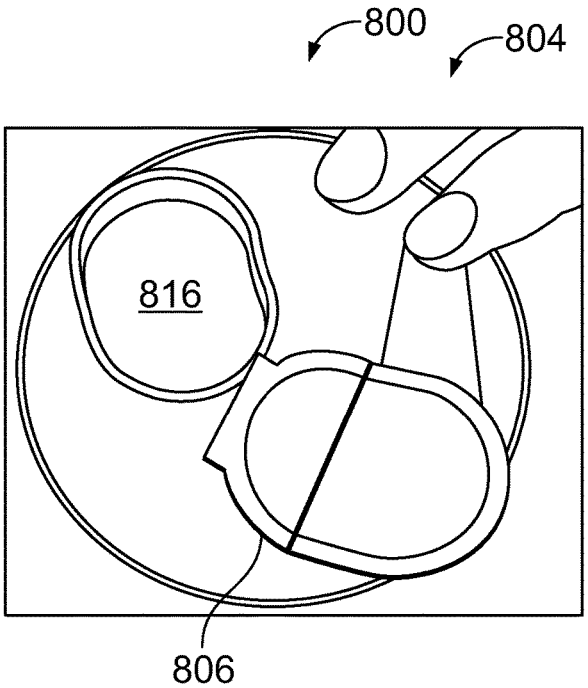

FIG. 11D illustrates the can end 800 in the open position 804. In the open position 804, the cover 806 has been rotated from the second partially open position 1104 to the open position 804 to expose (e.g., fully expose) the pour opening 816 and, thus, allow contents within an associated container to pour therethrough.

Figure 12A:
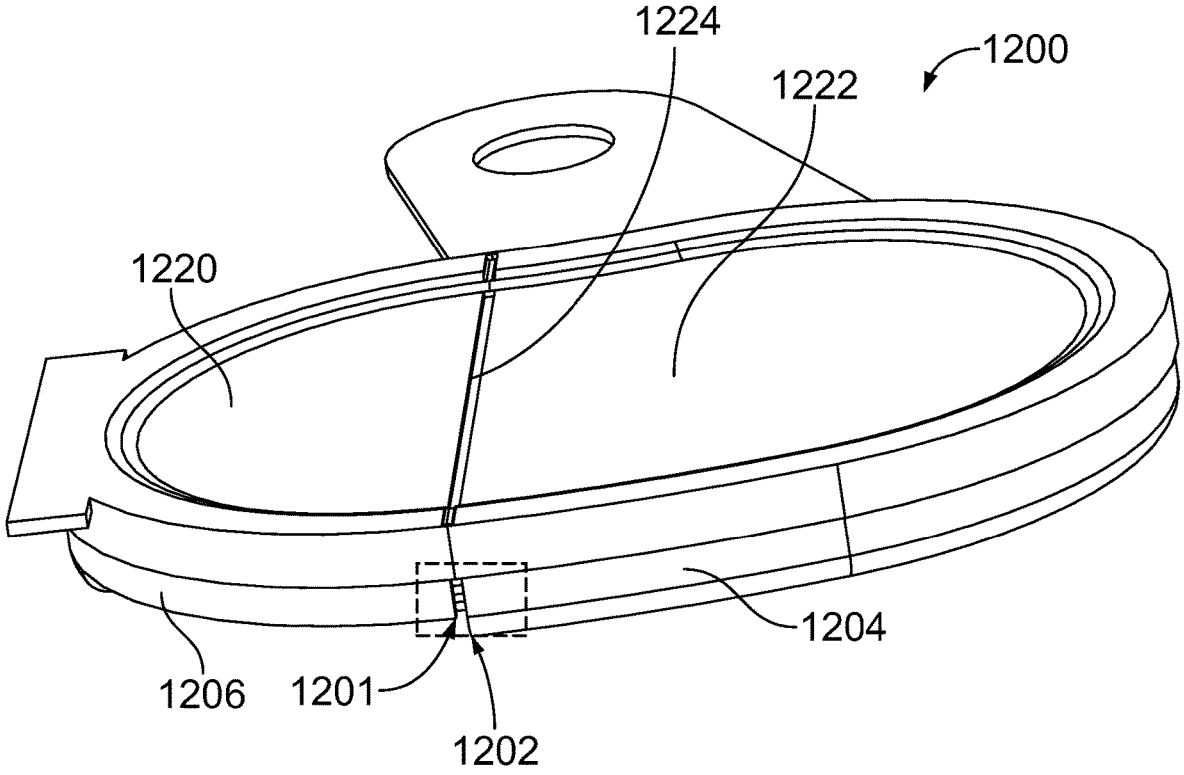
FIG. 12A is a perspective view of another example cover disclosed herein.
Figure 12B:
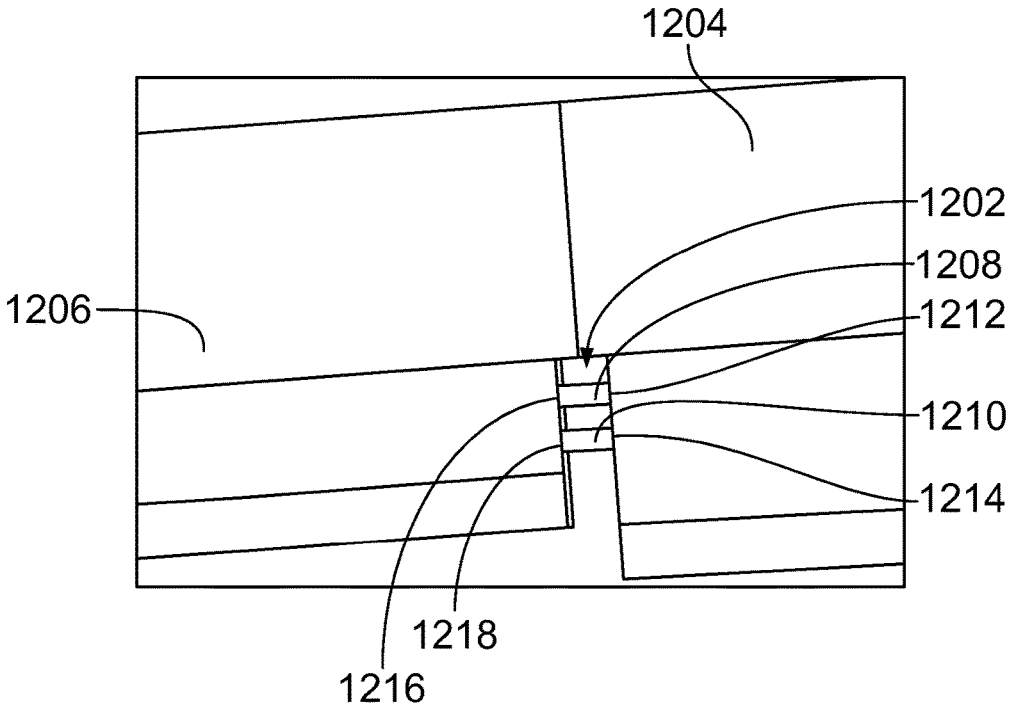
FIG. 12B is an enlarged, partial perspective view of the example cover of FIG. 12A.

FIG. 12A illustrates another example cover 1200 disclosed herein. FIG. 12B is an enlarged view of the cover 1200. The cover 1200 of the illustrated example is substantially similar to the cover 806 of FIGS. 8A-8B, 9A-9B, and 10A-10C, but includes a tamper evidence feature 1201. The cover 1200 includes a notch 1202 between a first wall 1204 and a second wall 1206. The tamper evidence feature 1201 of the illustrated example includes a first bracket or rib 1208 (e.g., a first metal strip) and a second bracket or rib 1210 (e.g., a second metal strip). The ribs 1208, 1210 of the illustrated example are positioned in and/or span across the notch 1202. Specifically, first ends 1212, 1214 of the ribs 1208, 1210 are coupled to the first wall 1204. Second ends 1216, 1218 of the ribs 1208, 1210 are coupled to the second wall 1206.

The ribs 1208, 1210 of the illustrated example indicate whether the cover 1200 has been opened and, thus, whether a pour opening (e.g., the pour opening 816 of FIG. 8B) has been exposed. Thus, the ribs 1208, 1210 provide tamper evidence capabilities (e.g., tamper evidency). Specifically, the ribs 1208, 1210 of the illustrated example break or rupture in response to a first portion 1220 of the cover 1200 being lifted relative to a second portion 1222 about a score line 1224. For example, the ribs 1208, 1210 break when the first portion 1220 of the cover 1200 is lifted about the score line 1224 and the second wall 1206 separates from the first wall 1204. Moreover, at least one or more of the first ends 1212, 1214 of the ribs 1208, 1210 remain attached to the first wall 1204 or at least one or more of the second ends 1216, 1218 remain attached to the second wall 1206 in response to the ribs 1208, 1210 rupturing. As such, consumers can identify whether the cover 1200 has been opened (e.g., tampered with) based on a state (e.g., ruptured or non-ruptured) of the ribs 1208, 1210. In some examples, the first wall 1204 and the second wall 1206 are connected and the notch 1202 is eliminated. In such examples, perforations are disposed between the first wall 1204 and the second wall 1206 in place of the notch 1202. Accordingly, the connection between the first wall 1204 and the second wall 1206 ruptures at the perforations to provide evidence indicative of whether an initial opening of the cover 1200 has occurred.

Figure 13A:
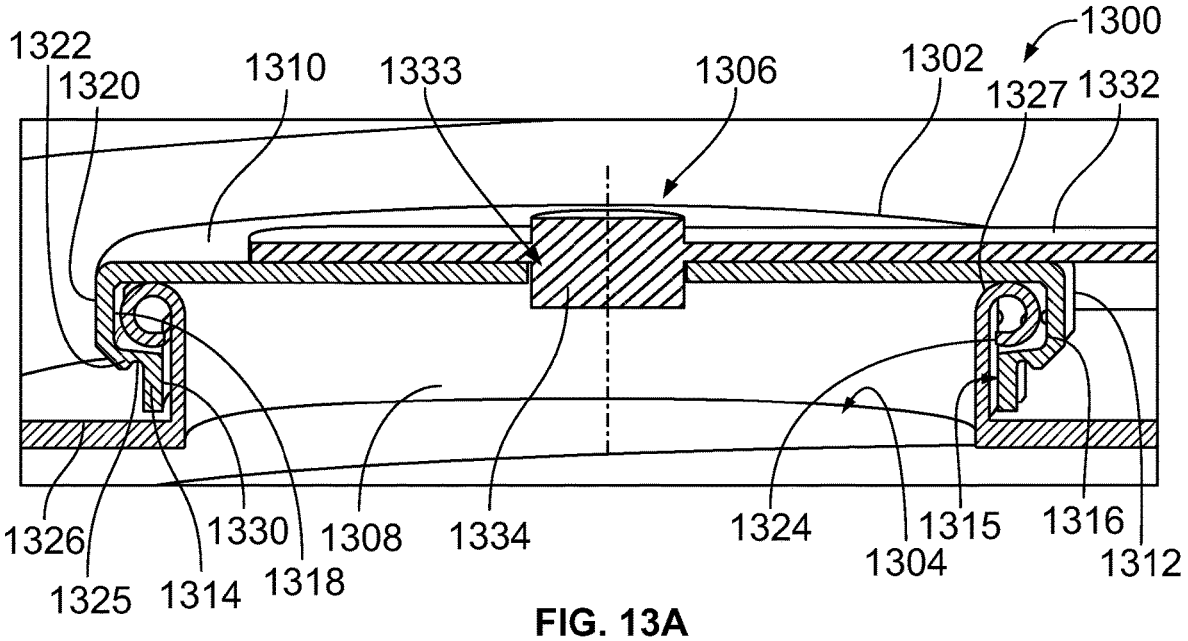
FIG. 13A is a cross-sectional view of yet another example can end having another example cover disclosed herein.
Figure 13B:
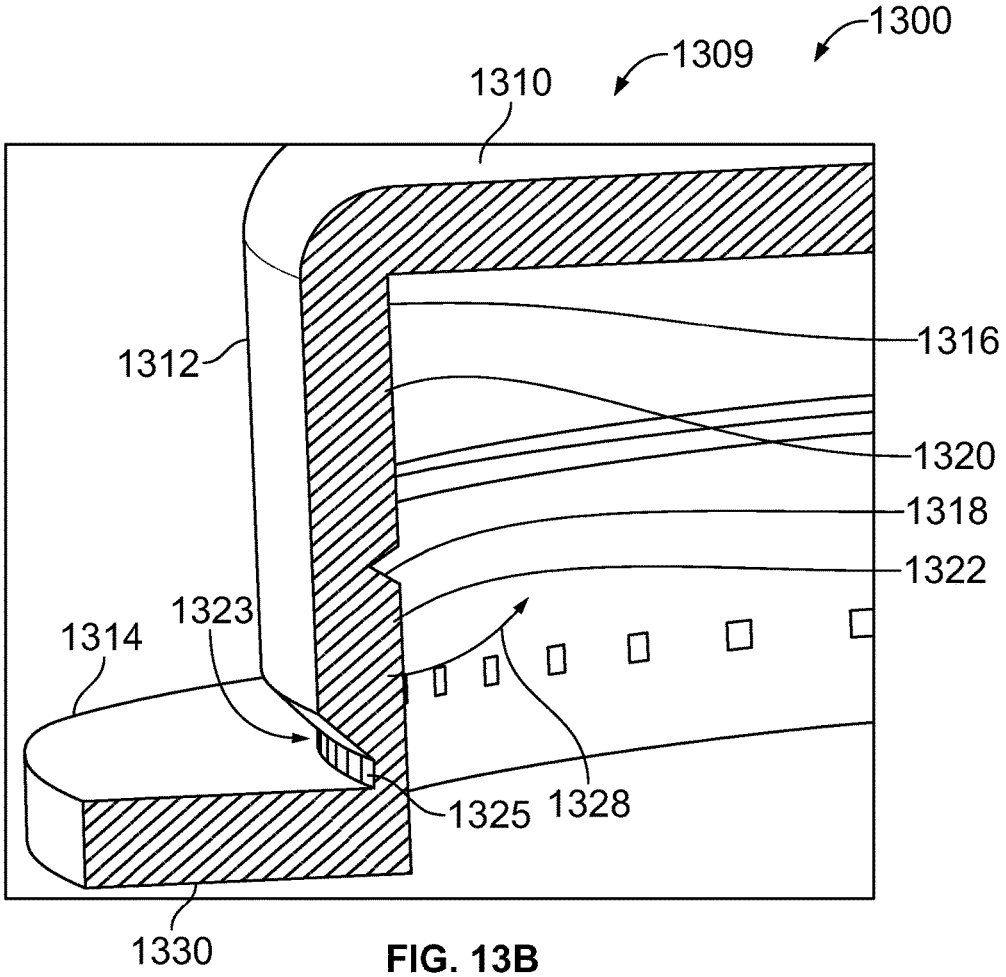
FIG. 13B is an enlarged view of the example cover of FIG. 13A.

FIG. 13A is a cross-sectional view of another example can end 1300 disclosed herein. The can end 1300 of the illustrated example includes a cover 1302 positioned over a pour opening 1304 (e.g., in a closed position 1306). The pour opening 1304 includes a circular perimeter that is surrounded by an annular wall 1308 (e.g., similar to the first wall 124 of the can end 100 of FIGS. 1A and 1B). FIG. 13B is a partial, enlarged view of an example preform 1309 of the example cover 1302 of FIG. 13A.

The cover 1302 of the illustrated example includes a top wall 1310, a sidewall 1312, and a flange 1314. When the cover 1302 is in the closed position 1306, the top wall 1310 is positioned over the pour opening 1304 and the sidewall 1312 is positioned around a perimeter of the annular wall 1308. An interior surface 1316 of the sidewall 1312 of the illustrated example includes an annular groove 1318 (e.g., at a midpoint of the sidewall 1312) that separates an upper portion 1320 (e.g., a first portion) of the sidewall 1312 and a lower portion 1322 (e.g., a second portion) of the sidewall 1312. Specifically, the upper portion 1320 of the sidewall 1312 is fixed to the top wall 1310 and the lower portion 1322 of the sidewall 1312 is fixed to the flange 1314. An interface 1323 between the lower portion 1322 of the sidewall 1312 and the flange 1314 includes perforations 1325 (e.g., a perforated ring). For example, the perforations 1325 are disposed along a perimeter of the sidewall 1312 between the lower portion 1322 of the sidewall 1312 and the flange 1314.

During assembly of the can end 1300, the top wall 1310 of the preform 1309 is positioned over the pour opening 1304 and the lower portion 1322 of the sidewall 1312 of the cover 1302 is rotated (e.g., bent) about the annular groove 1318 in a direction 1328 toward the top wall 1310. After the lower portion 1322 of the sidewall 1312 rotates, the lower portion 1322 is positioned at least partially underneath a curl 1324 extending from an end 1327 of the annular wall 1308 (e.g., between the curl 1324 and a center panel 1326 of the can end 1300). As a result, the flange 1314 is positioned underneath the curl 1324 such that a surface 1330 of the flange 1314 (e.g., a bottom surface of the flange 1314 of the preform 1309 of FIG. 13B) faces, engages, orients and/or otherwise interfaces with (e.g., an outer surface or vertical wall of) the annular wall 1308. For example, the flange 1314 is interlocked in a track 1315 defined between the curl 1324, the annular wall 1308, and the center panel 1326.

The cover 1302 of the illustrated example includes an arm or web 1332 coupled (e.g., rotatably or pivotably coupled) to the center panel 1326. The top wall 1310 of the cover 1302 of the illustrated example is rotatably coupled to a joint 1334 of the web 1332. For example, the top wall 1310 includes an opening 1333 to receive the joint 1334 about which the top wall 1310 rotates.

When in the closed position 1306, the cover 1302 provides a gas-tight seal over the pour opening 1304. In operation, to move the cover 1302 from the closed position 1306 to an open position (e.g., a position where the pour opening 1304 is exposed), the cover 1302 rotates or twists about the joint 1334 of the web 1332, which causes the sidewall 1312 to rupture at the perforations 1325. As a result, the flange 1314 detaches (e.g., completely separates) from the sidewall 1312 and remains positioned around the annular wall 1308 (e.g., between the center panel 1326 and the curl 1324). In this manner, the cover 1302 provides tamper proof evidency. To expose the pour opening 1304, a first portion of the cover 1302 (e.g., the second portion 212 of the cover 106 of FIGS. 2A-2E) is pivoted (e.g., about the score line 208 of the cover 106 of FIGS. 2A-2E) relative to a second portion of the cover (e.g., the first portion 210 of the cover 106 of FIGS. 2A-2E) to move the lower portion 1322 of the sidewall 1312 at least partially above the curl 1324 and, in turn, the cover 1302 pivots about the web 1332 to expose the pour opening 1304.

Figure 14A:
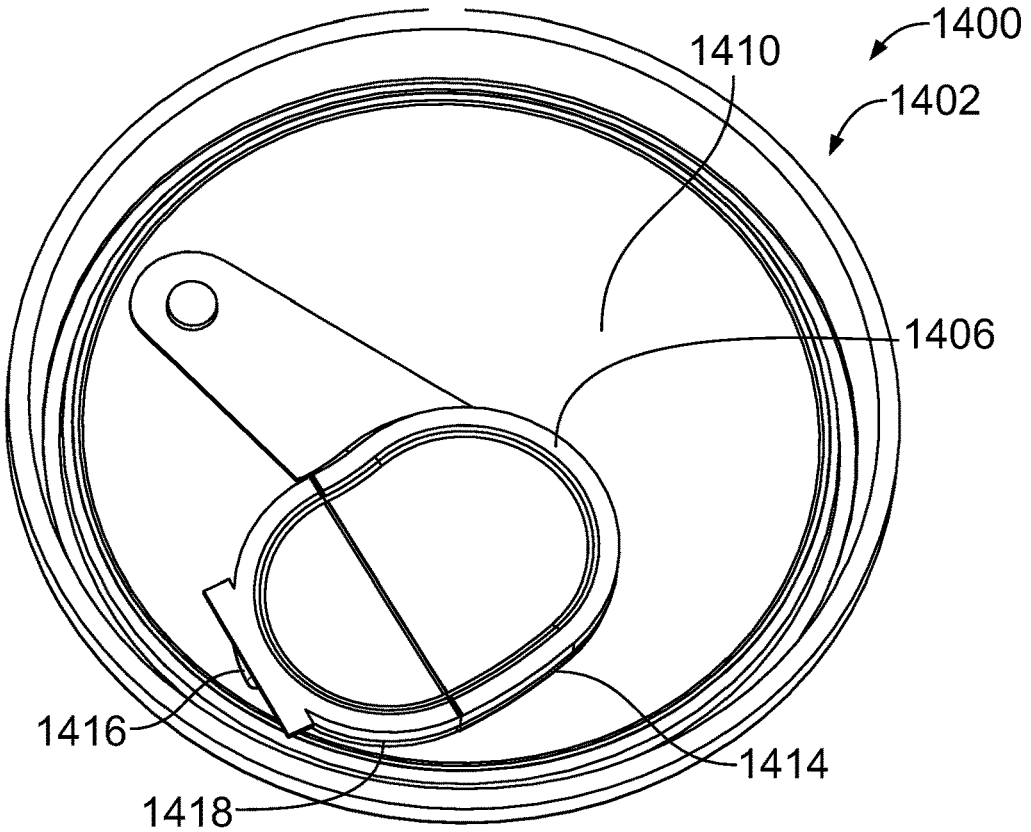
FIG. 14A is a perspective view of yet another example can end disclosed herein in an example closed position.
Figure 14B:
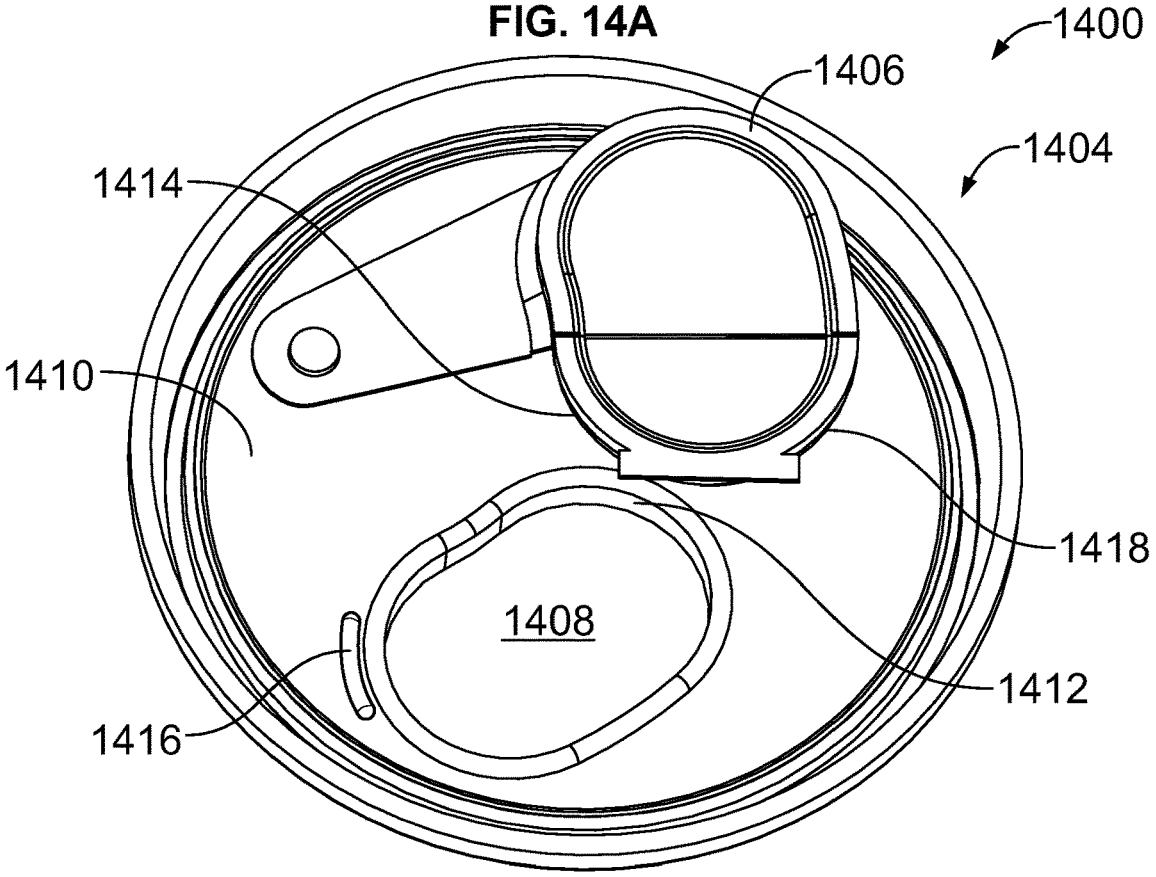
FIG. 14B is a perspective view of the example can end of FIG. 14A in an example open position.

FIG. 14A is a perspective view of another example can end 1400 in a closed position 1402. FIG. 14B is a perspective view of the example can end 1400 in an open position 1404. The can end 1400 includes another example cover 1406, which covers a pour opening 1408 (FIG. 14B) when the can end 1400 is in the closed position 1402 and exposes the pour opening 1408 when the can end 1400 is in the open position 1404. The can end 1400 of the illustrated example includes a center panel 1410 and a first wall 1412 extending from the center panel 1410 around a perimeter of the pour opening 1408. Additionally, the cover 1406 of the illustrated example includes a second wall 1414, which surrounds a perimeter of the first wall 1412 when the can end 1400 is in the closed position 1402. In some examples, the cover 1406 is identical to the cover 806 of FIGS. 8A and 8B.

The can end 1400 of the illustrated example includes a ridge or bead 1416 (e.g., a locking bead). The bead 1416 of the illustrated example extends from the center panel 1410. The bead 1416 of the illustrated example is separated from a portion of the first wall 1412 by a small distance (e.g., a distance approximately equal to a thickness of the second wall 1414). Specifically, the portion of the first wall 1412 that is slightly separated from the bead 1416 engages (e.g., interlocks with) a protrusion extending from the second wall 1414 (e.g., the second protrusion 928 of FIGS. 9A-9C) when the can end 1400 is in the closed position 1402. As such, when the can end 1400 is in the closed position 1402, the bead 1416 is engaged with a portion of an outer surface 1418 of the second wall 1414 (e.g., the surface 928*c* of the second protrusion 928 of FIGS. 9A-9C). Accordingly, the engagement between the bead 1416 and the outer surface 1418 locks and/or maintains the position of the cover 1406 over the pour opening 1408.

Figure 15:
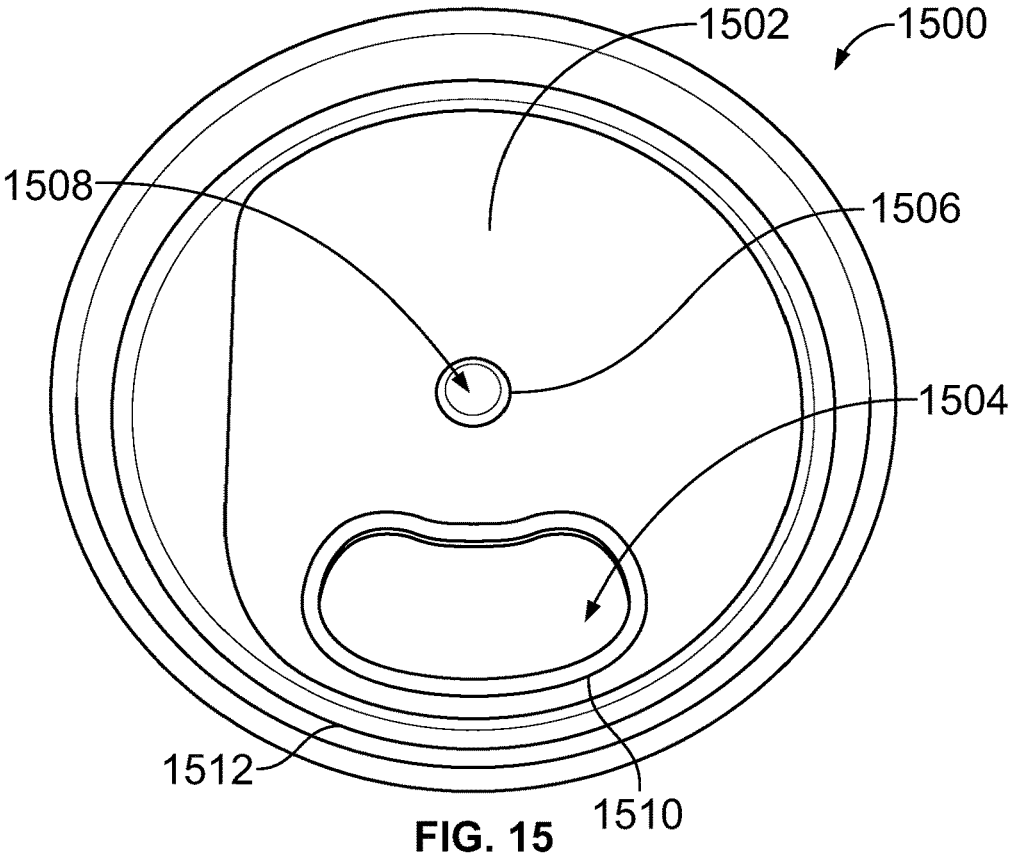
FIG. 15 is a top view of another example can end disclosed herein.

FIG. 15 is a perspective view of another example can end 1500. The can end 1500 of the illustrated example includes a center panel 1502 having a pour opening 1504. The pour opening 1504 of the illustrated example includes a kidney shaped perimeter. The center panel 1502 of the illustrated example includes a rivet 1506, which, in some examples, pivotally couples an example cover disclosed herein to the can end 1500. The rivet 1506 of the illustrated example is positioned at a center 1508 of the center panel 1502 and, thus, is not offset relative to a longitudinal or center axis of the can end 1500. Accordingly, an outer portion 1510 of the pour opening 1504 (e.g., on an opposite side of the pour opening 1504 from the center 1508 of the center panel 1502) of the illustrated example is separated from a circumferential wall 1512 by an equal distance across (e.g., the pour opening 1504 is not angled relative to the center of the center panel 1502).

Figure 16:
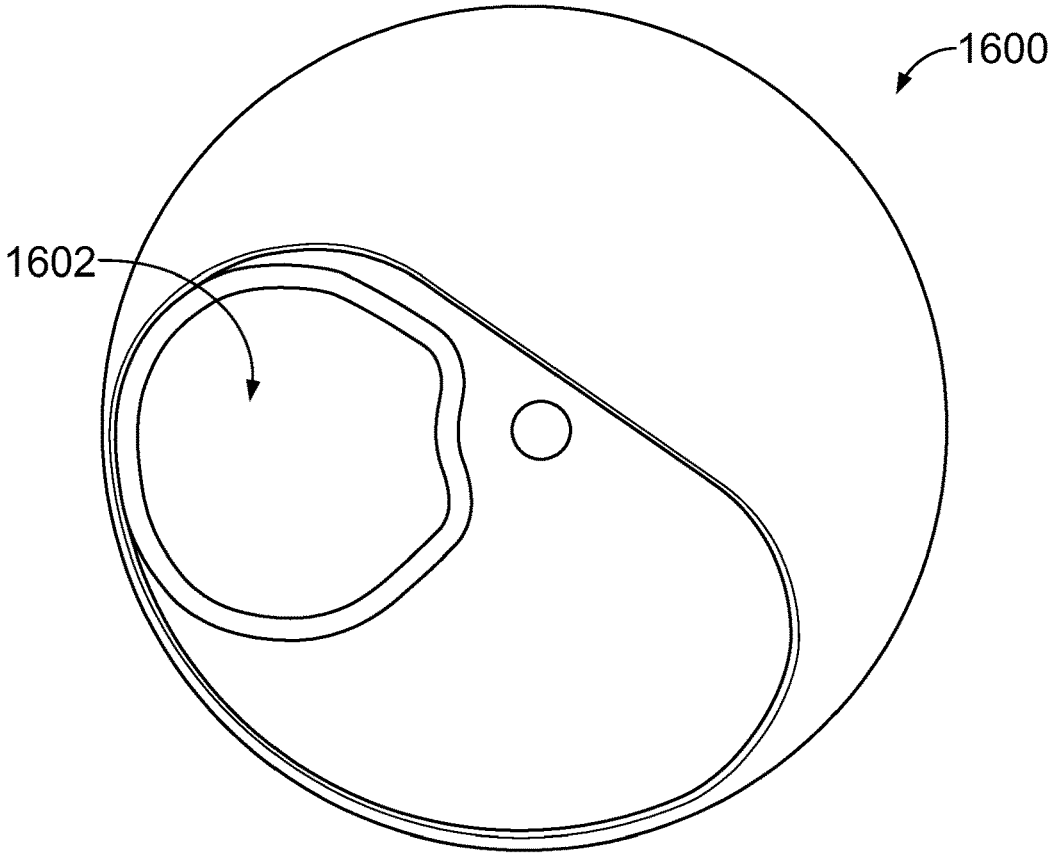
FIG. 16 is a top, perspective view of yet another example can end disclosed herein.

FIG. 16 is a top view of another example can end 1600. The can end 1600 includes another example pour opening 1602 that can be utilized by the example can end 100 of FIGS. 1A-B, the example can end 800 of FIGS. 8A-B, the example can end 1300 of FIGS. 13A-B, and/or the example can end 1400 of FIGS. 14A-B.

Figure 17A:
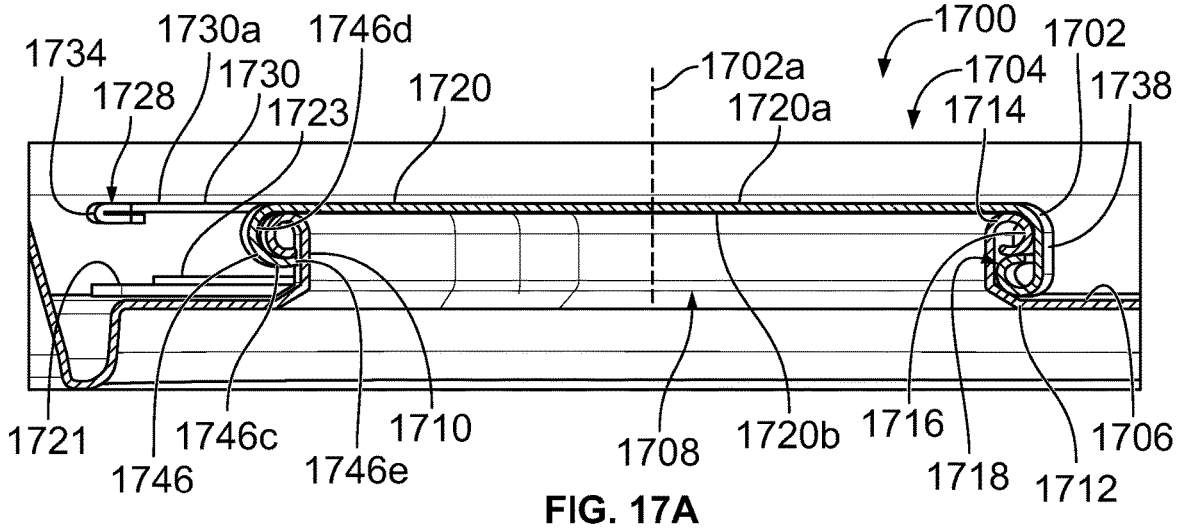
FIG. 17A is a cross-sectional view of a portion of another example can end disclosed herein.
Figure 17B:
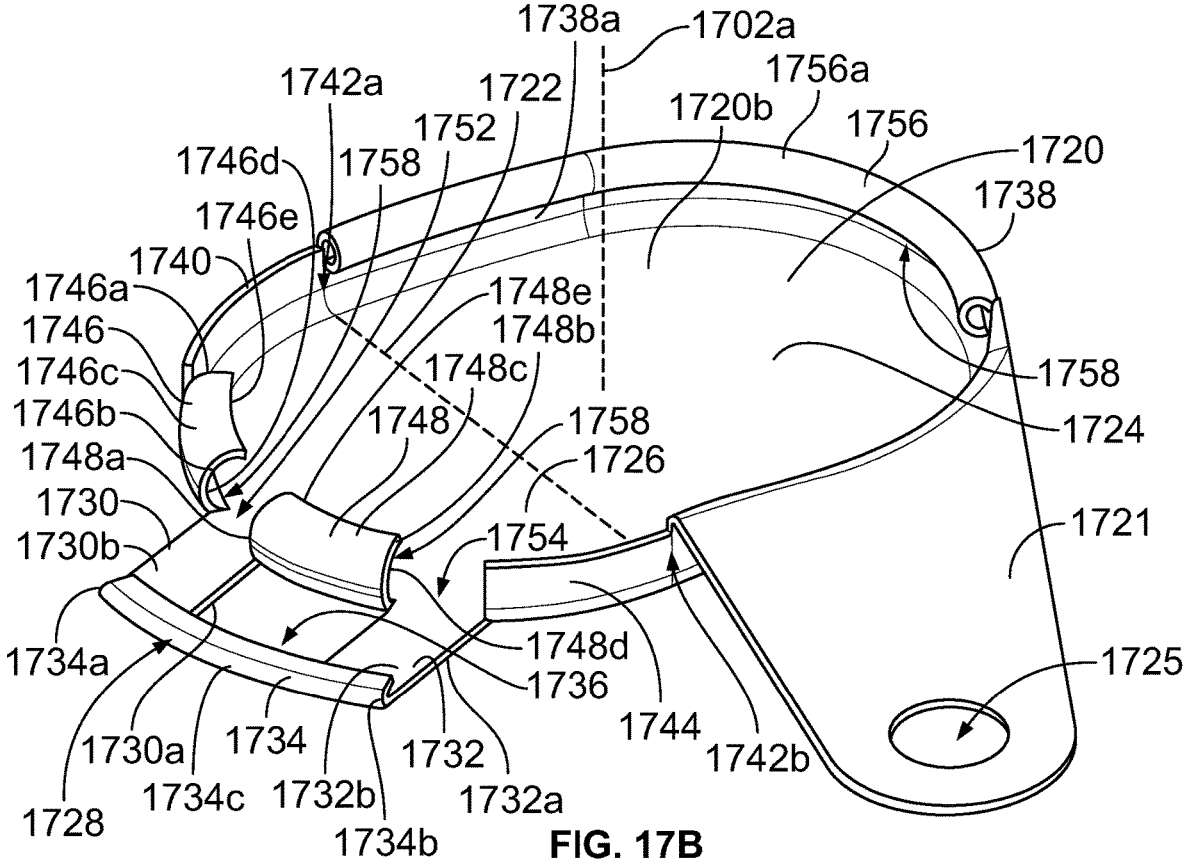
FIG. 17B illustrates an isolated perspective view of an example cover of the example can end of FIG. 17A.

FIG. 17A is a cross-sectional view of another example can end 1700 including another example cover 1702 in accordance with the teachings disclosed herein. In the illustrated example of FIG. 17A, the can end 1700 is in a closed position 1704. FIG. 17B is an isolated perspective view of the example cover 1702 of FIG. 17A. The example cover 1702 of FIGS. 17A-17B can additionally or alternatively be used with the example can end 800 of FIGS. 8A-8B, the example can end 1400 of FIGS. 14A-14B, and/or the example can end 1500 of FIG. 15.

The can end 1700 of the illustrated example includes a center panel 1706 having a pour opening 1708. The pour opening 1708 of the illustrated example has a kidney shape or profile (e.g., a kidney shaped perimeter) similar to the example pour opening 816 of FIG. 8B, the example pour opening 1408 of FIG. 14B, and/or the example pour opening 1504 of FIG. 15. In some examples, the pour opening 1708 can include an oval-shaped perimeter, a circular-shaped perimeter, and/or any other shape perimeter.

The can end 1700 of the illustrated example includes a first wall 1710 extending (e.g., in a vertical direction) from the center panel 1706 around the perimeter of the pour opening 1708 (e.g., adjacent to the pour opening 1708). For example, the first wall 1710 of the illustrated example surrounds or encompasses the entire perimeter of the pour opening 1708. As such, the first wall 1710 of the illustrated example defines a perimeter that substantially matches the perimeter of the pour opening 1708. The first wall 1710 of the illustrated example is substantially similar to the first wall 820 of FIG. 8B. Accordingly, the first wall 1710 of the illustrated example includes a first end 1712 (e.g., the first end 824 of FIG. 8B), a second end 1714 (e.g., the second end 826 of FIG. 8B), a lip 1716 (e.g., the lip 828 of FIG. 8B), and a first track 1718 (e.g., the first track 830 of FIG. 8B).

The cover 1702 of the illustrated example includes a body or base 1720 that covers the pour opening 1708 when the cover 1702 is in the closed position 1704. The base 1720 of the illustrated example has a kidney shaped perimeter and, thus, is complementary to the perimeter of the first wall 1710. To enable the base 1720 of the illustrated example to extend over the lip 1716 of the first wall 1710 when the can end 1700 is in the closed position 1704, the perimeter of the base 1720 is slightly larger (e.g., between approximately 0.5 percent and 2 percent larger) than the perimeter of the pour opening 1708.

To couple the cover 1702 of the illustrated example to the center panel 1706, the cover 1702 includes a web 1721. The web 1721 of the illustrated example is staked to the center panel 1706 to pivotally couple the cover 1702 to the center panel 1706. Thus, the base 1720 of the cover 1702 is repositionable relative to the first wall 1710 and/or the pour opening 1708 to configure the can end 1700 between the closed position 1704 and an open position (e.g., the open position 804 of FIG. 8B). Specifically, the web 1721 of the illustrated example is staked to the center panel 1706 via a rivet 1723, which enables the cover 1702 to pivot about the rivet 1723. Accordingly, the web 1721 of the illustrated example includes an opening 1725 (FIG. 17B) to receive the rivet 1723.

The cover 1702 of the illustrated example includes a crease or score line 1722. The score line 1722 of the illustrated example separates a first portion 1724 of the base 1720 and a second portion 1726 of the base 1720. The score line 1722 of the illustrated example is a hinge. As such, the first portion 1724, for instance is a fixed portion of the base 1720 and the second portion 1726 is a liftable or moveable portion (e.g., a liftable tab) of the base 1720. For example, the first portion 1724 of the base 1720 has a fixed spatial relationship relative to the center panel 1706 and the second portion 1726 of the base 1720 has an adjustable spatial relationship relative to the center panel 1706.

To facilitate pivotal movement of the second portion 1726 of the base 1720 relative to the first portion 1724, the cover 1702 of the illustrated example includes a latch or grip 1728. The grip 1728 of the illustrated example 1728 extends from the second portion 1726 of the base 1720. The grip 1728 of the illustrated example includes a first arm 1730, a second arm 1732, and a rim or handle 1734. Specifically, the first arm 1730 and the second arm 1732 of the illustrated example are separated (e.g., spaced apart) from each other and extend from the base 1720. The first arm 1730 and the second arm 1732 of the illustrated example include a thickness identical to a thickness of the base 1720. As such, the first arm 1730 and the second arm 1732 of the illustrated example include outer surfaces 1730*a*, 1732*a* that are flush with an outer surface 1720*a* of the base 1720 and inner surfaces 1730*b*,

1732*b* that are flush with an inner surface 1720*b* of the base 1720. The first arm 1730 of the illustrated example is fixed or joined to a first lateral end 1734*a* of the handle 1734. The second arm 1732 of the illustrated example is fixed or joined to a second lateral end 1734*b* of the handle 1734 opposite the first lateral end 1734*a*. The separation between the first arm 1730 and the second arm 1732 defines an opening 1736 between a midsection 1734*c* of the handle 1734 and the base 1720. In some examples, the first arm 1730 and the second arm 1732 are connected to eliminate the opening 1736.

The cover 1702 of the illustrated example includes a first notch 1742*a* and a second notch 1742*b* that align with the score line 1722 (e.g., aligned along a plane orthogonal to the center panel 1706). In this manner, the first notch 1742*a* and the second notch 1742*b* separate the first portion 1720 and the second portion 1726 and enable the second portion 1726 to pivot relative to the first portion 1720 about the score line 1722. Thus, the cover 1702 includes a second wall 1738, a third wall 1740 and a fourth wall 1744. The second and third walls 1738 and 1740 are separated by the first notch 1742*a* and the second and fourth walls 1738 and 1744 are separated by the second notch 1742*b*. Accordingly, the third wall 1740 and the fourth wall 1744 can pivot or rotate about the score line 1722 with the second portion 1726 of the base 1720, which allows the third wall 1740 and the fourth wall 1744 to be lifted away (e.g., separated) from the center panel 1706. Additionally, the walls 1738, 1740, 1744 of the illustrated example extend in a direction away from an outer surface 1720*a* of the base 1720 (e.g., toward the center panel 1706). In this manner, the walls 1738, 1740, 1744 of the illustrated example are positioned around a portion of the perimeter of the first wall 1710 when the can end 1700 is in the closed position 1704. For example, the third and fourth walls 1740, 1744 of the illustrated example extend around a portion (e.g., between approximately 30 percent to 60 percent) of the perimeter of the second portion 1726 of the base 1720.

The cover 1702 of the illustrated example includes a first locking tab 1746 and a second locking tab 1748. The first and second locking tabs 1746 and 1748 are formed on the second portion 1726 of the base 1720 of the cover 1702. In the illustrated example, the first locking tab 1746 is a first curl 1746*c* and the second locking tab 1748 is a second curl 1748*c*. In other examples, the first and second locking tabs 1746, 1748 can have different shapes. The first locking tab 1746 of the illustrated example is separated from the second locking tab 1748 by a first gap 1752. That is, the first locking tab 1746 of the illustrated example is formed between the third wall 1740 and the first gap 1752 or the first arm 1730 of the grip 1728. In this example, the first arm 1730 aligns with the first gap 1752. The second locking tab 1748 of the illustrated example is formed between the first arm 1730 of the grip 1728 (or the first gap 1752) and the second arm 1732 of the grip 1728 (or a second gap 1754 formed between the second locking tab 1748 and the fourth wall 1744). In this example, the second gap 1754 aligns with the second arm 1732 of the grip 1734. Specifically, the second locking tab 1748 of the illustrated example is formed from material that is curled away from the grip 1734 to define the opening 1736.

In the illustrated example, a first end 1746*a* of the first locking tab 1746 is spaced from and oriented toward the third wall 1740 and a second end 1746*b* of the first locking tab 1746 is oriented toward a first end 1748*a* of the second locking tab 1748. Additionally, a second end 1748*b* of the second locking tab 1748 is oriented toward the fourth wall 1744. The first locking tab 1746 and the second locking tab 1748 of the illustrated example extend around a portion (e.g., between approximately 10 percent to 40 percent) of the perimeter of the second portion 1726 of the base 1720.

The first locking tab 1746 and the second locking tab 1748 of the illustrated example are partial curls (e.g., semi-circular or arcuate shapes, partially circular or arcuate shapes, less than a full curl, etc.) that extend downwardly from the second portion 1726 of the base 1720 and curl in a direction toward a longitudinal axis 1702*a* of the cover 1702. The first locking tab 1746 and the second locking tab 1748 of the illustrated example wrap around the lip 1716 of the first wall 1710 when the can end 1700 is in the closed position 1704. Thus, inner surfaces 1746*d*, 1748*d* of the first curl 1746*c* and the second curl 1748*c*, respectively, interface (e.g., engage via friction) with the lip 1716. Accordingly, the first curl 1746*c* and the second curl 1748*c* are interlocked and/or engaged with the first track 1718. In some examples, the first wall 1710 includes grooves to receive respective edges 1746*e*, 1748*e* of the first and second curls 1746*c*, 1748*c* when the can end 1700 is in the closed position 1704.

The cover 1702 of the illustrated example includes a projection or protrusion 1756 extending from the second wall 1738. The protrusion 1756 of the illustrated example extends downwardly from the second wall 1738 in a direction away from the inner surface 1720*b* of the base 1720. The protrusion 1756 of the illustrated example curls in a direction toward the longitudinal axis 1702*a* of the cover 1702 and continues to curl in a direction toward an inner surface 1738*a* of the second wall 1738. Thus, the protrusion 1756 of the illustrated example is a third curl 1756*a*. The third curl 1756*a* of the illustrated example extends around a portion (e.g., between approximately 20 percent to 70 percent) of the perimeter of the second wall 1738. The third curl 1756*a* of the illustrated example engages and/or interlocks with the first track 1718 when the can end 1700 is in the closed position 1704. For example, the third curl 1756*a* interfaces (e.g., engages via friction) with the center panel 1706, the first wall 1710, and the lip 1716 when the can end 1700 is in the closed position 1704.

The cover 1702 of the illustrated example includes a second track 1758 defined between the base 1720 of the cover 1702 and the first, second, and third curls 1746*c*, 1748*c*, 1756*a*. When the can end 1700 is in the closed position 1704, the lip 1716 of the first wall 1710 is engaged and interlocked with the second track 1758. For example, the lip 1716 interfaces (e.g., engages via friction) with the base 1720, the second wall 1738, the first curl 1746*c*, the second curl 1748*c*, and the third curl 1756*a* when the can end 1700 is in the closed position 1704. Accordingly, the engagement between (1) the lip 1716 and the second track 1758 and (2) the first, second, and third curls 1746*c*, 1748*c*, 1756*a* and the first track 1718, presses the base 1720 toward the center panel 1706 to conceal the pour opening 1708.

Figure 18A:
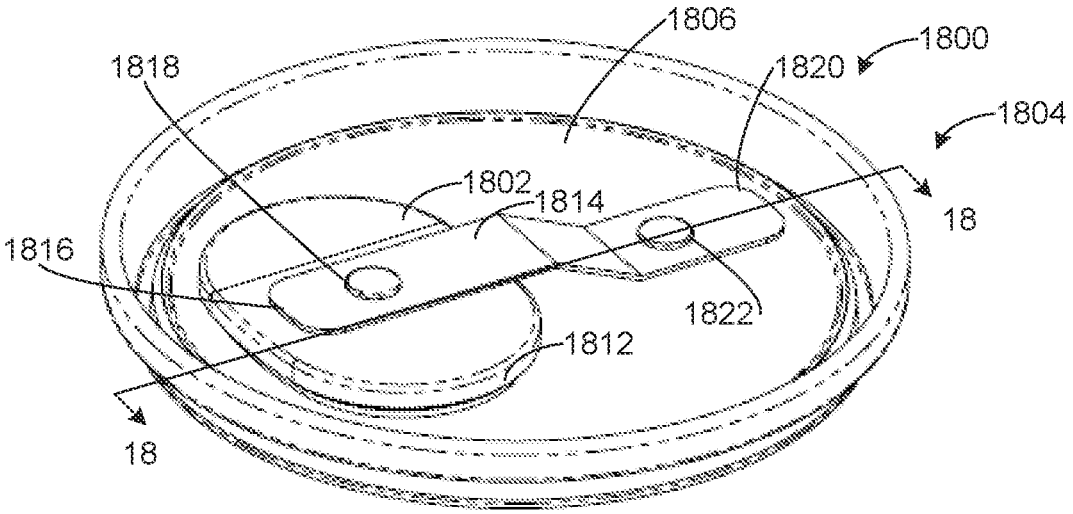
FIG. 18A is a perspective view of another example can end in accordance with teachings disclosed herein.
Figure 18B:
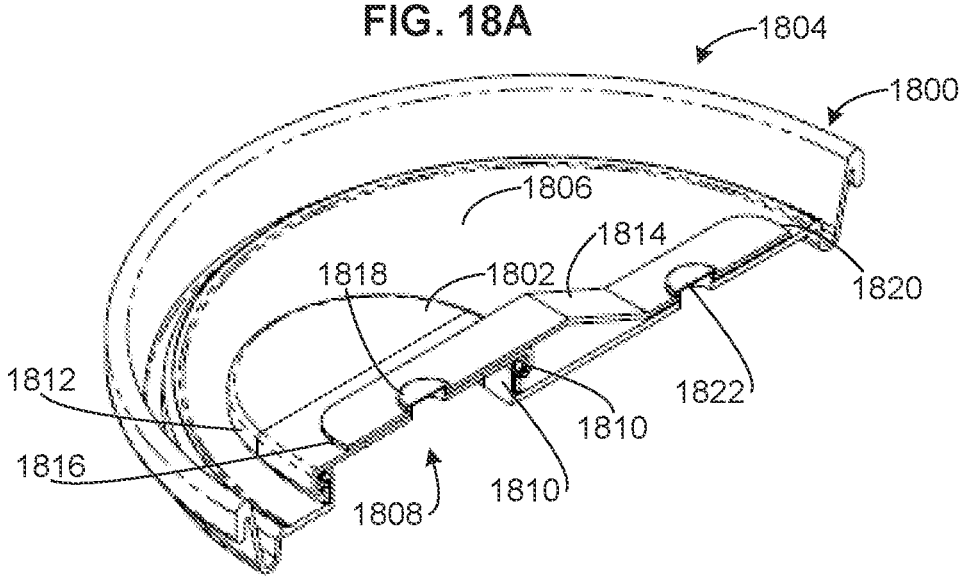
FIG. 18B is a perspective, cross-sectional view of the example can end of FIG. 18A.
Figure 18C:
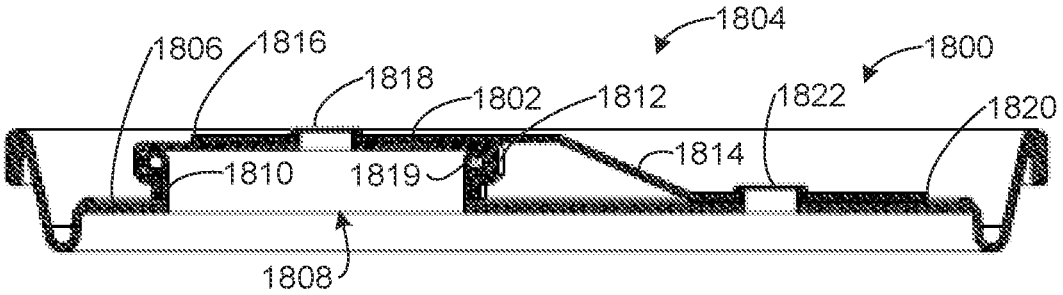
FIG. 18C is a cross-sectional view of the example can end taken along line 18-18 of FIG. 18A.

FIG. 18A is a perspective view of another example can end 1800 in accordance with the teachings disclosed herein. The can end 1800 of the illustrated example includes a cover 1802 (e.g., a removable cap). In the example of FIG. 18A, the cover 1802 is shown in an example closed position 1804. FIG. 18B is a perspective cross-sectional view of the example can end 1800 taken along line 18-18 of FIG. 18A. FIG. 18C is a cross-sectional view of the example can end 1800 taken along line 18-18 of FIG. 18A.

In the closed position 1804, the cover 1802 provides a seal to prevent contents in the container attached to the can end 1800 from spilling out from the container. The can end 1800 of the illustrated example includes a center panel 1806 having a pour opening 1808 and a first wall 1810 extending from the center panel 1806 around a perimeter of the pour opening 1808. To prevent contents from flowing through the pour opening 1808 when the cover 1802 is in the closed position 1804, the cover 1802 includes a second wall 1812 (e.g., an annular wall) that engages and/or interlocks with the first wall 1810 (e.g., via a friction fit). In the illustrated example, the second wall 1812 is an annular wall that extends around an entire perimeter or circumference of the cover 1802. However, in some examples, the second wall 1812 can be structured to extend around a portion of the perimeter or circumference of the cover 1802. To pivotally couple the cover 1802 of the illustrated example to the center panel 1806, the can end 1800 includes a tether 1814. The tether 1814 of the illustrated example includes a first end 1816 that is coupled or staked to the cover 1802 via a first rivet 1818 and a second end 1820 that is coupled or staked to the center panel 1806 via a second rivet 1822. In some examples, the first end 1816 of the tether 1814 can be coupled to the cover 1802 and/or the second end of the tether 1820 can be coupled to the can end 1800 via welding, adhesive and/or any other fastening and/or manufacturing process(es).

In operation, the cover 1802 can be removed from the can end 1800 by applying a lifting force to the cover 1802 in a direction away from the center panel 1806. The lifting force causes the second wall 1812 of the cover 1802 to detach or decouple from the first wall 1810 of the pour opening 1808. In some examples, the second wall 1812 deflects or bends outwardly relative to the first wall 1810 when a lifting force is applied to the cover 1802 in a direction away from the center panel 1806 to enable the second wall 1812 to detach or disengage from the first wall 1810. In some examples, after the cover 1802 is removed or decoupled from the first wall 1810, the cover 1802 moves or pivots away from the pour opening 1808 via the tether 1814. In other words, the tether 1814 bends (e.g., at a point between the first rivet 1818 and the second rivet 1822) to enable the cover 1802 to lift in a direction away from the pour opening 1808. In some examples, after the cover 1802 is removed from the first wall 1810, the cover 1802 rotates or pivots away (e.g., in a sideways direction) from the pour opening 1808 about a pivot axis of the second rivet 1822 to enable access to the pour opening 1808. In other words, the cover 1802 can be pivoted upward about the tether 1814 (e.g., where the tether deflects or bends) and/or can be rotated about a pivot axis of the second rivet 1822. Therefore, in some examples, the second rivet 1822 can be structured to allow the tether 1814 to rotate about a pivot axis of the second rivet 1822. In some examples, the second rivet 1822 can be structured to prevent rotation about the pivot axis of the second rivet 1822.

In the illustrated example, when the cover 1802 is removed from the pour opening 1808, the tether 1814 maintains the cover 1802 attached to the can end 1800 (e.g., the central panel 1806). The first rivet 1818 is fixed to the cover 1802 and does not allow movement of the cover 1802 relative to the first rivet 1818 (e.g., the cover 1802 is fixed and cannot rotate about a longitudinal axis of the first rivet 1818).

Additionally, the cover 1802 of the illustrated example is a re-closeable cover that enable the pour opening 1808 to be closed after being opened (e.g., an initial opening). To reclose the pour opening 1808, the cover 1802 is repositioned over the pour opening 1808 (e.g., via the tether 1814). A pressing force is applied to the cover 1802 to cause the cover 1802 to reengage the first wall 1810 of the pour opening 1808. Specifically, the cover 1802 attaches to the first wall 1810 via a snap-fit connection. In particular, a pressing force applied to the cover 1802 in a direction toward the center panel 1806 when the cover 1802 is positioned over the first wall 1810 causes the second wall 1812 of the cover 1802 to attach to the first wall 1810 via snap-fit or friction-fit connection. In some examples, the second wall 1812 deflects or bends outwardly over the first wall 1810 to pass over an annular bulb or curl 1819 of the first wall 1810. The first wall 1810 of the pour opening 1808 and the second wall 1812 of the cover 1802 can be structured with track interfaces similar to the first tracks 132, 830, 1718 and the second tracks 302, 1006, 1758 described above. Thus, the tether 1814 retains the cover 1802 to the can end 1800 to allow for re-closeable use. The cover 1802 and/or the tether 1814 of the illustrated example is formed of metal (e.g., aluminum). In some examples, the cover 1802 and/or the tether 1814 can be made of plastic and/or any other suitable material(s) and/or a combination thereof.

The foregoing examples of the can ends can be used with aluminum cans. In some examples, the can end 100, 800, 1300, 1400, 1500, 1600, 1700, 1800 and the covers 106, 806, 1200, 1302, 1406, 1702, 1802 are made from aluminum, plastic, and/or other materials, and/or a combination thereof.

Also, although each example can end disclosed above has certain features, it should be understood that it is not necessary for a particular feature of one example can end to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

From the foregoing, it will be appreciated that example re-closable can ends have been disclosed that protect and preserve contents within an associated container. The example re-closable can ends disclosed herein can be aluminum and/or maintain functionalities through numerous opening and closing cycles to allow consumers to enjoy the contents within the associated container at their own pace. In addition, the example re-closable can ends disclosed herein provide an easy-to-use design to minimize or otherwise reduce difficulties encountered by consumers when opening and/or closing the example re-closable can ends. For instance, the example re-closable can ends disclosed herein include a grip for easy movement of an associated cover. Additionally, the cover of the example re-closable can ends disclosed herein snaps into and/or out of a latched position to indicate the state of the example re-closable can end to the associated consumer. In addition, the example re-closable can ends disclosed herein include tamper evidence features to ensure consumers of the security of the associated container.

Example can ends having re-closable pour openings are disclosed herein. Further examples and combinations thereof include the following:

Example 1 includes a can end including a center panel having a pour opening, a first wall extending from the center panel around a perimeter of the pour opening, and a cover rotatably coupled to the center panel, the cover rotatable relative to the pour opening between a first position and a second position, the cover to interlock with the first wall when the cover is in the first position to prevent access to the pour opening, the cover to expose the pour opening when the cover is in the second position.

Example 2 includes the can end of example 1, wherein the cover includes a web staked to the center panel via a rivet, the cover to rotate about the rivet.

Example 3 includes the can end of any one of examples 1-2, wherein the cover includes a second wall extending toward the center panel, the second wall to be positioned around at least a portion of a perimeter of the first wall when the cover is in the first position.

Example 4 includes the can end of any one of examples 1-3, wherein the cover includes a hinge between a first portion of the cover and a second portion of the cover, the first portion of the cover to pivot about the hinge to enable the cover to move between the first position and the second position.

Example 5 includes the can end of any one of examples 1-4, wherein the cover includes a second wall extending from the first portion of the cover toward the center panel, a third wall extending from the second portion of the cover toward the center panel, and a rib coupled to the second wall and the third wall, the rib to rupture in response to the first portion of the cover pivoting about the hinge.

Example 6 includes the can end of any one of examples 1-5, further including a grip extending from the first portion of the cover.

Example 7 includes the can end of any one of examples 1-6, wherein the first wall includes a first end and a second end opposite the first end, the second end of the first wall fixed the center panel, the first end of the first wall including a first protrusion extending outward relative to the pour opening, the first wall having a first track defined between the center panel and the first protrusion.

Example 8 includes the can end of any one of examples 1-7, wherein the cover includes a body and a second wall extending from the body toward the center panel, the second wall including a second protrusion extending from an interior surface of the second wall, the second protrusion to engage with the first track when the cover is in the first position.

Example 9 includes the can end of any one of examples 1-8, wherein the cover includes a second track defined between the body, the second wall, and the second protrusion, the first protrusion of the first wall to engage the second track when the cover is in the first position.

Example 10 includes a can end including a center panel having a pour opening, a first wall extending from the center panel around a perimeter of the pour opening, and a cover coupled to the center panel, the cover including a hinge separating a first portion of the cover and a second portion of the cover, the second portion of the cover to pivot relative to the first portion about the hinge to enable the cover to rotate between a first position to conceal the pour opening and a second position to expose the pour opening.

Example 11 includes the can end of example 10, wherein the first portion of the cover includes a second wall and the second portion of the cover includes a third wall, the second wall and the third wall extending toward the center panel, the second wall and the third wall positioned around at least a portion of a perimeter of the first wall when the cover is in the first position.

Example 12 includes the can end of any one of examples 10 or 11, wherein the second wall is to slide on the center panel when the cover rotates between the first position and the second position.

Example 13 includes the can end of any one of examples 10-12, wherein the first wall and the second wall include a protrusion extending toward a longitudinal axis of the cover.

Example 14 includes the can end of any one of examples 10-13, wherein the first wall includes a first end and a second end opposite the first end, the first end of the first wall is fixed to the center panel, the second end of the first wall including a lip projecting away from the pour opening, the lip of the first wall to engage the protrusion of the cover when the cover is in the first position.

Example 15 includes the can end of any one of examples 10-14, further including at least one rib extending between the second wall and the third wall, the rib to rupture in response to pivoting the first portion of the cover relative to the second portion about the hinge.

Example 16 includes the can end of any one of examples 10-15, further including a tab extending from the cover, the cover to bend at the hinge in response to the tab being lifted.

Example 17 includes the can end of any one of examples 10-16, further including a web extending from the cover, the web to be staked to the center panel via a rivet to couple the cover to the center panel, the cover to rotate about the rivet.

Example 18 includes a can end includes a center panel having a pour opening, a first wall positioned around a perimeter of the pour opening, the first wall extending away from the center panel, the first wall including a first end and a second end opposite the first end, the first end fixed to the center panel, the second end including a lip, the lip extending outward relative to the pour opening, and a cover pivotably coupled to the center panel, the cover including a second wall extending from a body of the cover toward the center panel, the second wall including a first protrusion extending inward relative to the cover, the cover to pivot between a closed position to conceal the pour opening and an open position to expose the pour opening.

Example 19 includes the can end of example 18, wherein the cover includes a hinge separating a first portion of the cover and a second portion of the cover, the first portion of the cover to pivot relative to the second portion about the hinge.

Example 20 includes the can end of any one of examples 18-19, wherein the cover further includes a third wall extending from the body, wherein the second wall is associated with the first portion of the cover and the third wall is associated with the second portion of the cover, the second wall and the third wall separated by a notch.

Example 21 includes the can end of any one of examples 18-20, further including at least one rib traversing the notch, the at least one rib coupled to the second wall and the third wall, the at least one rib to rupture in response to the first portion of the cover being initially moved from a latched position to an unlatched position.

Example 22 includes the can end of any one of examples 18-20, wherein the first protrusion is to slidably engage the lip in response to the second wall being positioned around at least a portion of a perimeter of the first wall.

Example 23 includes the can end of any one of examples 18-22, wherein the cover further includes a second protrusion extending from the third wall, wherein the first protrusion and the second protrusion at least pivotally disengage in response to the second portion of the cover lifting away from the center panel about the hinge, the cover to pivot between the closed position and the open position in response to the first protrusion and the second protrusion being at least partially disengaged.

Example 24 includes the can end of any one of examples 18-23, wherein the body of the cover includes a mid-panel and an outer ring, the mid-panel recessed relative to the outer ring, a perimeter of the mid-panel to be adjacent to the first wall and the outer ring to engage the second end of the first wall when the cover is in the closed position.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. A can end comprising:

a center panel having a pour opening;

a first wall extending from an upper surface of the center panel around a perimeter of the pour opening, the first wall including a first end and a second end opposite the first end, the second end of the first wall fixed the center panel, the first end of the first wall including a first protrusion extending outward relative to the pour opening, the first wall having a first track defined between the center panel and the first protrusion; and a cover rotatably coupled to the center panel about a rotational axis, the cover rotatable relative to the pour opening between a first position to cover the pour opening and to restrict access to the pour opening and a second position to uncover the pour opening to expose to the pour opening, the cover having a locking tab pivotally coupled to the cover, the locking tab to pivot between a locked position and an unlocked position when the cover is in the first position, the locking tab in the locked position to interlock with the first wall of the center panel to prevent rotation of the cover about the rotational axis when the cover is in the first position to restrict access to the pour opening, the locking tab in the unlocked position to disengage the first wall when the cover is in the first position to enable the cover to rotate about the rotational axis to move to the second position, the cover including a body and a second wall extending from the body toward the center panel, the second wall including a second protrusion extending from an interior surface of the second wall, the second protrusion to engage the first track when the cover is in the first position.

2. The can end of claim 1, wherein the cover includes a web staked to the center panel via a rivet, the rivet defining the rotational axis such that the cover is to rotate about the rivet.

3. The can end of claim 1, wherein the panel the second wall is positioned around at least a portion of a perimeter of the first wall when the cover is in the first position, wherein the locking tab is to remain in the unlocked position when rotating the cover to the first position to prevent interference between the locking tab and the first wall as the cover rotates from the second position to the first position.

4. A can end comprising:

a center panel having a pour opening;

a first wall extending from an upper surface of the center panel around a perimeter of the pour opening; and a cover rotatably coupled to the center panel about a rotational axis, the cover rotatable relative to the pour opening between a first position to cover the pour opening and to restrict access to the pour opening and a second position to uncover the pour opening to expose to the pour opening, the cover having a locking tab pivotally coupled to the cover, the locking tab to pivot between a locked position and an unlocked position when the cover is in the first position, the locking tab in the locked position to interlock with the first wall of the center panel to prevent rotation of the cover about the rotational axis when the cover is in the first position to restrict access to the pour opening, the locking tab in the unlocked position to disengage the first wall when the cover is in the first position to enable the cover to rotate about the rotational axis to move to the second position, the cover including a rib coupled to the lock and the cover, the rib to rupture in response to the locking tab pivoting about a hinge relative to the cover.

5. The can end of claim 4, wherein the the hinge is positioned between the locking tab and the cover.

6. The can end of claim 1, further including a grip extending from the locking tab.

7. The can 4 of claim 4, wherein the first wall includes a first end and a second end opposite the first end, the second end of the first wall fixed the center panel, the first end of the first wall including a first protrusion extending outward relative to the pour opening, the first wall having a first track defined between the center panel and the first protrusion.

8. The can end of claim 7, wherein the cover includes a body and a second wall extending from the body toward the center panel, the second wall including a second protrusion extending from an interior surface of the second wall, the second protrusion to engage with the first track when the cover is in the first position.

9. The can end of claim 8, wherein the cover includes a second track defined between the body, the second wall, and the second protrusion, the first protrusion of the first wall to engage the second track when the cover is in the first position.

10. A can end comprising:

a center panel having a pour opening;

a first wall extending from the center panel around a perimeter of the pour opening; and a cover coupled to the center panel via a rivet defining a rotational axis of the cover, the cover including a hinge separating a first portion of the cover and a second portion of the cover, the second portion of the cover to pivot relative to the first portion about the hinge to enable the cover to rotate about the rotational axis between a first position to conceal the pour opening and a second position to expose the pour opening, the cover to slidably engage the first wall in response to the cover rotating about the rotational axis between the first position and the second position.

11. The can end of claim 10, wherein the first portion of the cover includes a second wall and the second portion of the cover includes a third wall, the second wall and the third wall extending toward the center panel, the second wall and the third wall positioned around at least a portion of a perimeter of the first wall when the cover is in the first position.

12. The can end of claim 11, wherein the second wall is to slide relative to the first wall and the center panel when the cover rotates between the first position and the second position.

13. The can end of claim 10, wherein the first wall includes a lip, the lip to engage the cover when the cover is in the first position.

14. The can end of claim 11, further including at least one rib extending between the second wall and the third wall, the rib to rupture in response to pivoting the first portion of the cover relative to the second portion about the hinge.

15. The can end of claim 10, further including a tab extending from the cover, the first portion of the cover to bend relative to the second portion at the hinge in response to the tab being lifted.

16. The can end of claim 10, further including a web extending from the cover, the web to be staked to the center panel via the rivet to couple the cover to the center panel.

17. A can end comprising:

a center panel having a pour opening;

a first wall positioned around a perimeter of the pour opening, the first wall extending away from the center panel, the first wall including a first end and a second end opposite the first end, the first end fixed to the center panel, the second end including a lip, the lip extending outward relative to the pour opening; and a cover pivotably coupled to the center panel, the cover to pivot between a closed position to conceal the pour opening and an open position to expose the pour opening, the cover including:

a hinge separating a first portion of a body of the cover and a second portion of the body of the cover, the first portion to pivot relative to the second portion about the hinge;

a second wall extending from the first portion toward the center panel, the second wall including a first protrusion extending inward relative to the cover;

a third wall extending from the second portion, the second wall and the third wall separated by a notch; and at least one rib traversing the notch, the at least one rib coupled to the second wall and the third wall, the at least one rib to rupture in response to the first portion of the cover being initially moved from a latched position to an unlatched position.

18. The can end of claim 17, wherein the first protrusion is to slidably engage the lip in response to the second wall being positioned around at least a portion of a perimeter of the first wall.

19. The can end of claim 18, wherein the cover further includes a second protrusion extending from the third wall, wherein the first protrusion and the second protrusion at least pivotally disengage in response to the second portion of the cover lifting away from the center panel about the hinge, the cover to pivot between the closed position and the open position in response to the first protrusion and the second protrusion being at least partially disengaged.

20. The can end of claim 17, wherein the body of the cover includes a mid-panel and an outer ring, the mid-panel recessed relative to the outer ring, a perimeter of the mid-panel to be adjacent to the first wall and the outer ring to engage the second end of the first wall when the cover is in the closed position.

21. The can end of claim 1, wherein the second wall is positioned further than the first protrusion from the center panel to enable the cover to rotate between the first position and the second position.

22. The can end of claim 21, wherein the cover includes a third wall extending from the body toward the center panel, the third wall including a third protrusion extending from an interior surface of the third wall, the third protrusion separated from the second protrusion by a gap, the third protrusion to engage with the first track when the cover is in the first position.

23. A can end comprising:

a center panel having a pour opening;

a first wall extending from the center panel around a perimeter of the pour opening; and a cover coupled to the center panel via a rivet defining a rotational axis of the cover, the cover including a hinge separating a first portion of the cover and a second portion of the cover, the second portion of the cover to pivot relative to the first portion about the hinge to enable the cover to rotate about the rotational axis between a first position to conceal the pour opening and a second position to expose the pour opening, wherein the cover is to slide relative the first wall when the cover rotates about the rotational axis between the first position and the second position, the cover including a first protrusion and a second protrusion separated by a gap, the first wall including a third protrusion, the first protrusion and the second protrusion to engage the third protrusion when the cover is in the first position.

24. The can end of claim 1, wherein the cover is to slide relative to the center panel when the cover moves from the first position to the second position.

* * * * *